US006635413B1

(12) United States Patent
Inami et al.

(10) Patent No.: US 6,635,413 B1
(45) Date of Patent: Oct. 21, 2003

(54) LIGHTSENSITIVE SILVER HALIDE EMULSION, PRODUCTION THEREOF AND SILVER HALIDE PHOTOGRAPHIC LIGHTSENSITIVE MATERIAL CONTAINING THE SAME

(75) Inventors: Yoshiyasu Inami, Minami-Ashigara (JP); Hirotomo Sasaki, Minami-Ashigara (JP); Hiroshi Takeuchi, Minami-Ashigara (JP); Shunichi Aida, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/521,672

(22) Filed: Mar. 8, 2000

(30) Foreign Application Priority Data

Mar. 8, 1999 (JP) ..... 11-060628

(51) Int. Cl.[7] ..... G03C 1/08; G03C 1/09; G03C 1/005

(52) U.S. Cl. ..... 430/567; 430/567; 430/607; 430/611; 430/600; 430/604

(58) Field of Search ..... 430/567, 569, 430/607, 611, 600, 604

(56) References Cited

U.S. PATENT DOCUMENTS 5,187,259 A * 2/1993 Sterman et al. ..... 430/354
5,219,720 A * 6/1993 Black et al. ..... 430/567
5,242,791 A 9/1993 Hirano et al.
5,273,871 A * 12/1993 Takada et al. ..... 430/567
5,318,889 A * 6/1994 Bagchi et al. ..... 430/642
5,518,871 A * 5/1996 Urabe ..... 430/567
5,536,630 A * 7/1996 Bagchi et al. ..... 430/567
5,614,360 A * 3/1997 Harbison et al. ..... 430/612
5,650,265 A * 7/1997 Sniadoch et al. ..... 430/530
5,665,530 A * 9/1997 Oyamada et al. ..... 430/567
5,972,588 A * 10/1999 Nabeta ..... 430/567
6,200,744 B1 3/2001 Sasaki et al.

FOREIGN PATENT DOCUMENTS

JP 6332093 12/1994

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A process for producing a lightsensitive silver halide emulsion comprising silver halide grains, wherein the emulsion contains tabular silver halide grains in an amount of at least 50% of the total projected area of all the silver halide grains, the average iodine content of all the silver halide grains is at least 2 mol %, and the tabular silver halide grains have at least 10 dislocation lines per grain, wherein the process comprises (step 1) set fourth below, and the process comprises a step of performing chemical sensitization so that a selenium sensitizer is added in an amount of $2.5\times10^{-6}$ to $5\times10^{-5}$ mol/mol silver and comprises a step of performing spectral sensitization (step 1) performing the spectral sensitization in which a spectral sensitizer is added in the presence of 50 ppm or less of calcium, magnesium and strontium, followed by adding at least one water-soluble salt of a metal selected from the group consisting of calcium, magnesium and strontium, so that the concentration of calcium, magnesium and strontium becomes 100–2500 ppm, and then the chemical sensitization is started.

18 Claims, No Drawings

LIGHTSENSITIVE SILVER HALIDE EMULSION, PRODUCTION THEREOF AND SILVER HALIDE PHOTOGRAPHIC LIGHTSENSITIVE MATERIAL CONTAINING THE SAME

CROSS-REFERENCE TO RELATED APPLICATION

This application is based upon and claims the benefit of priority from the prior Japanese Patent Application No. 11-060628, filed Mar. 8, 1999, the entire contents of which are incorporated herein by reference.

BACKGROUND OF THE INVENTION

The present invention relates to a silver halide photographic emulsion. More particularly, the present invention relates to a tabular silver halide grain photographic emulsion which is excellent in photographic speed and graininess, ensures slight change of photographic performance after storage and also ensures less fog occurrence, and further relates to a process for producing the same and a silver halide photographic lightsensitive material containing the above emulsion.

Methods of converting, for example, tabular grains to those of a high aspect ratio or a monodispersion for enhancing the sensitivity/graininess ratio of silver halide photographic emulsion are well known to persons of ordinary skill in the art to which the invention pertains. Further, combining a monodisperse tabular material of high aspect ratio with selenium sensitization to thereby enable a sensitivity enhancement, as described in Jpn. Pat. Appln. KOKAI Publication No. (hereinafter referred to as JP-A-) 6-332093, is known. Still further, combining an emulsion having its intergranular iodine distribution regulated to a monodispersion with selenium sensitization to thereby enable a sensitivity enhancement, as described in JP-A-6-11782 and JP-A-9-15776, is known. However, the realized sensitivity is still unsatisfactory, and a further enhancement of sensitivity is desired. These patent application specifications, although describing the amount of added selenium sensitizer or gold sensitize, do not describe the substantial amount of selenium or gold contained in grains and fail to specify any substantial selenium/gold ratio. There is no precedent of performing a simultaneous control of the ratio of selenium/gold contained in grains. The inventors have first found in the investigations for the present invention that controlling the selenium/gold ratio within a specified range is important for attaining a sensitivity enhancement.

With respect to the silver halide photographic lightsensitive material, a high sensitivity is demanded. The degree of change of photographic performance by storage of a lightsensitive material after production tends to increase with the sensitivity enhancement. Consequently, it is demanded to suppress this, and especially a technology for suppressing fogging is required.

In this connection, adding a palladium compound such as a palladium complex of ethylenediamine in order to suppress fogging is disclosed in, for example, U.S. Pat. No. 2,552,229, U.S. Pat. No. 2,566,263 and JP-A-5-333480. This is practically effective in suppressing the fog increase during storage.

JP-A-8-234341 (U.S. Pat. No. 5,614,360) discloses that the use of a palladium compound of ethylenediamine is advantageous in that any viscosity increase does not occur even in high gelatin concentrations. However, when the storage is conducted under tropical conditions of high temperature and high humidity, the fog suppressing effect thereof is not satisfactory. Thus, further improvement is desired (with respect to the fog during storage under tropical conditions, data are available from U.S. Pat. No. 2,552,229).

In the investigations for the present invention, it was further found that the use of Pd complexes described in the above JP-A-8-234341 (U.S. Pat. No. 5,614,360) has a drawback in that the degree of change of photographic performance during running processing is increased. In the production of silver halide photographic lightsensitive material, it is also desired that the degree of change of photographic performance during running processing be slight. Therefore, there is a demand for simultaneously suppressing the change of photographic performance during storage and the change of photographic performance during running processing.

The inventors have found that these tasks can be attained by the use of a specified palladium complex according to the present invention. There is no precedent of disclosing the use of the specified palladium compound and no precedent of applying the same to the lightsensitive silver halide emulsion of the present invention.

On the other hand, the use of a mercaptotetrazole compound having a water-soluble group in order to suppress the fogging during storage is described in JP-A-4-16838. It is disclosed to achieve a shelf life prolongation by the use of a mercaptotetrazole compound in combination with a mercaptothiadiazole compound.

However, the prior art fails to disclose the use of the emulsion of the present invention {lightsensitive silver halide emulsion comprising silver halide grains, wherein at least 50% of the total projected area are occupied by tabular silver halide grains; an average iodine content of all the silver halide grains is at least 2 mol %; and the tabular silver halide grains have at least 10 dislocation lines per grain; which lightsensitive silver halide emulsion satisfies at least one selected from among requirements (1) and (2) set forth below; and has undergone such chemical sensitization that a selenium sensitizer is added in an amount of $2.5\times10^{-6}$ to $5\times10^{-5}$ mol/mol silver and has undergone spectral sensitization: (1) the emulsion is prepared by performing the spectral sensitization in which a spectral sensitizer is added in the presence of 50 ppm or less of calcium, magnesium and strontium; followed by adding at least one water-soluble salt of a metal selected from the group consisting of calcium, magnesium and strontium, so that the concentration of calcium, magnesium and strontium becomes 100–2500 ppm; and then the chemical sensitization is started, and (2) the chemical sensitization and the spectral sensitization are performed in the presence of an alkali treated bone gelatin containing components of at least 280 thousand molecular weight in an amount of at least 30% in a molecular weight distribution measured by the PAGI method} in combination with a water-soluble mercapto compound. Further, the prior art fails to disclose advantageous effects attained by the use of a water-soluble mercaptotetrazole and a water-soluble mercaptotriazole in the emulsion as conducted in the present invention.

Although the inventors investigated the use of various types of compounds known as a water-soluble mercapto compound in the above emulsion of high sensitivity/graininess ratio according to the present invention, most thereof suffered from a sensitivity decrease. Further extensive investigations have been conducted, and it has been found that the use of a specified combination, namely the use of a water-soluble mercaptotetrazole and a water-soluble mercaptotriazole in combination, enables attaining a shelf life prolongation without detriment to the sensitivity.

A thiocyanate ion is useful for producing an emulsion of high sensitivity. It is well known to persons of ordinary skill in the art to which the invention pertains that reducing the amount thereof invites a sensitivity decrease. However, there is no precedent of particularly teaching that, with respect to the above emulsion of the present invention, not only is the amount of thiocyanate ion needed lower than the hitherto known level but also a shelf life prolongation can be attained thereby.

Limiting a surface silver iodide content for the purpose of suppressing the fogging during aging is effective. However, there is no precedent of attempting to lower an extreme-surface silver iodide content by adding and dissolving silver iodobromide fine grains having a silver iodide content lower than the surface silver iodide content of host grains during the after-ripening.

Incorporating a metal complex having a cyan ligand in emulsion grains in order to enhance a quantum sensitivity is described in, for example, JP-A-4-306642. However, there is no description particularly teaching that not only can the sensitivity/graininess ratio be further enhanced but also the fog increase during storage can be suppressed by combining the emulsion of the present invention {lightsensitive silver halide emulsion comprising silver halide grains, wherein at least 50% of the total projected area are occupied by tabular silver halide grains; an average iodine content of all the silver halide grains is at least 2 mol %; and the tabular silver halide grains have at least 10 dislocation lines per grain; which lightsensitive silver halide emulsion satisfies at least one selected from among requirements (1) and (2) set forth below; and has undergone such chemical sensitization that a selenium sensitizer is added in an amount of $2.5\times10^{-6}$ to $5\times10^{-5}$ mol/mol silver and has undergone spectral sensitization: (1) the emulsion is prepared by performing the spectral sensitization in which a spectral sensitizer is added in the presence of 50 ppm or less of calcium, magnesium and strontium; followed by adding at least one water-soluble salt of a metal selected from the group consisting of calcium, magnesium and strontium, so that the concentration of calcium, magnesium and strontium becomes 100–2500 ppm; and then the chemical sensitization is started, and (2) the chemical sensitization and the spectral sensitization are performed in the presence of an alkali treated bone gelatin containing components of at least 280 thousand molecular weight in an amount of at least 30% in a molecular weight distribution measured by the PAGI method} with the incorporation of a metal complex having a cyan ligand. It has first been found by the inventors that not only the enhancement of sensitivity/graininess ratio but also the improvement to fogging during storage can be attained by the addition of a hexacyanoiron (II) complex and a hexacyanoruthenium complex to the above emulsion during grain formation.

BRIEF SUMMARY OF THE INVENTION

An object of the present invention is to provide a silver halide photographic emulsion which is excellent in a sensitivity/fog ratio and a sensitivity/graininess ratio and provide a silver halide color photographic lightsensitive material including the emulsion. Another object of the present invention is to provide a silver halide photographic emulsion which ensures a remarkably prolonged shelf life and provide a silver halide color photographic lightsensitive material including the emulsion. A further object of the present invention is to provide a process for producing the above silver halide photographic emulsions.

DETAILED DESCRIPTION OF THE INVENTION

The objects of the present invention have been attained by the following means.

Embodiment I

A lightsensitive silver halide emulsion comprising silver halide grains, wherein at least 50% of the total projected of all the silver halide grains are occupied by tabular silver halide grains; an average iodine content of all the silver halide grains are at least 2 mol %; and the tabular silver halide grains have at least 10 dislocation lines per grain; and wherein the emulsion satisfies at least one selected from among requirements (1) and (2) set forth below; and the emulsion was undergone such chemical sensitization that a selenium sensitizer was added in an amount of $2.5\times10^{-6}$ to $5\times10^{-5}$ mol/mol silver and the emulsion was undergone spectral sensitization:

(1) the emulsion was prepared by performing the spectral sensitization in which a spectral sensitizer is added in the presence of 50 ppm or less of calcium, magnesium and strontium; followed by adding at least one water-soluble salt of a metal selected from the group consisting of calcium, magnesium and strontium, so that the concentration of calcium, magnesium and strontium became 100–2500 ppm; and then the chemical sensitization is started; and (2) the chemical sensitization and the spectral sensitization were performed in the presence of an alkali treated bone gelatin containing components of at least 280 thousand molecular weight in an amount of at least 30% in a molecular weight distribution measured by the PAGI method.

Embodiment II

A lightsensitive silver halide emulsion comprising silver halide grains, wherein at least 50% of the total projected of all the silver halide grains are occupied by tabular silver halide grains; an average iodine content of all the silver halide grains are at least 2 mol %; and the tabular silver halide grains have at least 10 dislocation lines per grain; and wherein the emulsion satisfies at least one selected from among requirements (1) and (2) set forth below; and the emulsion was undergone such chemical sensitization that the selenium/gold molar ratio in the grains became 0.8 to 10; and the emulsion was undergone spectral sensitization:

(1) the emulsion was prepared by performing the spectral sensitization in which a spectral sensitizer is added in the presence of 50 ppm or less of calcium, magnesium and strontium; followed by adding at least one water-soluble salt of a metal selected from the group consisting of calcium, magnesium and strontium, so that the concentration of calcium, magnesium and strontium became 100–2500 ppm; and then the chemical sensitization is started; and (2) the chemical sensitization and the spectral sensitization were performed in the presence of an alkali treated bone gelatin containing components of at least 280 thousand molecular weight in an amount of at least 30% in a molecular weight distribution measured by the PAGI method.

Emodiment III

The emulsion of Embodiment I or Embodiment II above, wherein each of the silver halide grains has a twin face spacing of 0.017 $\mu$m or less.

Emodiment IV

The emulsion of any one of Embodiments I to III above, wherein the silver halide grains are those produced by a process in which, in the crystal growth step thereof, fine silver halide grains containing silver iodide in an amount of at least 95 mol % are formed by mixing together an aqueous solution of a water-soluble silver salt and an aqueous solution of a water-soluble halide by means of a mixer provided outside a reactor vessel for use in the crystal growth and, immediately after the formation of the fine silver halide grains, the fine grains are fed in the reactor vessel for use in the crystal growth.

Emodiment V

The emulsion of any one of Embodiments I to IV above, which is one produced by, at the time of the chemical sensitization thereof, adding and dissolving a silver iodobromide emulsion prepared in advance to thereby effect a shell attachment.

Emodiment VI

The emulsion of any one of Embodiments I to V above, which is one produced by adding at least one complex selected from the group consisting of hexacyanoiron (II) complexes and hexacyanoruthenium complexes at the time of grain formation thereof.

Emodiment VII

A silver halide color photographic lightsensitive material comprising a support and, superimposed thereon, at least one blue-sensitive silver halide emulsion layer containing a yellow coupler, at least one green-sensitive silver halide emulsion layer containing a magenta coupler, at least one red-sensitive silver halide emulsion layer containing a cyan coupler and at least one hydrophilic protective colloid layer, wherein calcium ions, magnesium ions and strontium ions are contained in a coating amount, in terms of atomic weight, of $8.0\times10^{-2}$ g or less per g of gelatin and wherein at least one emulsion for use in the above emulsion layers is the lightsensitive silver halide emulsion of any one of Embodiments I to VI above.

Embodiment VIII

The lightsensitive material comprising the silver halide emulsion of any one of Embodiments I to VI above, which satisfies at least one selected from among the following requirements (1) to (3):

(1) at least one Pd(II) complex represented by the following general formula (I-1) is contained:

(I-1)

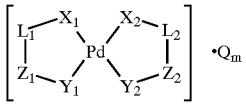

wherein each of $X_1$ and $X_2$ independently represents —$S(R_{11})$—, —$N(R_{12})(R_{13})$— or —$O(R_{14})$—; each of $Y_1$ and $Y_2$ independently represents —$S(R_{21})$—, —$N(R_{22})(R_{23})$— or —$O(R_{24})$—; each of $Z_1$ and $Z_2$ independently represents an alkylene group, an arylene group or a divalent heterocyclic residue; each of $L_1$ and $L_2$ independently represents a single bond, an alkylene group, —CO— or —$SO_2$—; Q represents an anionic ion; m is an integer of 0 to 4; provided that, when each of $X_1$ and $X_2$ independently is —$N(R_{12})(R_{13})$— and each of $Y_1$ and $Y_2$ independently is —$N(R_{22})(R_{23})$—, each of $L_1$ and $L_2$ independently represents —CO— or —$SO_2$—; each of $R_{11}$, $R_{14}$, $R_{21}$ and $R_{24}$ independently represents a hydrogen atom, an alkyl group, a cycloalkyl group, an alkenyl group, an alkynyl group, an aralkyl group, an aryl group or a heterocyclic group; each of $R_{12}$, $R_{13}$, $R_{22}$ and $R_{23}$ independently represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, an alkylsulfonyl group or an arylsulfonyl group; and, when $R_{12}$ or $R_{22}$ is a hydrogen atom, the N-position proton may be dissociated to thereby result in coordination with Pd(II);

(2) at least one water-soluble mercaptotetrazole compound represented by the following general formula (II-1) and at least one water-soluble mercaptotriazole compound represented by the following general formula (II-2) are contained:

(II-1)

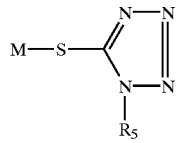

wherein $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms,. —$COR_3$, —$COOR_3$ or —$SO_2R_3$; and $R_3$ represents a hydrogen atom, an alkyl group or an aryl group; and (II-2)

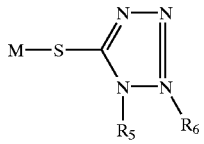

wherein $R_6$ represents a hydrogen atom, a substituted or unsubstituted alkyl group or a substituted or unsubstituted aryl group; $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms, —$COR_3$, —$COOR_3$ or —$SO_2R_3$; and $R_3$ represents a hydrogen atom, an alkyl group or an aryl group; and (3) thiocyanate ions are contained in the lightsensitive material in an amount of $2.5\times10^{-3}$ mol or less per mol of silver.

Embodiment IX

The lightsensitive material of Embodiment VIII above, which satisfies the requirement (1) of Embodiment VIII, and the Pd(II) complex of the general formula (I-1) of the requirement (1) is represented by the following general formula (I-2):

(I-2-1)

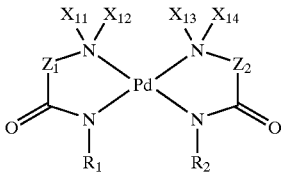

or (I-2-2)

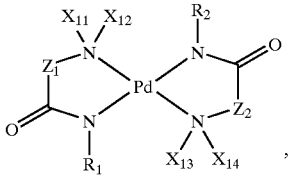

wherein each of $Z_1$ and $Z_2$ independently represents an alkylene group, an arylene group or a divalent heterocyclic residue; each of $R_1$ and $R_2$ independently represents a hydrogen atom, an alkyl group, an aryl group, a heterocyclic group, an acyl group, an alkoxycarbonyl group, an aryloxycarbonyl group, a carbamoyl group, an alkylsulfonyl group or an arylsulfonyl group; and each of $X_{11}$, $X_{12}$, $X_{13}$ and $X_{14}$ independently represents a hydrogen atom, an alkyl group, an aryl group or a heterocyclic group.

Embodiment X

The lightsensitive material of Embodiment VIII above, which satisfies the requirement (2).

Embodiment XI

A process for producing a lightsensitive silver halide emulsion comprising silver halide grains, containing tabular silver halide grains in an amount of at least 50% of the total projected area of all the silver halide grains; having an average iodine content of at least 2 mol %; and having at least 10 dislocation lines per grain, wherein the process comprises at least one step selected from among (step 1) and (step 2) set forth below, and the process comprises a step of performing chemical sensitization so that a selenium sensitizer is added in an amount of $2.5\times10^{-6}$ to $5\times10^{-5}$ mol/mol silver and a step of performing spectral sensitization:

(step 1) performing the spectral sensitization in which a spectral sensitizer is added in the presence of 50 ppm or less of calcium, magnesium and strontium; followed by adding at least one water-soluble salt of a metal selected from the group consisting of calcium, magnesium and strontium, so that the concentration of calcium, magnesium and strontium becomes 100–2500 ppm; and then the chemical sensitization is started; and (step 2) performing the chemical sensitization and the spectral sensitization in the presence of an alkali treated bone gelatin containing components of at least 280 thousand molecular weight in an amount of at least 30% in a molecular weight distribution measured by the PAGI method.

Embodiment XII

A process for producing a lightsensitive silver halide emulsion comprising silver halide grains, containing tabular silver halide grains in an amount of at least 50% of the total projected area of all the silver halide grains; having an average iodine content of at least 2 mol %; having at least 10 dislocation lines per grain, wherein the process comprises at least one step selected from among (step 1) and (step 2) set forth below, and the process comprises a step of performing chemical sensitization so that the silver halide grains have a selenium/gold molar ratio of 0.8 to 10 and a step of performing spectral sensitization:

(step 1) performing the spectral sensitization in which a spectral sensitizer is added in the presence of 50 ppm or less of calcium, magnesium and strontium; followed by adding at least one water-soluble salt of a metal selected from the group consisting of calcium, magnesium and strontium, so that the concentration of calcium, magnesium and strontium becomes 100–2500 ppm; and then the chemical sensitization is started; and (step 2) performing the chemical sensitization and the spectral sensitization in the presence of an alkali treated bone gelatin containing components of at least 280 thousand molecular weight in an amount of at least 30% in a molecular weight distribution measured by the PAGI method.

Embodiment XIII

The process according to Embodiment XI or Embodiment XII above, wherein each of the silver halide grains has a twin face spacing of 0.017 $\mu$m or less.

Embodiment XIV

The process according to any one of Embodiments XI to XIII above, wherein, in the crystal growth step of the silver halide grains, fine silver halide grains containing silver iodide in an amount of at least 95 mol % are formed by mixing together an aqueous solution of a water-soluble silver salt and an aqueous solution of a water-soluble halide by means of a mixer provided outside a reactor vessel for use in the crystal growth and, immediately after the formation of the fine silver halide grains, the fine grains are fed in the reactor vessel for use in the crystal growth.

Embodiment XV

The process according to any one of Embodiments XI to XIV above, wherein, at the time of the chemical sensitization of the lightsensitive silver halide emulsion, a silver iodobromide emulsion prepared in advance is added and dissolved to thereby effect a shell attachment.

Embodiment XVI

The process according to any one of Embodiments XI to XV above, wherein at least one complex selected from the group consisting of hexacyanoiron (II) complexes and hexacyanoruthenium complexes is added at the time of grain formation of the lightsensitive silver halide emulsion.

Embodiment XVII

A silver halide photographic lightsensitive material comprising the silver halide emulsion of Embodiment VIII which satisfies all the requirements (1) to (3).

The present invention will be described in detail below.

The emulsion of the present invention relates to an emulsion of silver iodobromide or silver chloroiodobromide tabular grains.

With respect to the tabular silver halide grains (hereinafter also simply referred to as "tabular grains"), the terminology "aspect ratio" means the ratio of diameter to thickness of the silver halide. That is, it is a quotient of the diameter divided by the thickness of each individual silver halide grain. The terminology "diameter" used herein refers to the diameter of a circle having an area equal to the projected area of grain as obtained when observing silver halide grains through a microscope or an electron microscope. The tabular silver halide grains referred to in the present invention are those whose aspect ratio is at least 2. Preferably, grains having an aspect ratio of at least 3 occupy at least 50%, more preferably at least 60%, and most preferably at least 90% of the projected area of all the silver halide grains.

In the present invention, the terminology "average aspect ratio" means an average of the aspect ratios of all the tabular grains of the emulsion. The average aspect ratio of the tabular grains of the present invention is preferably at least 3, more preferably at least 5, and most preferably at least 8. It is preferred that the aspect ratio do not exceed 50.

The method of taking a transmission electron micrograph by the replica technique and measuring the equivalent circular diameter and thickness of each individual grain can be mentioned as an example of aspect ratio determining method. In the mentioned method, the thickness is calculated from the length of replica shadow.

The configuration of tabular grains of the present invention is generally hexagonal. The terminology "hexagonal configuration" means that the shape of the principal plane of tabular grains is hexagonal, the neighboring side ratio (maximum side length/minimum side length) thereof being 2 or less. The neighboring side ratio is preferably 1.6 or less, more preferably 1.2 or less. That the lower limit thereof is 1.0 is needless to mention. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in JP-A-63-11928 by Saito, the disclosure of which is herein incorporated by reference.

The hexagonal tabular grains for use in the present invention are formed through the steps of nucleation, Ostwald ripening and growth. Although all of these steps are important for suppressing the spread of grain size distribution, especial attention should be paid so as to prevent the spread of size distribution at the first nucleation step because the spread of size distribution brought about in a previous step cannot be narrowed by an ensuing step. What is important in the nucleation step is the relationship between the temperature of reaction mixture and the period of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al., the disclosure of which is herein incorporated by reference, describes that the suitable temperature at nucleation is 60° C. or below.

Gelatin may be further added during the grain formation in order to obtain monodisperse tabular grains of high aspect ratio. The gelatin to be added is preferably a gelatin modified by phthalic anhydride and succinic anhydride that is described in JP-A-8-82883, the disclosure of which is herein incorporated by reference. Further, a chemically modified gelatin as described in JP-A's-10-148897 and 11-143002, the disclosures of which are herein incorporated by reference, (gelatin in which at least two —COOH groups have newly been introduced at a chemical modification of —$NH_2$ group contained in the gelatin), can also be preferably used. Although this chemically modified gelatin is a gelatin characterized in that at least two carboxyl groups have newly been introduced at a chemical modification of amino group contained in the gelatin, it is preferred that a gelatin converted to trimellitate be used as the same. These gelatins are preferably added prior to the growth step, more preferably immediately after the nucleation. The addition amount thereof is preferably at least 60%, more preferably at least 80%, and most preferably at least 90%, based on the total weight of dispersion medium used in grain formation.

The tabular grain emulsion is composed of silver iodobromide or silver chloroiodobromide. Although silver chloride may be contained, the silver chloride content is preferably 8 mol % or less, more preferably 3 mol % or less, or 0 mol %. The silver iodide content is preferably 20 mol % or less since the variation coefficient of the grain size distribution of the tabular grain emulsion is preferably 30% or less. The lowering of the variation coefficient of the distribution of equivalent circular diameter of the tabular grain emulsion can be facilitated by lowering the silver iodide content. The variation coefficient of the grain size distribution of the tabular grain emulsion is more preferably 20% or less, and the silver iodide content is more preferably 10 mol % or less.

It is preferred that the tabular grain emulsion have some intragranular structure with respect to the silver iodide distribution. The silver iodide distribution may have a double structure, a treble structure, a quadruple structure or a structure of higher order.

In the present invention, the tabular grains have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 35, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kv on the grains of 0.25 $\mu$m in thickness) is preferred for ensuring clearer observation. The thus obtained photograph of grains enables determining the position and number of dislocation lines in each grain viewed in the direction perpendicular to the principal planes.

The number of dislocation lines of the tabular grains of the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x% of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of tabular grains. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The position of dislocation lines may be localized on the periphery, principal planes or local points as mentioned above, or the formation of dislocation lines may be effected on a combination thereof. That is, dislocation lines may be concurrently present on both the periphery and the principal planes.

The introduction of dislocation lines in the tabular grains can be accomplished by disposing a specified phase of high silver iodide content within the grains. In the dislocation line introduction, the phase of high silver iodide content may be provided with discontinuous regions of high silver iodide content. Practically, the phase of high silver iodide content within the grains can be obtained by first preparing base grains, providing them with a phase of high silver iodide content and covering the outside thereof with a phase of silver iodide content lower than that of the phase of high silver iodide content. The silver iodide content of the base tabular grains is lower than that of the phase of high silver iodide content, and is preferably 0 to 20 mol %, more preferably 0 to 15 mol %.

The terminology "phase of high silver iodide content within the grains" refers to a silver halide solid solution containing silver iodide. The silver halide of this solid solution is preferably silver iodide, silver iodobromide or silver chloroiodobromide, more preferably silver iodide or silver iodobromide (the silver iodide content is in the range of 10 to 40 mol % based on the silver halides contained in the phase of high silver iodide content). For selectively causing the phase of high silver iodide content within the grains (hereinafter referred to as "internal high silver iodide phase") to be present on any place of the sides, corners and faces of the base grains, it is desirable to control forming conditions for the base grains, forming conditions for the internal high silver iodide phase and forming conditions for the phase covering the outside thereof. With respect to the forming conditions for the base grains, the pAg (logarithm of inverse number of silver ion concentration), the presence or absence, type and amount of silver halide solvent and the temperature are important factors. Regulating the pAg at base grain growth to 8.5 or less, preferably 8 or less, enables selectively causing the internal high silver iodide phase to be present near the apex or on the face of the base grains in the subsequent step of forming the internal high silver iodide phase. On the other hand, regulating the pAg at base grain growth to at least 8.5, preferably at least 9, enables causing the internal high silver iodide phase to be present on the side of the base grains during the subsequent step of forming the internal high silver iodide phase. The threshold value of the pAg is changed upward or downward depending on the temperature and the presence or absence, type and amount of silver halide solvent. When, for example, a thiocyanate is used as the silver halide solvent, the threshold value of the pAg is deviated toward a higher value. What is most important as the pAg at growth is the pAg at the termination of growth of base grains. On the other hand, even when the pAg at growth does not satisfy the above value, the selected position of the internal high silver iodide phase can be controlled by carrying out, after the growth of base grains, the regulation to the above pAg and a ripening. Ammonia, an amine compound, a thiourea derivative or a thiocyanate salt is available as the silver halide solvent.

For the formation of the internal high silver iodide phase, use can be made of the so-called conversion methods. These conversion methods include one in which, during grain formation, halide ions whose salts forming silver ions exhibit a solubility lower than that of halide ions forming the grains or the vicinity of the surface of the grains occurring at the time of grain formation, are added. In the present invention, it is preferred that the amount of added low-solubility halide ions be at least some value (relating to halogen composition) relative to the surface area of grains occurring at the time of the addition. For example, it is preferred that, during grain formation, KI be added in an amount not smaller than some amount relative to the surface area of silver halide grains occurring at the time of the grain formation. Specifically, it is preferred that an iodide salt be added in an amount of at least $8.2\times10^{-5}$ mol/m$^2$.

Preferred process for forming the internal high silver iodide phase comprises adding an aqueous solution of silver salt simultaneously with the addition of an aqueous solution of halide salts containing an iodide salt.

For example, an aqueous solution of $AgNO_3$ is added simultaneously with the addition of an aqueous solution of KI by the double jet. The addition initiating times and addition completing times of the aqueous solution of KI and the aqueous solution of $AgNO_3$ may be differed from each other, that is, the one may be earlier or later than the other. The addition molar ratio of an aqueous solution of $AgNO_3$ to an aqueous solution of KI is preferably at least 0.1, more preferably at least 0.5, and most preferably at least 1. The total addition molar amount of an aqueous solution of $AgNO_3$ relative to halide ions within the system and added iodide ions may fall in a silver excess region. It is preferred that the pAg exhibited when the aqueous solution of halide containing such iodide ions and the aqueous solution of silver salt are added by the double jet be decreased in accordance with the passage of double jet addition time. The pAg prior to the addition initiation is preferably in the range of 6.5 to 13, more preferably 7.0 to 11. The pAg at the time of addition completion is most preferably in the range of 6.5 to 10.0.

In the performing of the above process, it is preferred that the solubility of mixed silver halide be as low as possible. Accordingly, the temperature of the mixture exhibited at the time of formation of the high silver iodide phase is preferably in the range of 30 to 80° C., more preferably 30 to 70° C.

Furthermore, the formation of the internal high silver iodide phase can preferably be performed by adding fine grains of silver iodide, fine grains of silver iodobromide, fine grains of silver chloroiodide or fine grains of silver chloroiodobromide. It is especially preferred that the formation be effected by adding fine grains of silver iodide. Although these fine grains generally have a size of 0.01 to 0.1 μm, use can also be made of fine grains with a size of less than 0.01 μm or more than 0.1 μm. With respect to the process for preparing these fine grains of silver halide, reference can be made to descriptions of JP-A-1-183417, JP-A-2-44335, JP-A-1-183644, JP-A-1-183645, JP-A-2-43534 and JP-A-2-43535, the disclosures of which are herein incorporated by reference. The internal high silver iodide phase can be provided by adding these fine grains of silver halide and conducting a ripening. When the fine grains are dissolved by ripening, use can be made of the aforementioned silver halide solvent. It is not needed that all these added fine grains be immediately dissolved and disappear. It is satisfactory if, when the final grains have been completed, they are dissolved and disappear.

Another method of introducing dislocation lines in the tabular grains comprises using an iodide ion release agent as described in JP-A-6-11782, the disclosure of which is herein incorporated by reference, which can preferably be employed.

Also, dislocation lines can be introduced by appropriately combining this method of introducing dislocation lines with the aforementioned method of introducing dislocation lines.

The position of the internal high silver iodide phase, as measured from the center of, for example, a hexagon resulting from grain projection, is preferably present in the range of 5 to less than 100 mol %, more preferably 20 to less than 95 mol %, and most preferably 50 to less than 90 mol %, based on the amount of silver of the whole grain. The amount of silver halide forming this internal high silver iodide phase, in terms of the amount of silver, is 50 mol % or less, preferably 20 mol % or less, based on the amount of silver of the whole grain. With respect to the above high silver iodide phase, there are provided formulated values of the production of silver halide emulsion, not values obtained by measuring the halogen composition of final grains according to various analytical methods. The internal high silver iodide phase is often caused to completely disappear in final grains by, for example, recrystallization during the shell attaching step, and all the above silver amounts relate to formulated values thereof.

Therefore, although the observation of dislocation lines can be easily performed in the final grains by the above method, the internal silver iodide phase introduced for the introduction of dislocation lines often cannot be confirmed as a clear phase because the boundary silver iodide composition is continuously changed. The halogen composition at each grain part can be determined by a combination of X-ray diffractometry, the EPMA method (also known as the XMA method, in which silver halide grains are scanned by electron beams to thereby detect the silver halide composition), the ESCA method (also known as the XPS method, in which X rays are irradiated and photoelectrons emitted from grain surface are separated into spectra), etc.

The outside phase which covers the internal high silver iodide phase has a silver iodide content lower than that of the internal high silver iodide phase. The silver iodide content of the covering outside phase is preferably in the range of 0 to 30 mol %, more preferably 0 to 20 mol %, and most preferably 0 to 10 mol %, based on the silver halide contained in the covering outside phase.

Although the temperature and pAg employed at the formation of the outside phase which covers the internal high silver iodide phase are arbitrary, the temperature preferably ranges from 30 to 80° C., most preferably from 35 to 70° C., and the pAg preferably ranges from 6.5 to 11.5. The use of the aforementioned silver halide solvent is occasionally preferred, and the most preferred silver halide solvent is a thiocyanate salt.

The variation coefficient of the intergranular iodine distribution of silver halide grains for use in the present invention is preferably 25% or less, more preferably 15% or less, and most preferably 10% or less. When the variation coefficient of the iodine content distribution of each silver halide is greater than 25%, unfavorably, a high contrast is not realized and a sensitivity lowering is intense when a pressure is applied.

Any known processes such as the process of adding fine grains as described in JP-A-1-183417, the disclosure of which is herein incorporated by reference, and the process of using an iodide ion release agent as described in JP-A-2-68538 the disclosure of which is herein incorporated by reference, can be employed either individually or in combination for the production of silver halide grains whose intergranular iodine distribution is narrow for use in the present invention.

The silver halide grains of the present invention preferably have a variation coefficient of intergranular iodine distribution of 25% or less. The process described in JP-A-3-213845, the disclosure of which is herein incorporated by reference, can be used as the most suitable process for effecting the intergranular iodine distribution to a monodispersion. That is, a monodisperse intergranular iodine distribution can be accomplished by a process in which fine silver halide grains containing silver iodide in an amount of at least 95 mol % are formed by mixing together an aqueous solution of a water-soluble silver salt and an aqueous solution of a water-soluble halide (containing at least 95 mol % of iodide ions) by means of a mixer provided outside a reactor vessel for the crystal growth and, immediately after the formation, fed in the reactor vessel. The terminology "reactor vessel" used herein means the vessel in which the nucleation and/or crystal growth of tabular silver halide grains is carried out.

With respect to the above process of mixer preparation followed by adding procedure and the preparatory means for use therein, the following three techniques can be employed as described in JP-A-3-213845, the disclosure of which is herein incorporated by reference:

(i) immediately after formation of fine grains in a mixer, the fine grains are transferred into a reactor vessel;

(ii) powerful and effective agitation is carried out in the mixer; and (iii) an aqueous solution of protective colloid is injected into the mixer.

The protective colloid used in technique (iii) above may be separately injected in the mixer, or may be incorporated in the aqueous solution of silver halide or the aqueous solution of silver nitrate before the injection in the mixer. The concentration of the protective colloid is at least 1% by weight, preferably in the range of 2 to 5% by weight. Examples of polymeric compounds exhibiting a protective colloid function to the silver halide grains for use in the present invention include polyacrylamide polymers, amino polymers, polymers having thioether groups, polyvinyl alcohol, acrylic polymers, polymers having hydroxyquinoline, cellulose, starch, acetal, polyvinylpyrrolidone and ternary polymers. Low-molecular-weight gelatin can preferably be used as the above polymeric compound. The molecular weight of low-molecular-weight gelatin is preferably 30,000 or less, more preferably 10,000 or less.

The grain formation temperature in the preparation of fine silver halide grains is preferably 35° C. or below, more preferably 25° C. or below. The temperature of the reactor vessel in which fine silver halide grains are incorporated is at least 50° C., preferably at least 60° C., and more preferably at least 70° C.

The grain size of fine-size silver halide for use in the present invention can be determined by placing grains on a mesh and making a direct observation through a transmission electron microscope. The size of fine grains of the present invention is 0.3 μm or less, preferably 0.1 μm or less, and more preferably 0.01 μm or less. This fine silver halide may be added simultaneously with the addition of other halide ions and silver ions, or may be separately added. The fine silver halide grains are mixed in an amount of 0.005 to 20 mol %, preferably 0.01 to 10 mol %, based on the total silver halide.

The silver iodide content of each individual grain can be measured by analyzing the composition of each individual grain by means of an X-ray microanalyzer. The terminology "variation coefficient of intergranular iodine distribution" means a value defined by the formula:

$$\text{variation coefficient} = (\text{standard deviation}/\text{av. silver iodide content}) \times 100$$

wherein the standard deviation, specifically the standard deviation of silver iodide content, and the average silver iodide content are obtained by measuring the silver iodide contents of at least 100, preferably at least 200, and more preferably at least 300 emulsion grains. The measuring of the silver iodide content of each individual grain is described in, for example, EP No. 147,868. There are cases in which a correlation exists between the silver iodide content Yi (mol %) of each individual grain and the equivalent spherical diameter Xiμ of each individual grain and cases in which no such correlation exists. It is preferred that no correlation exist therebetween. The structure associated with the silver halide composition of grains of the present invention can be identified by, for example, a combination of X-ray diffractometry, the EPMA method (also known as the XMA method, in which silver halide grains are scanned by electron beams to thereby detect the silver halide composition) and the ESCA method (also known as the XPS method, in which X rays are irradiated and photoelectrons emitted from grain surface are separated into spectra). In the measuring of silver iodide content in the present invention, the terminology "grain surface" refers to the region whose depth from surface is about 50 Å, and the terminology "grain internal part" refers to the region other than the above surface. The halogen composition of such a grain surface can generally be measured by the ESCA method.

One embodiment of silver halide emulsion of the present invention is characterized in that the emulsion is prepared by performing the spectral sensitization in which a spectral sensitizer is added in the presence of 50 ppm or less of calcium, magnesium and strontium; followed by adding at least one water-soluble salt of a metal selected from the group consisting of calcium, magnesium and strontium, so that the concentration of calcium, magnesium and strontium becomes 100–2500 ppm; and then the chemical sensitization is started.

In the preparation of the emulsion of the present invention, substantially no calcium, magnesium and strontium exist after desalting of the emulsion and before performing spectral sensitization and chemical sensitization thereto. The term, "substantially no calcium, magnesium and strontium exist" means that the smaller the amount of calcium, magnesium and strontium, the better. Specifically, the term means that the content of calcium, magnesium and strontium is 50 ppm or less, preferably 35 ppm or less, more preferably 20 ppm or less. Herein, "the content of calcium, magnesium and strontium is 50 ppm or less" means that the sum of each of the contents of calcium, magnesium and strontium is within the specified concentration. The contents of calcium, magnesium and strontium is expressed by the amount of compounds having any one of calcium, magnesium and strontium, for example, calcium ions, magnesium ions, strontium ions, calcium salts, magnesium salts, and strontium salts, which is expressed in terms of calcium atom, magnesium atom and strontium atom, respectively, and indicated as a concentration of the amount in terms of the atom per unit weight of the emulsion.

The content of calcium, magnesium, and strontium can be quantified by, for example, ICP emission spectral analytical method.

The addition of at least one water-soluble salt of a metal selected from the group consisting of calcium, magnesium and strontium, which is performed after spectral sensitization, will be described below.

Firstly, the timing of addition of the water-soluble metal salt will be described. A spectral sensitizer adsorbs to surface of emulsion grains after addition thereof to the emulsion, then the adsorption reaches to equilibrium. In the present invention, at least one water-soluble salt of a metal selected from the group consisting of calcium, magnesium and strontium, can be added after the spectral sensitizing dye sufficiently adsorbs to the surface of the grains. The preferred timing of the addition of the water-soluble salt is when the spectral sensitizing dye is adsorbed to the surface of the grains in an amounts of 80% or more, preferably, 90% or more, of the amount of spectral sensitizing dye adsorbed to the surface of the grains at equilibrium.

The amount of the spectral sensitizing dye adsorbed can be calculated as follows. That is, the amount of the spectral sensitizing dye contained in the supernatant after a solid layer and a liquid layer are separated by centrifuge, is measured. The amount of the spectral sensitizing dye adsorbed can be calculated by subtracting the measured amount form the amount of the spectral sensitizing dye that was firstly added to the emulsion.

In the present invention, the addition amount of at least one water-soluble salt of a metal selected from the group consisting of calcium, magnesium and strontium, which is added after spectral sensitizing dye sufficiently adsorbed to the grains and before initiation of chemical sensitization, is set so that the content of calcium, magnesium and strontium in the emulsion after the addition thereof becomes 100–2500 ppm, preferably, 200–2500 ppm. Among the metals selected for the water-soluble salt to be added, magnesium is preferred, strontium is more preferred and calcium is most preferred.

As examples of the water-soluble salt of calcium, calcium nitrate and calcium chloride are preferred. As examples of the water-soluble salt of magnesium, magnesium nitrate and magnesium chloride are preferred, and magnesium nitrate is more preferred. As examples of the water-soluble salt of strontium, strontium nitrate is preferred.

In the present invention, the time to initiate chemical sensitization is the time at which at least one chemical sensitizing dye is added.

The high-molecular-weight gelatin for use in the present invention will be described below.

The high-molecular-weight gelatin for use in the present invention refers to an alkali treated bone gelatin containing components of at least 280 thousand molecular weight in an amount of at least 30% in a molecular weight distribution measured by the PAGI method. The gelatin for use in the present invention is an alkali treated bone gelatin containing components of at least 280 thousand molecular weight in an amount of at least 30%, preferably at least 35%, in the molecular weight distribution. The gelatin is obtained by decomposing the structure of collagen tissue with an alkali or an acid so that hydrophilicity is imparted thereto. The alkali treated gelatin consists of components sub-α (low molecular weight), α (molecular weight: about 100 thousand), β (molecular weight: about 200 thousand), γ (molecular weight: about 300 thousand) and large-polymer portion (void; molecular weight larger than about 300 thousand), classification into these components based on the molecular weight. The component ratios, namely the molecular weight distribution, is measured by the internationally established PAGI method. The PAGI method comprises applying an aqueous solution of gelatin to gel filtration using a high performance liquid chromatography to thereby obtain a chromatogram, from which a molecular weight distribution is estimated. The sum of γ and void components occupies at least 30%, preferably at least 35%, and more preferably at least 37%, of the gelatin for use in the present invention.

The processes for producing the above gelatin can be classified into the following two major processes.

1. Process in Which Gelatin is not Crosslinked:

The alkali treated gelatin is produced by removing calcium from raw bones, liming the resultant bones to thereby decompose the collagen tissue, extracting with hot water and drying. The extraction is generally performed at 1 to 7 levels of extraction temperatures. The extraction temperature is raised in conformity with the increase of the extraction number. The molecular weight distribution of final gelatin can be controlled by regulating the extraction temperature and time. The gelatin for use in the present invention can be prepared by investigating these extraction conditions.

2. Process in Which a Gelatin Crosslinking Agent is Employed:

The gelatin for use in the present invention is obtained by crosslinking gelatin. This crosslinking can be performed by two methods, one in which crosslinking between gelatin molecules is conducted by an enzyme and the other in which a crosslinking agent is added so as to form a chemical bond between gelatin molecules with the result that gelatin molecules are crosslinked.

Typical enzyme using process for use in the present invention will be described below with respect to the gelatin crosslinked with transglutaminase. The transglutaminase enzyme can crosslink gelatin by the function of catalyzing the acyl transition reaction between various primary amines and the γ-carboxyamido group of glutamine residue of gelatin being a protein. The transglutaminase is derived from animals, plants or microorganisms. For example, an extract from a mammalian organ such as liver of guinea-pig or blood can be mentioned as the transglutaminase derived from animals. The transglutaminase derived from plants is, for example, an extract from pea, and the transglutaminase derived from microorganisms is, for example, an extract from ray fungus. As long as a transglutaminase activity is exhibited, the substance can preferably be used in the present invention, irrespective of the origin thereof.

All transglutaminases synthesized by, for example, the process of Clark (Archives of Biochemistry and Biophysics, 79, 338 (1959)), the process of Connel (J. Biological Chemistry, 246 (1971)), the process of JP-A-4-207149 and the process of JP-A-6-30770 can preferably be used in the present invention. An example of these transglutaminases is Activa (trade name, produced by Ajinomoto Co., Inc.). The transglutaminase activity useful in the present invention can be measured by reacting benzyloxycarbonyl-L-glutaminylglycine with hyroxylamine and determining the amount of formed hydroxamic acid. The transglutaminase activity of $1\times10^{-6}$ mol of hydroxamic acid per minute as measured by this method is referred to as "1 unit". In the present invention, the transglutaminase is preferably added in such an amount that at least $1\times10^{-6}$ mol, more preferably at least $1\times10^{-5}$ mol, of hydroxamic acid is formed per g of gelatin, depending on the type of employed gelatin.

All crosslinking agents known as gelatin curing agents can be used in the preparation of crosslinked gelatin for use in the present invention. Representative compounds as such crosslinking agents will be set forth below.

A. Inorganic Crosslinking Agent (Inorganic Hardener)

Cationic chromium complexes: complex ligands composed of a hydroxyl group, an oxalate group, a citrate group, a malonate group, a lactate salt, a tartrate salt, a succinate salt, an acetate salt, a formate salt, a sulfate, a chloride and a nitrate.

Aluminum salts: especially, aluminum sulfate, potassium alum and ammonium alum.

These compounds crosslink the carboxyl groups of gelatin.

B. Organic Crosslinking Agent (Organic Hardener)

1. Aldehyde crosslinking agent: Formaldehyde is most often employed. Effective crosslinking can be effected by dialdehydes, examples of which include glyoxals and succinaldehydes. Glutaraldehyde is especially effective. Diglycolaldehyde and various aromatic dialdehydes, or dialdehyde starch, or dialdehyde derivatives of plant gum can also be used in the crosslinking according to the present invention.

2. N-methylol compounds and other protected aldehyde crosslinking agents: N-methylol compounds obtained by condensation of formaldehyde with various aliphatic linear or cyclic amides, urea or nitrogenous heterocycles. For example, 2,3-dihydroxydioxane, an acetate ester of dialdehyde with a hemiacetal thereof and 2,5-dimethoxytetrahydrofuran can be mentioned.

3. Ketone crosslinking agents: Diketone and quinone compounds. Well known diketones are, for example, 2,3-butanedione and $CH_3COCOCH_3$. p-Benzoquinone is well known as the quinone.

4. Sulfonate esters and sulfonyl halides: Representative compounds are bis(sulfonyl chloride) and bis(sulfonyl fluoride) compounds.

5. Active halogen compounds: Compounds having at least two active halogen atoms. Representative compounds are, for example, simple bis-α-chloro or bis-α-bromo derivatives of a ketone, an ester or an amide, bis(2-chloroethylurea), bis(2-chloroethyl)sulfone and phosphoramidic halides.

6. Epoxides: Butadiene dioxide can be mentioned as a representative compound.

7. Active olefins: Various compounds having at least two double bonds, especially unsubstituted vinyl groups activated by neighboring electron attractive group, are effective gelatin crosslinkers. Examples of such compounds include divinyl ketone, resorcinol bis(vinylsulfonate), 4,6-bis(vinylsulfonate), 4,6-bis(vinylsulfonyl)-m-xylene, bis(vinylsulfonylalkyl)ether or amine, 1,3,5-triacryloylhexahydro-s-triazine, diacrylamide and 1,3-bis(acryloyl)urea.

8. Other: Also, use can be made of hardeners (general formulae (H-I) to (H-VIII)) listed at page 475 line 8 to page 508 line 3 of JP-A-62-215272, which is herein incorporated by reference.

In the production of the crosslinked gelatin for use in the present invention, the aforementioned crosslinking agent is added to a gelatin solution to thereby induce a crosslinking between gelatin molecules. The reaction conditions, although varied depending on the type of employed crosslinking agent, can be decided by setting certain reaction temperature and reaction time and measuring the molecular weight distribution of gelatin in accordance with the PAGI method. In that instance, the progress of crosslinking can be traced by measuring the viscosity of the gelatin solution. Although reacting all the added crosslinking agent is desired, when some remains unreacted, the gelatin solution after crosslinking reaction can be ultrafiltered to thereby remove any remaining crosslinking agent. In the present invention, crosslinking reaction conditions, viz. crosslinking reaction temperature, time, solution pH, etc., can be set by measuring the molecular weight distribution in accordance with the PAGI measuring method.

Although the gelatin for use in the present invention can be added at any time during grain formation, it is preferred that the addition start at least after the nucleation. The addition amount of gelatin is 10% or more, preferably 30% or more, and more preferably 50% or more, based on all the dispersion mediums during grain formation. Further, the gelatin for use in the present invention is effective even if it is added as a dispersant gelatin used after emulsion washing. The addition amount thereof is 10% or more, preferably 30% or more, and more preferably 50% or more, based on the dispersant gelatin added after emulsion washing. Still further, the gelatin for use in the present invention is effective even if it is added prior to coating. The addition amount thereof is 10% or more, preferably 30% or more, and more preferably 50% or more, based on the dispersion medium added prior to coating.

In the present invention, a sensitivity-enhanced emulsion can be obtained by carrying out such a gold/selenium sensitization that the selenium/gold molar ratio in emulsion grains falls within the range of 0.8 to 10. When the selenium/gold molar ratio exceeds 10, a fog increase is caused, contrarily resulting in a sensitivity decrease. The selenium/gold molar ratio is more preferably in the range of 0.8 to 5, most preferably 0.8 to 3.

The formation amount of silver selenide produced during selenium sensitization can be determined by the following procedure (i).

(i) A coating on a support is swollen by water, and a silver halide emulsion is peeled from the support by enzymatic decomposition. Selenium compound adsorbed on the silver halide is washed away by adding a 0.1 N solution of KBr and conducting satisfactory washing with the care that none of the silver halide is fixed. Thereafter, grains are separated by the centrifugal separation method, and the amount of selenium in the grains is determined.

It is desirable to perform the determination of the amount of selenium by the atomic absorption method which is easy and ensures high accuracy. In the present invention, the determination was carried out by the high-temperature carbon oven atomic absorption method with the use of Zeeman atomic absorption spectrophotometer, model 180-80, manufactured by Hitachi, Ltd.

The amount of gold captured in silver halide grains by gold sensitization can be determined by the following procedure (ii).

(ii) A coating on a support is swollen by water, and a silver halide emulsion is peeled from the support by enzymatic decomposition. Thereafter, a separation into grains and a supernatant is carried out by the centrifugal separation method, and the amount of gold in the grains is determined.

The determination of the amount of gold is performed by the atomic absorption method as in the determination of the amount of selenium.

The selenium sensitization for use in the present invention will now be described.

Selenium compounds disclosed in hitherto published patents can be used as the selenium sensitizer in the present invention. In the use of unstable selenium compound and/or nonunstable selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A-4-25832 and JP-A-4-109240, the disclosures of which are herein incorporated by reference, are preferably used as the unstable selenium compound.

Specific examples of the unstable selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2,6-dimethoxybenzoyl)selenide), selenophosphates, phosphine selenides and colloidal metal selenium.

The unstable selenium compounds, although preferred types thereof are as mentioned above, are not limited thereto. It is generally understood by persons of ordinary skill in the art to which the invention pertains that the structure of the unstable selenium compound as a photographic emulsion sensitizer is not so important as long as the selenium is unstable and that the unstable selenium compound plays no other role than having its selenium carried by organic portions of selenium sensitizer molecules and causing it to present in unstable form in the emulsion. In the present invention, the unstable selenium compounds of this broad concept can be used advantageously.

Compounds described in JP-B-46-4553, JP-B-52-34492 and JP-B-52-34491, the disclosures of which are herein incorporated by reference, can be used as the nonunstable selenium compound in the present invention. Examples of the nonunstable selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

Of these selenium compounds, those of the following general formula (A) and general formula (B) are preferred.

(A)

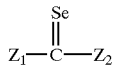

In the formula, $Z_1$ and $Z_2$ may be identical with or different from each other, and each represent an alkyl group (for example, methyl, ethyl, t-butyl, adamantyl or t-octyl), an alkenyl group (for example, vinyl or propenyl), an aralkyl group (for example, benzyl or phenethyl), an aryl group (for example, phenyl, pentafluorophenyl, 4-chlorophenyl, 3-nitrophenyl, 4-octylsulfamoylphenyl or α-naphthyl), a heterocyclic group (for example, 2-pyridyl, 3-thienyl, 2-furyl or 2-imidazolyl), —$NR_1(R_2)$, —$OR_3$ or —$SR_4$.

$R_1$, $R_2$, $R_3$ and $R_4$ may be identical with or different from each other, and each represent a hydrogen atom, an alkyl group, an aralkyl group, an aryl group, a heterocyclic group or an acyl group. Examples of the alkyl, aralkyl, aryl and heterocyclic groups are the same as mentioned with respect to $Z_1$. Provided that each of $R_1$ and $R_2$ may represent a hydrogen atom or an acyl group (for example, acetyl, propanoyl, benzoyl, heptafluorobutanoyl, difluoroacetyl, 4-nitrobenzoyl, α-naphthoyl or 4-trifluoromethylbenzoyl).

In the general formula (A), it is preferred that $Z_1$ represent an alkyl group, an aryl group or —$NR_1(R_2)$ and that $Z_2$ represent —$NR_5(R_6)$. $R_1$, $R_2$, $R_5$ and $R_6$ may be identical with or different from each other, and each represent a hydrogen atom, an alkyl group, an aryl group or an acyl group.

The general formula (A) more preferably represents N,N-dialkylselenoureas, N,N,N'-trialkyl-N'-acylselenoureas, tetraalkylselenoureas, N,N-dialkylarylselenoamides and N-alkyl-N-arylarylselenoamides.

(B)

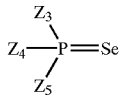

In the formula, $Z_3$, $Z_4$ and $Z_5$ may be identical with or different from each other, and each represent an alkyl group, an alkenyl group, an alkynyl group, an aralkyl group, an aryl group, a heterocyclic group, —$OR_7$, —$NR_8(R_9)$, —$SR_{10}$, —$SeR_{11}$, X or a hydrogen atom.

Each of $R_7$, $R_{10}$ and $R_{11}$ represents an alkyl group, an alkenyl group, an alkynyl group, an aralkyl group, an aryl group, a heterocyclic group, a hydrogen atom or a cation. Each of $R_8$ and $R_9$ represents an alkyl group, an alkenyl group, an alkynyl group, an aralkyl group, an aryl group, a heterocyclic group or a hydrogen atom. X represents a halogen atom.

In the general formula (B), the alkyl group, alkenyl group, alkynyl group and aralkyl group represented by $Z_3$, $Z_4$, $Z_5$, $R_7$, $R_8$, $R_9$, $R_{10}$ and $R_{11}$ are linear, branched or cyclic alkyl group, alkenyl group, alkynyl group and aralkyl group, respectively (for example, methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl and phenethyl).

In the general formula (B), the aryl group represented by $Z_3$, $Z_4$, $Z_5$, $R_7$, $R_8$, $R_9$, $R_{10}$ and $R_{11}$ is a monocyclic or condensed-ring aryl group (for example, phenyl, pentafluorophenyl, 4-chlorophenyl, 3-sulfophenyl, α-naphthyl or 4-methylphenyl).

In the general formula (B), the heterocyclic group represented by $Z_3$, $Z_4$, $Z_5$, $R_7$, $R_8$, $R_9$, $R_{10}$ and $R_{11}$ is a saturated or an unsaturated heterocyclic group of 3 to 10 membered ring containing at least one of nitrogen, oxygen and sulfur atoms (for example, 2-pyridyl, 3-thienyl, 2-furyl, 2-thiazolyl, 2-imidazolyl or 2-benzimidazolyl). The heterocyclic group may consist of condensed rings.

In the general formula (B), the cation represented by $R_7$, $R_{10}$ and $R_{11}$ is an alkali metal atom or ammonium. The halogen atom represented by X is, for example, a fluorine atom, a chlorine atom, a bromine atom or an iodine atom.

In the general formula (B), it is preferred that each of $Z_3$, $Z_4$ and $Z_5$ represent an alkyl group, an aryl group or —$OR_7$ and that $R_7$ represent an alkyl group or an aryl group.

The general formula (B) more preferably represents a trialkylphosphine selenide, a triarylphosphine selenide, a trialkyl selenophosphate or a triaryl selenophosphate.

Specific examples of the compounds of the general formulae (A) and (B) will be shown below, which in no way limit the present invention.

1.

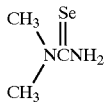

2.

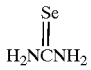

3.

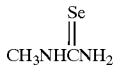

4.

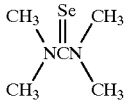

5.

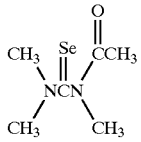

6.

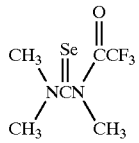

7.

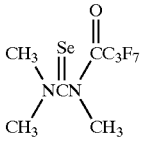

-continued
8.
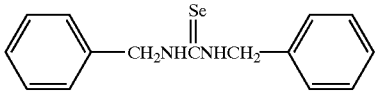
9.
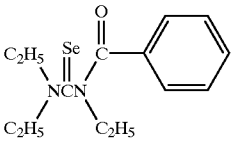
10.
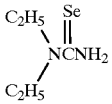
11.
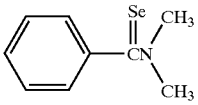
12.
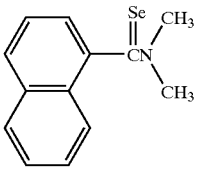
13.
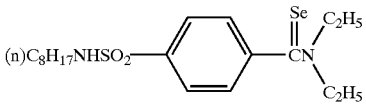
14.
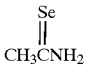
15.
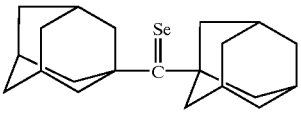
16.
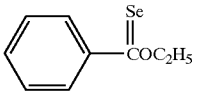
17.
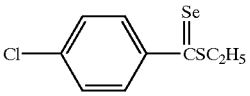
18.
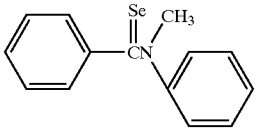
19.
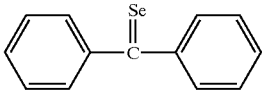
20.
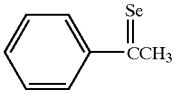
-continued
21.
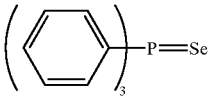
22.
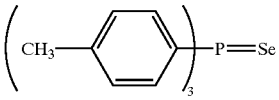
23.
24.
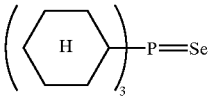
25.
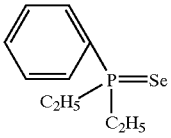
26.
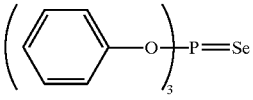
27.
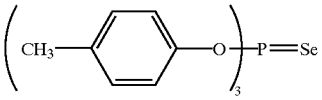
28.
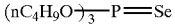
29.
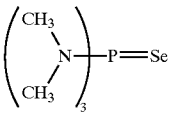
30.
31.
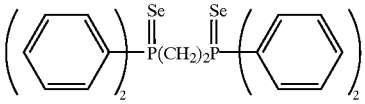
32.
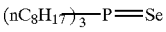
33.
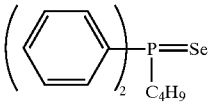
34.
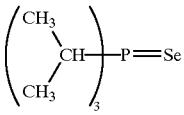
35.
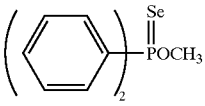

-continued

36.

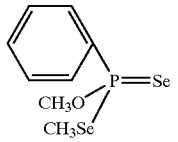

37.

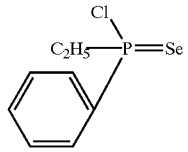

38.

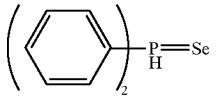

39.

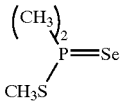

40.

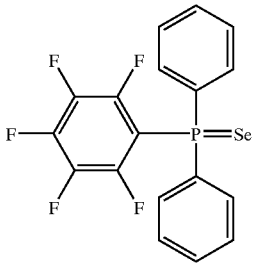

These selenium sensitizers are dissolved in a single solvent or a mixture of solvents selected from among water and organic solvents such as methanol and ethanol and added at the time of chemical sensitization, preferably prior to the initiation of chemical sensitization. The above selenium sensitizers can be used either individually or in combination. The joint use of an unstable selenium compound and a nonunstable selenium compound is preferred.

The addition amount of selenium sensitizer for use in the present invention, although varied depending on the activity of employed selenium sensitizer, the type and size of silver halide, the ripening temperature and time, etc., is preferably at least $1\times10^{-8}$ mol, more preferably at least $1\times10^{-7}$ mol, and most preferably $2.5\times10^{-6}$ to $5\times10^{-5}$ mol, per mol of silver halide. The temperature of chemical sensitization in the use of a selenium sensitizer is preferably between 40° C. and 80° C. The pAg and pH are arbitrary. For example, with respect to pH, the effect of the present invention can be exerted even if it widely ranges from 4 to 9.

The selenium sensitization can more effectively be accomplished by performing it in the presence of a silver halide solvent.

Examples of the silver halide solvents which can be employed in the present invention include (a) organic thioethers described in U.S. Pat. Nos. 3,271,157, 3,531,289, and 3,574,628, JP-A-54-1019 and JP-A-54-158917, (b) thiourea derivatives described in, for example, JP-A's-53-82408, 55-77737 and 55-2982, (c) silver halide solvents having a thiocarbonyl group interposed between an oxygen or sulfur atom and a nitrogen atom, described in JP-A-53-144319, (d) imidazoles described in JP-A-54-100717, (e) sulfites and (f) thiocyanates, the disclosures of which are herein incorporated by reference.

Thiocyanates and tetramethylthiourea can be mentioned as especially preferred silver halide solvents. The amount of added solvent, although varied depending on the type thereof, is, for example, preferably in the range of $1\times10^{-4}$ to $1\times10^{-2}$ mol per mol of silver halide.

The oxidation number of gold of the gold sensitizer used in the aforementioned gold sensitization may be either +1 or +3, and gold compounds customarily used as gold sensitizers can be employed. Representative examples thereof include chloroauric acid salts, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The addition amount of gold sensitizer, although varied depending on various conditions, is preferably between $1\times10^{-7}$ mol and $5\times10^{-5}$ mol per mol of silver halide as a yardstick.

With respect to the emulsion of the present invention, it is desired to perform sulfur sensitization in combination when chemical sensitization is performed.

The sulfur sensitization is generally performed by adding a sulfur sensitizer and agitating the emulsion at high temperature, preferably 40° C. or above, for a given period of time.

In the above sulfur sensitization, those known as sulfur sensitizers can be used. For example, use can be made of thiosulfates, allylthiocarbamidothiourea, allyl isothiacyanate, cystine, p-toluenethiosulfonates and rhodanine. Use can also be made of other sulfur sensitizers described in, for example, U.S. Pat. Nos. 1,574,944, 2,410,689, 2,278,947, 2,728,668, 3,501,313, and 3,656,955, DE No. 1,422,869, JP-B-56-24937 and JP-A-55-45016, the disclosures of which are herein incorporated by reference. The addition amount of sulfur sensitizer is satisfactory if it is sufficient to effectively increase the sensitivity of the emulsion. This amount, although varied to a large extent under various conditions such as the pH, temperature and size of silver halide grains, is preferably in the range of $1\times10^{-7}$ to $5\times10^{-5}$ mol per mol of silver halide.

The silver halide emulsion of the present invention can be subjected to a reduction sensitization during the grain formation, or after the grain formation but before the chemical sensitization, during the chemical sensitization or after the chemical sensitization.

The reduction sensitization can be performed by a method selected from among the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, ascorbic acid and derivatives thereof, amines and polyamino acids, hydrazine derivatives, formamidinesulfinic acid, silane compounds and borane compounds. In the reduction sensitization of the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

Each reduction sensitizer is dissolved in water or any of organic solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

An oxidizer capable of oxidizing silver is preferably used during the process of producing the emulsion of the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be performed during the step of grain formation or the step of chemical sensitization.

The photographic emulsion of the present invention preferably exerts the effect of the present invention by being subjected to a spectral sensitization with a methine dye or the like. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. These dyes may contain any of nuclei commonly used in cyanine dyes as basic heterocyclic nuclei. Examples of such nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have substituents on carbon atoms thereof.

The merocyanine dye or composite merocyanine dye may have a 5 or 6-membered heterocyclic nucleus such as a pyrazolin-5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB No. 1,344,281, GB No. 1,507,803, JP-B-43-4936, JP-B-53-12375, JP-A-52-110618 and JP-A-52-109925, the disclosures of which are herein incorporated by reference.

The emulsion of the present invention may be doped with a dye which itself exerts no spectral sensitizing effect or a substance which absorbs substantially none of visible radiation and exhibits supersensitization, together with the above spectral sensitizing dye.

The doping of the emulsion with the spectral sensitizing dye may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666, the disclosures of which are herein incorporated by reference. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928, the disclosure of which is herein incorporated by reference. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666, the disclosure of which is herein incorporated by reference. Still further, the spectral sensitizing dye can be added at any stage during the formation of silver halide grains according to the method disclosed in U.S. Pat. No. 4,183,756, the disclosure of which is herein incorporated by reference and other methods.

Although the sensitizing dye can be used in an amount of $4\times10^{-6}$ to $8\times10^{-3}$ mol per mol of silver halide, the use thereof in an amount of about $5\times10^{-5}$ to $2\times10^{-3}$ mol per mol of silver halide is more effective when the size of silver, halide grains is in the preferred range of 0.2 to 1.2 $\mu$m.

The silver halide grains of the present invention preferably have a twin face spacing of 0.017 $\mu$m or less, more preferably 0.007 to 0.017 $\mu$m, and most preferably 0.007 to 0.015 $\mu$m.

The terminology "twin face spacing" used herein means the distance between two twin faces with respect to the grains having two twin faces within each grain, and means the largest of the twin face distances with respect to the grains having at least three twin faces.

The method of measuring the twin face spacing is described in JP-A-63-163451. The twin face can be observed through a transmission electron microscope. Specifically, a support is coated with an emulsion comprising tabular grains to thereby prepare a sample in which the tabular grains are arranged approximately in parallel to the support. The sample is cut with a diamond knife to thereby prepare a 0.1 $\mu$m thick section. The twin faces of the tabular grains can be detected by observing the section through a transmission electron microscope. When electron beams pass through the twin faces, a phase shift occurs in the electron waves. Thus, the presence of the twin faces can be recognized.

The fogging during aging of the silver halide emulsion of the present invention can be improved by adding and dissolving a previously prepared silver iodobromide emulsion, to be attached to each of host grains as a shell at the time of chemical sensitization. Although the timing of the addition is arbitrary as long as it is performed during chemical sensitization, it is preferred that the silver iodobromide emulsion be first added and dissolved and, thereafter, a sensitizing dye and a chemical sensitizer be added in this order. The employed silver iodobromide emulsion has an iodine content lower than the surface iodine content of host grains, which is preferably a pure silver bromide emulsion. This silver iodobromide emulsion, although the size thereof is not limited as long as it is completely dissolvable, preferably has an equivalent spherical diameter of 0.1 $\mu$m or less, more preferably 0.05 $\mu$m or less. Although the addition amount of silver iodobromide emulsion depends on employed host grains, basically, it preferably ranges from 0.005 to 5 mol %, more preferably from 0.1 to 1 mol %, based on the molar amount of silver.

The addition amount of hexacyanoiron (II) complex or hexacyanoruthenium complex (hereinafter also referred to simply as "metal complex") for use in the present invention is preferably in the range of $10^{-7}$ to $10^{-3}$ mol per mol of silver halide, more preferably $1.0\times10^{-5}$ to $5\times10^{-4}$ mol per mol of silver halide. The addition and incorporation of the metal complex for use in the present invention may be performed at any stage through the process of preparing silver halide grains which consists of nucleation, growth, physical ripening and chemical sensitization. Also, the addition and incorporation may be performed in some divisions. However, it is preferred that at least 50% of the total content of metal complex contained in each silver halide grain be contained in layers underlying the outermost surface of silver halide grain where ½ or less of the silver content contained in the grain is present. These layers containing the metal complex may be overlaid with a layer which does not contain any metal complex.

The incorporation of the above metal complex is preferably accomplished by dissolving the metal complex in water or a suitable solvent and directly adding the solution to the reaction mixture during the formation of silver halide grains, or by adding the metal complex solution to the aqueous solution of halide, aqueous solution of silver salt or other solution for preparation of silver halide grains and thereafter conducting grain formation. Alternatively, the incorporation of metal complex is also preferably accomplished by adding silver halide grains in which the metal complex has been introduced in advance, dissolving them and depositing them on other silver halide grains.

With respect to the hydrogen ion concentration of the reaction mixture to which the metal complex is added, the pH value is preferably in the range of 1 to 10, more preferably 3 to 7.

The silver halide color photographic lightsensitive material of the present invention comprises a support and, superimposed thereon, at least one blue-sensitive silver halide emulsion layer containing a yellow coupler, at least one green-sensitive silver halide emulsion layer containing a magenta coupler, at least one red-sensitive silver halide emulsion layer containing a cyan coupler and at least one hydrophilic protective colloid layer, wherein at least one emulsion for use in the above emulsion layers is the silver halide emulsion of the present invention. The calcium ions, magnesium ions and/or strontium ions contained in the emulsion of the present invention are soluble in water, so that they may be diffused from the emulsion layer to other layers and may flow into processing solution during processing to thereby occasionally cause failure. Therefore, the amount of calcium ions, magnesium ions and/or strontium ions contained in the silver halide color photographic lightsensitive material of the present invention, in terms of atomic weight, is preferably $8.0\times10^{-2}$ g or less, more preferably $4.0\times10^{-2}$ g or less, per g of all the gelatin contained in the lightsensitive material.

Herein the "amount of calcium ions, magnesium ions and strontium ions" means the sum of the amounts of calcium ions, magnesium ions and strontium ions, each in terms of atomic weight.

The Pd compound represented by the general formula (I-1) will be described in detail below.

In the general formula (I-1), each of $X_1$ and $X_2$ independently represents —$S(R_{11})$—, —$N(R_{12})(R_{13})$— or —$O(R_{14})$—. Each of $R_{11}$ and $R_{14}$ independently represents a hydrogen atom, an alkyl group, a cycloalkyl group, an alkenyl group, an alkynyl group, an aralkyl group, an aryl group or a heterocyclic group. Each of the alkyl group, cycloalkyl group, alkenyl group, alkynyl group and aralkyl group represented by $R_{11}$ and $R_{14}$ preferably has 1 to 30 carbon atoms and more preferably has 1 to 10 carbon atoms, and is linear or branched. Examples thereof include methyl, ethyl, propyl, butyl, isopropyl, cyclopropyl, allyl, propargyl and benzyl. The aryl group represented by $R_{11}$ and $R_{14}$ preferably has 6 to 30 carbon atoms and more preferably has 6 to 12 carbon atoms and is monocyclic or of condensed rings. Examples thereof include phenyl and naphthyl. The heterocyclic group represented by $R_{11}$ and $R_{14}$ is a 3 to 10-membered saturated or unsaturated heterocyclic group containing at least one of nitrogen, oxygen and sulfur atoms. The heterocyclic group may be monocyclic or may form condensed rings with other aromatic rings. The heterocycle is preferably a 5 or 6-membered aromatic heterocycle, which is, for example, 2-pyridyl, 2-imidazolyl, 2-quinolyl, 2-benzimidazolyl, 4-pyrimidyl, 3-pyrazolyl, 2-isoquinolyl, 2-thiazolyl, 2-thienyl, 3-furyl or 2-benzothiazolyl.

Each of $R_{12}$ and $R_{13}$ independently represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, an alkylsulfonyl group or an arylsulfonyl group. The alkyl group, cycloalkyl group, alkenyl group, alkynyl group, aralkyl group, aryl group and heterocyclic group represented by $R_{12}$ and $R_{13}$ have the same meaning as $R_{11}$ and $R_{14}$ of $X_1$ and $X_2$. Each of the acyl group, alkoxycarbonyl group, aryloxycarbonyl group, carbamoyl group, alkylsulfonyl group and arylsulfonyl group represented by $R_{12}$ and $R_{13}$ preferably has 1 to 20 carbon atoms. Examples thereof include acetyl, benzoyl, formyl, methoxycarbonyl, ethoxycarbonyl, phenoxycarbonyl, mesyl and tosyl.

Each of the groups represented by $R_{11}$, $R_{12}$, $R_{13}$ and $R_{14}$ of the general formula (I-1) may be substituted, and the substituents include the following. The aforementioned number of carbon atoms of each group includes the number of carbon atoms of the following substituents.

The substituents are, for example, halogen atoms (fluorine atom, chlorine atom, bromine atom and iodine atom), a cyano group, a nitro group, ammonio groups (e.g., trimethylammonio), a phosphonio group, a sulfo group (including a salt), a sulfino group (including a salt), a carboxyl group (including a salt), a phosphono group (including a salt), a hydroxy group, a mercapto group, a hydrazino group, alkyl groups (e.g., methyl, ethyl, n-propyl, isopropyl, t-butyl, n-octyl, cyclopentyl and cyclohexyl), alkenyl groups (e.g., allyl, 2-butenyl and 3-pentenyl), alkynyl groups (e.g., propargyl and 3-pentynyl), aralkyl groups (e.g., benzyl and phenethyl), aryl groups (e.g., phenyl, naphthyl and 4-methylphenyl), heterocyclic groups (e.g., pyridyl, furyl, imidazolyl, piperidyl and morpholino), alkoxy groups (e.g., methoxy, ethoxy and butyloxy), aryloxy groups (e.g., phenoxy and 2-naphthyloxy), alkylthio groups (e.g., methylthio and ethylthio), arylthio groups (e.g., phenylthio), amino groups (e.g., unsubstituted amino, methylamino, dimethylamino, ethylamino and anilino), acyl groups (e.g., acetyl, benzoyl, formyl and pivaloyl), alkoxycarbonyl groups (e.g., methoxycarbonyl and ethoxycarbonyl), aryloxycarbonyl groups (e.g., phenoxycarbonyl), carbamoyl groups (e.g., unsubstituted carbamoyl, N,N-dimethylcarbamoyl, N-ethylcarbamoyl and N-phenylcarbamoyl), acyloxy groups (e.g., acetoxy and benzoyloxy), acylamino groups (e.g., acetylamino and benzoylamino), alkoxycarbonylamino groups (e.g., methoxycarbonylamino), aryloxycarbonylamino groups (e.g., phenoxycarbonylamino), ureido groups (e.g., unsubstituted ureido, N-methylureido and N-phenylureido), alkylsulfonylamino groups (e.g., methylsulfonylamino), arylsulfonylamino groups (e.g., phenylsulfonylamino), alkylsulfonyloxy groups (e.g., methylsulfonyloxy), arylsulfonyloxy groups (e.g., phenylsulfonyloxy), alkylsulfonyl groups (e.g., mesyl), arylsulfonyl groups (e.g., tosyl), alkoxysulfonyl groups (e.g., methoxysulfonyl), aryloxysulfonyl groups (e.g., phenoxysulfonyl), sulfamoyl groups (e.g., unsubstituted sulfamoyl, N-methylsulfamoyl, N,N-dimethylsulfamoyl and N-phenylsulfamoyl), alkylsulfinyl groups (e.g., methylsulfinyl), arylsulfinyl groups (e.g., phenylsulfinyl), alkoxysulfinyl groups (e.g., methoxysulfinyl), aryloxysulfinyl groups (e.g., phenoxysulfinyl) and phosphoamide groups (e.g., N,N-diethylphosphoamide). These groups may further be substituted. When a plurality of substituents exist, they may be identical with or different from each other.

In the general formula (I-1), each of $Z_1$ and $Z_2$ independently represents an alkylene group, an arylene group or a divalent heterocyclic residue. The alkylene group is, for example, methylene, ethylene, propylene, cyclopentylene or cyclohexylene. The arylene group is, for example, phenylene or naphthalene. The heterocycle of the divalent heterocyclic residue is, for example, pyridine, imidazole, quinoline, pyrimidine, thiazole, thiophene, furan, morpholine, piperazine or piperidine. Furthermore, $Z_1$ and $Z_2$ may have the same substituents as those mentioned above for $R_{11}$, $R_{12}$, $R_{13}$ and $R_{14}$.

In the general formula (I-1), each of $Y_1$ and $Y_2$ independently represents —$S(R_{21})$—, —$N(R_{22})(R_{23})$— or —$O(R_{24})$—. $R_{21}$ and $R_{24}$ each independently have the same meaning as $R_{11}$ and $R_{14}$ of $X_1$ and $X_2$. $R_{22}$ and $R_{23}$ each independently have the same meaning as $R_{12}$ and $R_{13}$ of $X_1$ and $X_2$.

In the general formula (I-1), each of $L_1$ and $L_2$ independently represents a single bond, an alkylene group, —CO— or —$SO_2$—, provided that, when each of $X_1$ and $X_2$ is —$NR_{12}R_{13}$— and each of $Y_1$ and $Y_2$ is —$NR_{22}R_{23}$—, each of $L_1$ and $L_2$ represents —CO— or —$SO_2$—. The alkylene group is, for example, methylene, ethylene, propylene, cyclopentylene or cyclohexylene. This alkylene group may be substituted with substituents mentioned above for $R_{11}$, $R_{12}$, $R_{13}$ and $R_{14}$.

In the general formula (I-1), $X_1$ and $X_2$, or $Y_1$ and $Y_2$, or $L_1$ and $L_2$, or $Z_1$ and $Z_2$, may be identical with or different from each other. $X_1$ and $Z_1$, or $X_1$ and $L_1$, or $Y_1$ and $Z_1$, or $Y_1$ and $L_1$, may be coupled with each other to thereby form a saturated or unsaturated heterocycle. $X_2$ and $Z_2$, or $X_2$ and $L_2$, or $Y_2$ and $Z_2$, or $Y_2$ and $L_2$, may be coupled with each other to thereby form a saturated or unsaturated heterocycle. Moreover, $X_1$ and $X_2$ and/or $Y_1$ and $Y_2$, may be coupled with each other to thereby form a compound whose single molecule coordinates with palladium ion.

In the general formula (I-1), Q represents an anionic ion, such as a halide ion, a nitrate ion, a carbonate ion, a hydrogen carbonate ion, a sulfate ion, a sulfite ion, a cyano ion, a cyanate ion, an isocyanate ion, a thiocyanate ion, a borate ion, a phosphonate ion, a perchlorate ion, an organic carboxylate ion (e.g., formate ion, acetate ion or oxalate ion) or an organic sulfonate ion (e.g., methanesulfonate ion, benzenesulfonate ion, p-toluenesulfonate ion or 2,6-naphthalenedisulfonate ion). Q is preferably a halide ion (chloro ion or bromo ion), a nitrate ion, a sulfate ion, a sulfite ion, a cyanate ion or a perchlorate ion.

In the general formula (I-1), m is an integer of 0 to 4.

In solutions, the compounds of the general formula (I-1) are in Pd(II) complex forming equilibrium with ligands. Thus, the two ligands of the general formula (I-1) can have both of trans and cis structures in solutions. For simple expression, only one of the isomers is described herein in the present invention.

In the general formula (I-1), it is preferred that $X_1$ and $X_2$, and $Y_1$ and $Y_2$, and $L_1$ and $L_2$, and $Z_1$ and $Z_2$, be identical with each other; that $X_1$ represent —$S(R_{11})$— or —$N(R_{12})(R_{13})$—, $Z_1$ represent a substituted or unsubstituted alkylene group or arylene group, $Y_1$ represent —$N(R_{22})(R_{23})$—, and $L_1$ represent a single bond or —CO—; that $R_{11}$ represent a hydrogen atom or an alkyl or aryl group unsubstituted or substituted with a hydrophilic group (for example, sulfo, sulfino, carboxy, phosphono, hydroxy, a carbamoyl group (e.g., unsubstituted carbamoyl, N,N-dimethylcarbamoyl, N-ethylcarbamoyl or N-phenylcarbamoyl), an acylamino group (e.g., acetylamino or benzoylamino), an alkoxycarbonylamino group (e.g., methoxycarbonylamino), a ureido group (e.g., unsubstituted ureido, N-methylureido or N-phenylureido), an alkylsulfonylamino group (e.g., methylsulfonylamino), a sulfamoyl group (e.g., unsubstituted sulfamoyl, N-methylsulfamoyl, N,N-dimethylsulfamoyl or N-phenylsulfamoyl)); and that each of $R_{12}$, $R_{13}$, $R_{22}$ and $R_{23}$ represent a hydrogen atom, or an alkyl, aryl, acyl, alkoxycarbonyl, carbamoyl or alkylsulfonyl group unsubstituted or substituted with a hydrophilic group (same hydrophilic group as used in $R_{11}$) (preferably having 1 to 20 carbon atoms, for example, acetyl, formyl, methoxycarbonyl, ethoxycarbonyl or mesyl).

In the present invention, the compounds represented by the general formula (I-2) are more preferable than the above preferred compound group.

The $Z_1$, $Z_2$, $R_1$, $R_2$, $X_{11}$, $X_{12}$, $X_{13}$ and $X_{14}$ of the general formula (I-2) will be described below.

In the general formula (I-2), each of $Z_1$ and $Z_2$ independently represents an alkylene group (e.g., methylene, ethylene, propylene, cyclopentylene or cyclohexylene), an arylene group (e.g., phenylene or naphthalene) or a divalent heterocyclic residue (as the heterocycle: e.g., pyridine, imidazole, quinoline, pyrimidine, thiazole, thiophene, furan, morpholine, piperazine or piperidine).

In the general formula (I-2), each of $R_1$ and $R_2$ independently represents a hydrogen atom, an alkyl group, an aryl group, a heterocyclic group, an acyl group, an alkoxycarbonyl group, an aryloxycarbonyl group, a carbamoyl group, an alkylsulfonyl group or an arylsulfonyl group. The alkyl group represented by $R_1$ and $R_2$ preferably has 1 to 30 carbon atoms, and is more preferably a linear, branched or cyclic alkyl group having 1 to 10 carbon atoms. Examples thereof include methyl, ethyl, propyl and cyclopropyl. In this specification, for example, when the alkyl group represented by $R_1$ and $R_2$ has the below described substituent, the terminology "number of carbon atoms" refers to the number of carbon atoms including those of the substituent. The same can be applied to other groups as well. The aryl group represented by $R_1$ and $R_2$ preferably has 6 to 30 carbon atoms and more preferably has 6 to 12 carbon atoms and is monocyclic or of condensed rings. Examples thereof include phenyl and naphthyl. The heterocyclic group represented by $R_1$ and $R_2$ is a 3 to 10-membered saturated or unsaturated heterocyclic group containing at least one of nitrogen, oxygen and sulfur atoms. The heterocyclic group may be monocyclic or may form condensed rings with other aromatic rings. The heterocycle is preferably a 5 or 6-membered aromatic heterocycle, which is, for example, 2-pyridyl, 2-imidazolyl, 2-quinolyl, 2-benzimidazolyl, 4-pyrimidyl, 3-pyrazolyl, 2-isoquinolyl, 2-thiazolyl, 3-thienyl, 2-furyl or 2-benzothiazolyl.

Each of the acyl group, alkoxycarbonyl group, aryloxycarbonyl group, carbamoyl group, alkylsulfonyl group and arylsulfonyl group represented by $R_1$ and $R_2$ preferably has 1 to 20 carbon atoms. Examples thereof include acetyl, benzoyl, formyl, methoxycarbonyl, ethoxycarbonyl, phenoxycarbonyl, mesyl and tosyl.

In the general formula (I-2), the hydrogen atom, alkyl group, aryl group and heterocyclic group each independently represented by $X_{11}$, $X_{12}$, $X_{13}$ and $X_{14}$ have the same meaning as the hydrogen atom, alkyl group, aryl group and heterocyclic group represented by $R_1$ and $R_2$.

In the general formula (I-2), the groups represented by $R_1$ $R_2$, $X_{11}$, $X_{12}$, $X_{13}$, $X_{14}$, $Z_1$ and $Z_2$ may be substituted, and the substituents include the following.

The substituents are, for example, halogen atoms (fluorine, chlorine, bromine and iodine), a cyano group, a nitro group, ammonio groups (e.g., trimethylammonio), a phosphonio group, a sulfo group (including a salt), a sulfino group (including a salt), a carboxy group (including a salt), a phosphono group (including a salt), a hydroxy group, a mercapto group, a hydrazino group, alkyl groups (e.g., methyl, ethyl, n-propyl, isopropyl, t-butyl, n-octyl, cyclopentyl and cyclohexyl), alkenyl groups (e.g., allyl, 2-butenyl and 3-pentenyl), alkynyl groups (e.g., propargyl and 3-pentynyl), aralkyl groups (e.g., benzyl and phenethyl), aryl groups (e.g., phenyl, naphthyl and 4-methylphenyl), heterocyclic groups (e.g., pyridyl, furyl, imidazolyl, piperidyl and morpholino), alkoxy groups (e.g., methoxy, ethoxy and butyloxy), aryloxy groups (e.g., phenoxy and 2-naphthyloxy), alkylthio groups (e.g., methylthio and ethylthio), arylthio groups (e.g., phenylthio), amino groups (e.g., unsubstituted amino, methylamino, dimethylamino, ethylamino and anilino), acyl groups (e.g., acetyl, benzoyl, formyl and pivaloyl), alkoxycarbonyl groups (e.g., methoxycarbonyl and ethoxycarbonyl), aryloxycarbonyl groups (e.g., phenoxycarbonyl), carbamoyl groups (e.g., unsubstituted carbamoyl, N,N-dimethylcarbamoyl, N-ethylcarbamoyl and N-phenylcarbamoyl), acyloxy groups (e.g., acetoxy and benzoyloxy), acylamino groups (e.g., acetylamino and benzoylamino), alkoxycarbonylamino groups (e.g., methoxycarbonylamino), aryloxycarbonylamino groups (e.g., phenoxycarbonylamino), ureido groups (e.g., unsubstituted ureido, N-methylureido and N-phenylureido), alkylsulfonylamino groups (e.g., methylsulfonylamino), arylsulfonylamino groups (e.g., phenylsulfonylamino), alkylsulfonyloxy groups (e.g., methylsulfonyloxy), arylsulfonyloxy groups (e.g., phenylsulfonyloxy), alkylsulfonyl groups (e.g., mesyl), arylsulfonyl groups (e.g., tosyl), alkoxysulfonyl groups (e.g., methoxysulfonyl), aryloxysulfonyl groups (e.g., phenoxysulfonyl), sulfamoyl groups (e.g., unsubstituted sulfamoyl, N-methylsulfamoyl, N,N-dimethylsulfamoyl and N-phenylsulfamoyl), alkylsulfinyl groups (e.g., methylsulfinyl), arylsulfinyl groups (e.g., phenylsulfinyl), alkoxysulfinyl groups (e.g., methoxysulfinyl), aryloxysulfinyl groups (e.g., phenoxysulfinyl) and phosphoamide groups (e.g., N,N-diethylphosphoamide). These groups may further be substituted. When a plurality of substituents exist, they may be identical with or different from each other.

In the general formula (I-2), the two ligands may be identical with or different from each other.

Further, $X_{11}$ and $Z_1$ may be coupled with each other, and/or $X_{14}$ and $Z_2$ may be coupled with each other, to thereby form a ring. Still further, $X_{11}$, and $X_{13}$ may be coupled with each other, or $R_1$ and $R_2$ may be coupled with each other, to thereby form a compound whose single molecule coordinates with palladium ion.

In the compounds of the general formula (I-2), the two ligands can have both of trans and cis structures.

The compounds preferably employed in the present invention are those represented by the general formula (I-2).

In the general formula (I-2), preferably, each of $Z_1$ and $Z_2$ represents an alkylene group; each of $R_1$ and $R_2$ represents a hydrogen atom, an alkyl group, an acyl group, a carbamoyl group, an alkylsulfonyl group or an arylsulfonyl group; and each of $X_{11}$, $X_{12}$, $X_{13}$ and $X_{14}$ represents a hydrogen atom or an alkyl group.

In the general formula (I-2), more preferably, each of $X_{11}$ and $X_{12}$ represents an alkylene group; each of $R_1$ and $R_2$ represents a hydrogen atom or an alkyl group; and each of $X_{11}$, $X_{12}$, $X_{13}$ and $X_{14}$ represents a hydrogen atom or an alkyl group.

In the general formula (I-2), most preferably, each of $Z_1$ and $Z_2$ represents a methylene group; each of $R_1$ and $R_2$ represents a hydrogen atom or an alkyl group having 1 to 6 carbon atoms, substituted with a hydrophilic group (for example, a sulfo group, a carboxy group, a hydroxy group, an amino group, an ammonium group, a carbamoyl group or a sulfamoyl group); and each of $X_{11}$, $X_{12}$, $X_{13}$ and $X_{14}$ represents a hydrogen atom or an alkyl group having 1 to 6 carbon atoms, substituted with a hydrophilic group (for example, a sulfo group, a carboxy group, a hydroxy group, an amino group, an ammonium group, a carbamoyl group or a sulfamoyl group).

Specific examples of the compounds represented by the general formula (I-1) and general formula (I-2) will be set forth below, which in no way limit the compounds of the present invention.

I-1-1
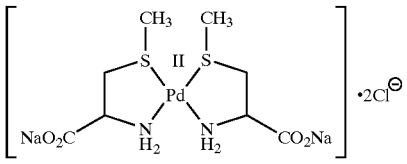
I-1-2
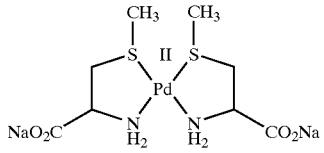
I-1-3
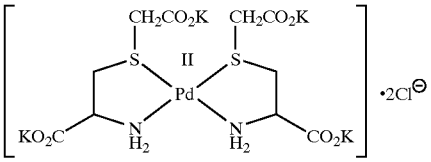
I-1-4
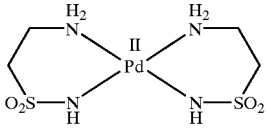
I-1-5
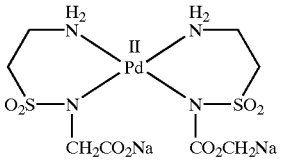
I-1-6
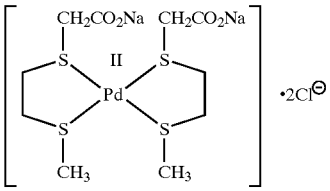
I-1-7
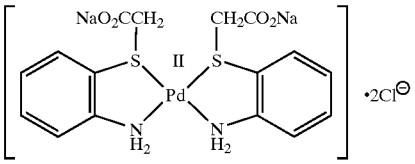
I-1-8
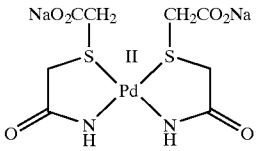
I-2-1
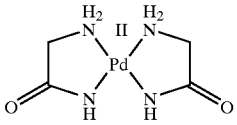
-continued
I-2-2
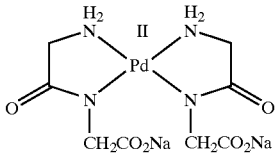
I-2-3
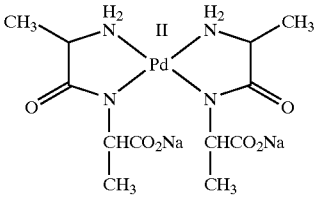
I-2-4
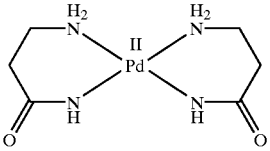
I-2-5
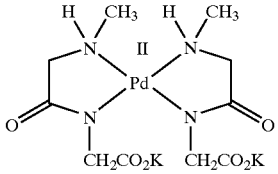
I-2-6
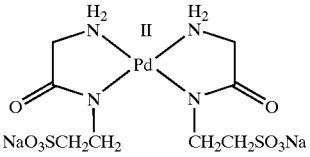
I-2-7
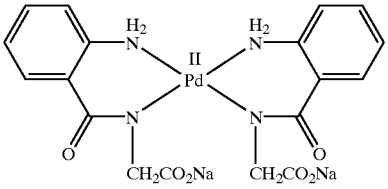
I-2-8
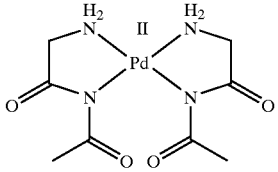
I-2-9
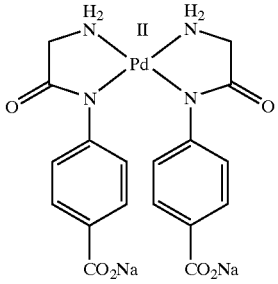

-continued

I-2-10

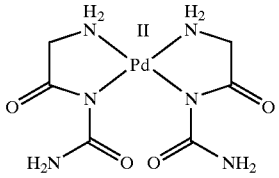

I-2-11

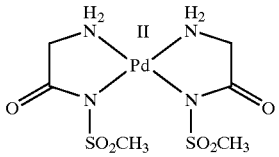

I-2-12

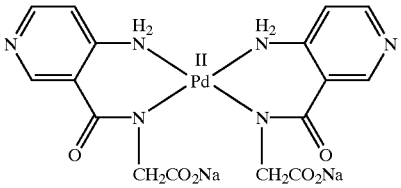

I-2-13

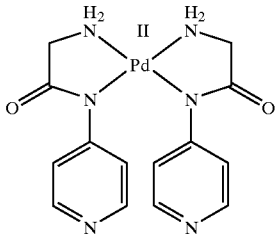

I-2-14

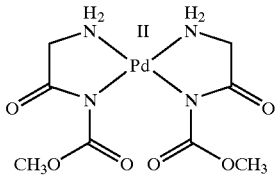

I-2-15

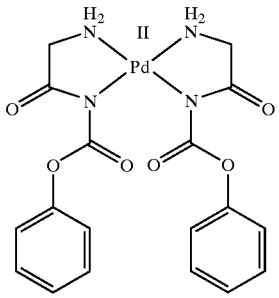

I-2-16

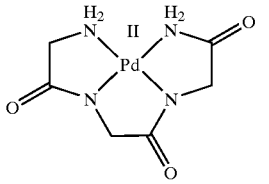

I-2-17

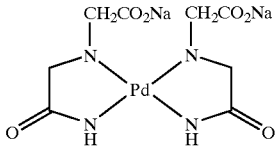

-continued

I-2-18

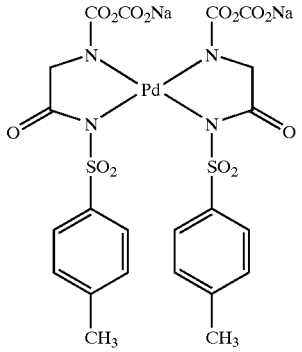

I-2-19

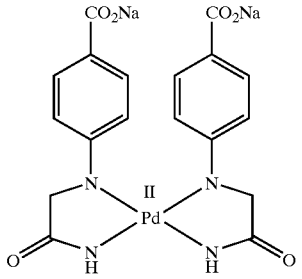

I-2-20

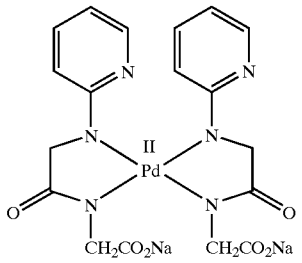

The ligands (for example, $X_1$—$L_1$—$Z_1$—$Y_1$) of the general formula (I-1) can easily be obtained as commercial products or as compounds synthesized from commercially available chemicals by known methods.

The palladium compounds represented by the general formula (I-1) can be synthesized from the corresponding ligands and organic or inorganic palladium compounds by known methods. The synthetic methods are described in, for example, J. Inorg. Nucl. Chem., vol. 41, page 429 (1979), Inorg. Chim. Acta, vol. 7, page 88 (1973), Acta Crystallogr., Sect. B, vol. 29, page 762 (1973), Inorganic Chemistry, vol. 7, page 1447 (1968), Journal of Inorganic Chemistry, vol. 8, page 304 (1963), and ibid. vol. 23, page 561 (1978), the disclosures of which are herein incorporated by reference.

The palladium compounds for use in the synthesis of the compounds of the general formula (I-1) are described in detail in, for example, Gmelin Handbook TEIL 65 (published in 1942) and ibid. Supplement vol. B2 (published in 1989), and are available as commercial products, synthetic products or in situ synthetic products.

Specific examples of suitable palladium compounds include palladium (II) chloride, palladium (II) bromide, palladium (II) hydroxide, palladium (II) sulfate, palladium (II) thiocyanate, tetrachloropalladium (II) acid salts (sodium salt, potassium salt or ammonium salt), hexachloropalladium (IV) acid salts, tetrabromopalladium (II) acid salts, hexabromopalladium (IV) acid salts, bis(salicylato) palladium (II) acid salts, bis(dithiooxalato-S,S')palladium (II) acid salts, trans-dichlorobis(thioether)palladium (II), tetraamminepalladium (II) salts, dichlorodiaminepalladium (II), dibromodiaminepalladium (II), oxalatodiaminepalladium (II) and bis(glycinato)palladium (II).

In the present invention, the method customarily used for adding additives to photographic lightsensitive materials can be employed in the addition of the compound of the general formula (I-1) to the silver halide photographic lightsensitive material. For example, the addition of the compound can be accomplished by dissolving a water-soluble compound in water to thereby obtain an aqueous solution of appropriate concentration, or by dissolving a water insoluble or scarcely soluble compound in an appropriate organic solvent miscible with water, e.g., any of alcohols, glycols, ketones, esters and amides which is not detrimental to the photographic performance to thereby obtain a solution, and adding the solution to the silver halide photographic lightsensitive material. The compounds of the general formula (I-1) may be added to the silver halide photographic lightsensitive material either after the synthesis and isolation thereof conducted in the manner as described in the above literature, or, without isolation, in the form of a solution of a mixture of a palladium compound and a ligand.

In the present invention, the solution of palladium compound represented by the general formula (I-1) can be incorporated in at least one of a lightsensitive emulsion layer, an interlayer, an antihalation layer and a surface protective layer. Further, the solution of palladium compound represented by the general formula (I-1) according to the present invention together with a binder may newly be provided as a separate layer. Preferably, the solution is incorporated in an interlayer, an antihalation layer or a surface protective layer. In the incorporation in such a layer, the solution is added to a coating liquid for forming the layer. The addition may be conducted at any stage during preparation of the coating liquid or just before the application thereof. When the solution is incorporated in the lightsensitive emulsion layer, although the addition may be performed immediately after the grain formation of the silver halide emulsion, it is preferred that the solution addition be performed after chemical sensitization.

In the present invention, the palladium compound represented by the general formula (I-1) is contained in an amount of $1\times10^{-7}$ to $1\times10^{-3}$ mol, preferably $1\times10^{-6}$ to $1\times10^{-4}$ mol, per $m^2$ of lightsensitive material.

The water-soluble mercaptotetrazole compound represented by the general formula (II-1) of the present invention will now be described.

In the general formula (II-1), $R_5$ represents an organic residue substituted with at least one member selected from the group consisting of —$SO_3M$, —COOM, —OH and —$NHR_2$, wherein M and $R_2$ are as defined above. The organic residue is, for example, an alkyl group having 1 to 10 carbon atoms (e.g., methyl, ethyl, propyl, hexyl or cyclohexyl) or an aryl group having 6 to 14 carbon atoms (e.g., phenyl or naphthyl).

In the general formula (II-1), the groups represented by $R_5$ may further be substituted, and the substituents include the following.

The substituents are, for example, halogen atoms (fluorine, chlorine, bromine and iodine), a cyano group, a nitro group, ammonio groups (e.g., trimethylammonio), a phosphonio group, a sulfo group (including a salt), a sulfino group (including a salt), a carboxyl group (including a salt), a phosphono group (including a salt), a hydroxy group, a mercapto group, a hydrazino group, alkyl groups (e.g., methyl, ethyl, n-propyl, isopropyl, t-butyl, n-octyl, cyclopentyl and cyclohexyl), alkenyl groups (e.g., allyl, 2-butenyl and 3-pentenyl), alkynyl groups (e.g., propargyl and 3-pentynyl), aralkyl groups (e.g., benzyl and phenethyl), aryl groups (e.g., phenyl, naphthyl and 4-methylphenyl), heterocyclic groups (e.g., pyridyl, furyl, imidazolyl, piperidyl and morpholino), alkoxy groups (e.g., methoxy, ethoxy and butyloxy), aryloxy groups (e.g., phenoxy and 2-naphthyloxy), alkylthio groups (e.g., methylthio and ethylthio), arylthio groups (e.g., phenylthio), amino groups (e.g., unsubstituted amino, methylamino, dimethylamino, ethylamino and anilino), acyl groups (e.g., acetyl, benzoyl, formyl and pivaloyl), alkoxycarbonyl groups (e.g., methoxycarbonyl and ethoxycarbonyl), aryloxycarbonyl groups (e.g., phenoxycarbonyl), carbamoyl groups (e.g., unsubstituted carbamoyl, N,N-dimethylcarbamoyl, N-ethylcarbamoyl and N-phenylcarbamoyl), acyloxy groups (e.g., acetoxy and benzoyloxy), acylamino groups (e.g., acetylamino and benzoylamino), alkoxycarbonylamino groups (e.g., methoxycarbonylamino), aryloxycarbonylamino groups (e.g., phenoxycarbonylamino), ureido groups (e.g., unsubstituted ureido, N-methylureido and N-phenylureido), alkylsulfonylamino groups (e.g., methylsulfonylamino), arylsulfonylamino groups (e.g., phenylsulfonylamino), alkylsulfonyloxy groups (e.g., methylsulfonyloxy), arylsulfonyloxy groups (e.g., phenylsulfonyloxy), alkylsulfonyl groups (e.g., mesyl), arylsulfonyl groups (e.g., tosyl), alkoxysulfonyl groups (e.g., methoxysulfonyl), aryloxysulfonyl groups (e.g., phenoxysulfonyl), sulfamoyl groups (e.g., unsubstituted sulfamoyl, N-methylsulfamoyl, N,N-dimethylsulfamoyl and N-phenylsulfamoyl), alkylsulfinyl groups (e.g., methylsulfinyl), arylsulfinyl groups (e.g., phenylsulfinyl), alkoxysulfinyl groups (e.g., methoxysulfinyl), aryloxysulfinyl groups (e.g., phenoxysulfinyl) and phosphoamide groups (e.g., N,N-diethylphosphoamide). These groups may further be substituted. When a plurality of substituents exist, they may be identical with or different from each other.

When there are at least two —$SO_3M$, —COOM, —OH and —$NHR_2$ groups as $R_5$ substituents, they may be identical with or different from each other.

In the general formula (II-1), $R_2$ represents a hydrogen atom, an alkyl group having 1 to 6 carbon atoms, —$COR_3$, —$COOR_3$ or —$SO_2R_3$. $R_3$ represents a hydrogen atom, an alkyl group having 1 to 20 carbon atoms (e.g., methyl, ethyl, propyl, hexyl, cyclohexyl, dodecyl or octadecyl) or an aryl group (e.g., phenyl or naphthyl). These groups may be substituted with those set forth above as $R_5$ substituents.

In the general formula (II-1), M represents a hydrogen atom, an alkali metal atom (e.g., lithium, sodium or potassium), a quaternary ammonium group (e.g., ammonio, tetramethylammonio, benzyltrimethylammonio or tetrabutylammonio) or a quaternary phosphonium group (e.g., tetramethylphosphonio).

In the general formula (II-1), it is preferred that $R_5$ represent a phenyl substituted with one or two —$SO_3M$ groups, a phenyl substituted with one or two —COOM groups, a phenyl substituted with one or two —$NHR_2$ groups, an alkyl group having 1 to 4 carbon atoms, substituted with one or two —$SO_3M$ groups, or an alkyl group having 1 to 4 carbon atoms, substituted with one or two —COOM groups; that $R_2$ represent a hydrogen atom, an alkyl group having 1 to 4 carbon atoms or —$COR_3$; that $R_3$ represent a hydrogen atom or an alkyl group having 1 to 4 carbon atoms, substituted with a hydrophilic group (e.g., carboxyl, sulfo or hydroxy); and that M represent a hydrogen atom or a sodium atom. More preferably, $R_5$ represents a phenyl substituted with —$SO_3M$ or a phenyl substituted with —COOM.

Specific examples of the compounds represented by the general formula (II-1) will be set forth below, which in no way limit the present invention.

II-1-1

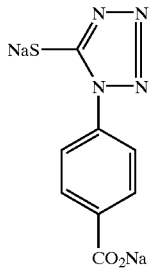

II-1-2

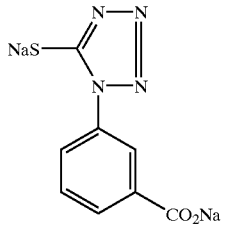

II-1-3

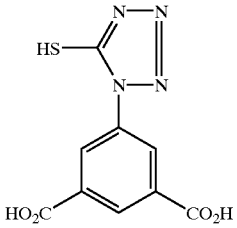

II-1-4

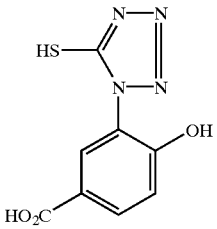

II-1-5

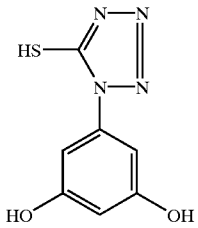

II-1-6

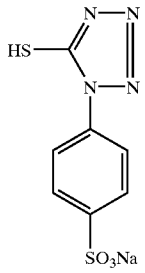

-continued

II-1-7

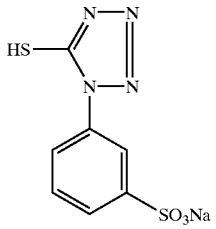

II-1-8

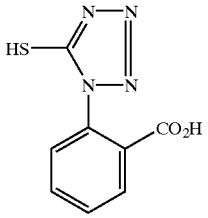

II-1-9

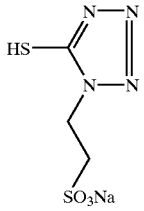

II-1-10

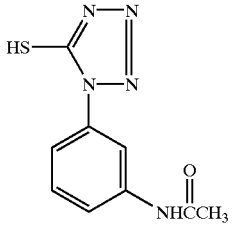

II-1-11

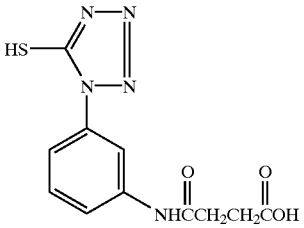

The general formula (II-2) will now be described. M and $R_5$ of the general formula (II-2) have the same meaning as M and $R_5$ of the general formula (II-1), respectively.

In the general formula (II-2), $R_6$ represents a hydrogen atom, an alkyl group having 1 to 10 carbon atoms (e.g., methyl, ethyl, propyl, hexyl or cyclohexyl) or an aryl group having 6 to 15 carbon atoms (e.g., phenyl or naphthyl). The alkyl or aryl group may be substituted with those set forth above as substituents of $R_5$ of the general formula (II-1).

In the general formula (II-2), it is preferred that $R_6$ represent a hydrogen atom, an alkyl group having 1 to 4 carbon atoms or phenyl; that $R_5$ represent a phenyl substituted with one or two $-SO_3M$ groups, a phenyl substituted with one or two —COOM groups, a phenyl substituted with one or two $—NHR_2$ groups, an alkyl group having 1 to 4 carbon atoms, substituted with one or two $—SO_3M$ groups, or an alkyl group having 1 to 4 carbon atoms, substituted with one or two —COOM groups; that $R_2$ represent a hydrogen atom, an alkyl group having 1 to 4 carbon atoms or —$COR_3$; that $R_3$ represent a hydrogen atom or an alkyl group having 1 to 4 carbon atoms, substituted with a hydrophilic group (e.g., carboxyl, sulfo or hydroxy); and that M represent a hydrogen atom or a sodium atom. More preferably, $R_6$ represents a hydrogen atom, and $R_5$ represents a phenyl substituted with one —$SO_3M$ group or a phenyl substituted with one —COOM group.

Specific examples of the compounds represented by the general formula (II-2) will be set forth below, which in no way limit the present invention.

II-2-1

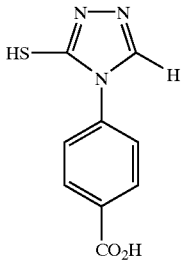

II-2-2

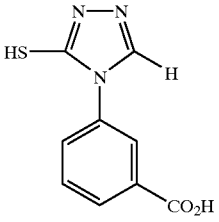

II-2-3

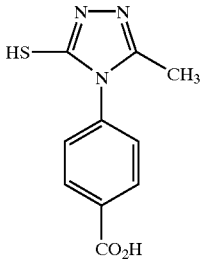

II-2-4

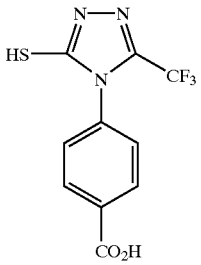

II-2-5

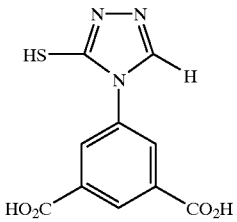

-continued

II-2-6

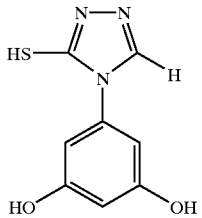

II-2-7

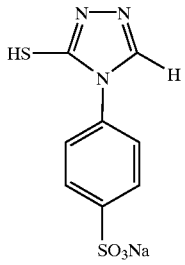

II-2-8

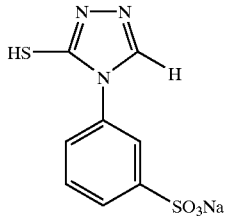

II-2-9

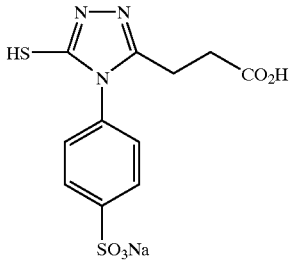

II-2-10

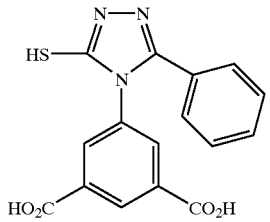

II-2-11

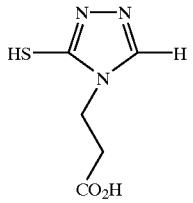

II-2-12

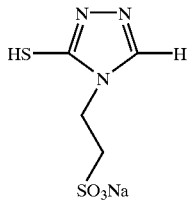

-continued

II-2-13

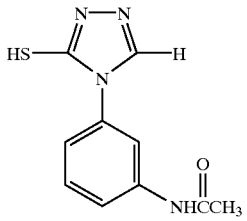

II-2-14

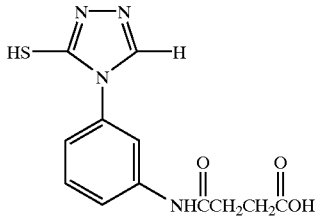

The compounds represented by the general formula (II-1) and (II-2) are known, and can be synthesized by the methods described in the following literature.

The literature includes "The Chemistry of Heterocyclic Chemistry" 1,2,4-triazole, pages 404 to 442, edited by John A. Montogomery, JOHN WILEY & SONS (1981); S. R. Sandier, W. Karo "Organic Functional Group Preparation", pages 312 to 315, Academic Press (1968); "COMPREHENSIVE HETEROCYCLIC COMPOUNDS" vol. 5, pages 761 to 784 and pages 825 to 834, edited by Kevin T. Pott, PERGAMON PRESS; "HETEROCYCLIC COMPOUNDS", pages 425 to 445, edited by Robert C. Elderfield, JOHN WILEY & SONS (1961); and "THE HIGH NITROGEN COMPOUNDS", pages 640 to 653, edited by Frederic R. Benson, JOHN WILEY & SONS (1984).

The compound represented by the general formula (II-1) or general formula (II-2), although contained in a silver halide emulsion layer or hydrophilic colloid layers (interlayer, surface protective layer, yellow filter layer, antihalation layer, etc.), is preferably incorporated in a silver halide emulsion layer or a layer neighboring thereto. It is most preferred that the compound be incorporated in an emulsion layer in which an emulsion of any one of Embodiments I to VI mentioned above.

The compound of the general formula (II-1) and the compound of the general formula (II-2) are preferably incorporated in the same layer or neighboring layers. Most preferably, the compounds are incorporated in the same layer.

The incorporation of this compound in the emulsion is satisfactorily performed in accordance with the customary method of adding photographic emulsion additives. For example, this compound can be dissolved in methyl alcohol, ethyl alcohol, methyl cellosolve, acetone, water or a solvent of a mixture thereof, and added in the form of a solution.

The compound represented by the general formula (II-1) or (II-2) can be added at any step of the process for producing the photographic emulsion, and can be added at any stage after completion of emulsion production but just before coating. With respect to preferable addition step in the present invention, it is effective to conduct the addition between completion of silver halide grain formation and step of chemical sensitization.

The addition amount of compound represented by the general formula (II-1) or (II-2), in terms of total amount, is generally in the range of $1\times10^{-6}$ to $1\times10^{-1}$ mol, preferably $5\times10^{-6}$ to $5\times10^{-3}$ mol, per mol of selenium-sensitized silver halide. The molar ratio of compound of the general formula (II-1) to compound of general formula (II-2) when used in combination, although arbitrary, is preferably in the range of 99.5:0.5 to 50:50, more preferably 99:1 to 70:30. Thus, it is preferred that the use of the compound of the general formula (II-2) be made in smaller amount.

In the present invention, in the joint use of compounds of the general formulae (II-1) and (II-2), the timing of adding the compound of the general formula (II-1) and the timing of adding the compound of the general formula (II-2) may be identical with or different from each other. For example, it is feasible to add the compound of the general formula (II-2) between completion of silver halide grain formation and completion of chemical sensitization step while adding the compound of the general formula (II-1) after completion of chemical sensitization step but just before coating, or vice versa. However, the former is preferred.

In the lightsensitive material of the present invention, it is only required that at least one lightsensitive layer be formed on a support. A typical example thereof is a silver halide photographic lightsensitive material having, on its support, at least one lightsensitive layer constituted by a plurality of silver halide emulsion layers which have substantially the same color sensitivity but have different light sensitivities. This lightsensitive layer includes a unit lightsensitive layer which is sensitive to any of blue light, green light and red light. In a multilayered silver halide color photographic lightsensitive material, these unit lightsensitive layers are generally arranged in the order of red-, green- and blue-sensitive layers from a support side. However, according to the intended use, this arrangement order may be reversed, or an arrangement order can be employed in which a different lightsensitive layer is interposed between the layers of the same color sensitivity. Nonlightsensitive layers can be formed between the silver halide lightsensitive layers and as the uppermost layer and the lowermost layer. These may contain, e.g., couplers, DIR compounds and color mixing inhibitors described later. As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045. Also, as described in JP-A's-57-112751, 62-200350, 62-206541 and 62-206543, the disclosures of which are herein incorporated by reference, layers can be arranged so that a low-speed emulsion layer is formed on a side apart from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is herein incorporated by reference, layers can be arranged, from the farthest side from a support, in the order of blue-sensitive layer/GH/RH/GL/RL. Furthermore, as described in JP-A-56-25738 and JP-A-62-63936, the disclosure of which is herein incorporated by reference, layers can be arranged, from the farthest side from a support, in the order of blue-sensitive layer/GL/RL/GH/RH.

As described in JP-B-49-15495, three layers can be arranged so that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged so that the sensitivity is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in a layer sensitive to one color as described in JP-A-59-202464, the disclosure of which is herein incorporated by reference.

In addition, the order of high-speed emulsion layer/low-speed emulsion layer/medium-speed emulsion layer or low-speed emulsion layer/medium-speed emulsion layer/high-speed emulsion layer can be adopted.

Furthermore, the arrangement can be changed as described above even when four or more layers are formed.

It is preferable to utilize an interlayer inhibitory effect as means for improving a color reproduction.

For imparting the interlayer effect to the red-sensitive layer in a specified wavelength region, it is preferred to dispose a separate interlayer effect donor layer containing silver halide grains, subjected to given spectral sensitization.

Compounds which react developing agent oxidation products obtained by development to thereby release a development inhibitor or a precursor thereof are used as the material for exerting the interlayer effect. For example, use can be made of DIR (development inhibitor releasing) couplers, DIR hydroquinone and couplers capable of releasing DIR hydroquinone or a precursor thereof. When the development inhibitor has a high diffusivity, the development inhibiting effect can be exerted irrespective of the position of the donor layer in the interlayer multilayer structure. However, there also occurs a development inhibiting effect in nonintended directions. Therefore, for correcting this, it is preferred that the donor layer be colored (for example, coloring is made in the same color as that of the layer on which undesirable development inhibitor effect is exerted). From the viewpoint that the lightsensitive material of the present invention obtains desirable spectral sensitivity, it is preferred that the donor layer capable of exerting the interlayer effect realize magenta coloring.

Although, for example, the size and configuration of silver halide grains for use in the layer capable of exerting an interlayer effect on the red-sensitive layer are not particularly limited, it is preferred to use so-called tabular grains of high aspect ratio, a monodisperse emulsion having uniform grain size, or silver iodobromide grains having an iodine layer structure. Further, for extending an exposure latitude, it is preferred to mix a plurality of emulsions whose grain sizes are different from each other.

Although the donor layer capable of exerting the interlayer effect on the red-sensitive layer may be provided by coating on any position on the support, it is preferred that the donor layer be provided by coating at a position which is closer to the support than the blue-sensitive layer and which is more remote from the support than the red-sensitive layer. It is further preferred that the donor layer be positioned closer to the support than the yellow filter layer.

It is more preferred that the donor layer capable of exerting the interlayer effect on the red-sensitive layer be provided at a position which is closer to the support than the green-sensitive layer and which is more remote from the support than the red-sensitive layer. The donor layer is most preferably arranged at a position neighboring to a side of the green-sensitive layer close to the support. The terminology "neighboring" used herein means that an intermediate layer or any other thing is interposed therebetween.

There may be a plurality of layers capable of exerting the interlayer effect on the red-sensitive layer. These layers may be positioned so that they neighbor to each other or are apart from each other.

The emulsion for use in the lightsensitive material of the present invention may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, whose productive process is described in JP-A-59-133542. The thickness of the shell of this emulsion, although varied depending on development processing, etc., is preferably in the range of 3 to 40 nm, more preferably 5 to 20 nm.

The silver halide emulsion is generally subjected to physical ripening, chemical sensitization and spectral sensitization before use. Additives employed in these steps are described in RD No. 17643, RD No. 18716 and RD No. 307105. Positions where the description is made are listed in the following table.

With respect to the lightsensitive material of the present invention, at least two emulsions which are different from each other in at least one of the characteristics, specifically the grain size, grain size distribution, halogen composition, grain configuration and sensitivity of lightsensitive silver halide emulsion, can be mixed together and used in one layer.

It is preferred that silver halide grains having a grain surface fogged as described in U.S. Pat. No. 4,082,553, silver halide grains having a grain internal portion fogged as described in U.S. Pat. No. 4,626,498 and JP-A-59-214852 and colloidal silver be used in lightsensitive silver halide emulsion layers and/or substantially nonlightsensitive hydrophilic colloid layers. The expression "silver halide grains having a grain surface or grain internal portion fogged" refers to silver halide grains which can be developed uniformly (nonimagewise) irrespective of the nonexposed or exposed zone of lightsensitive material. The process for producing them is described in U.S. Pat. No. 4,626,498 and JP-A-59-214852. The silver halides constituting internal nuclei of core/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 $\mu$m, more preferably 0.05 to 0.6 $\mu$m. With respect to grain configuration, although both regular grains and a polydisperse emulsion can be used, monodispersity (at least 95% of the weight or number of silver halide grains have grain sizes falling within ±40% of the average grain size) is preferred.

In the present invention, it is preferred to use nonlightsensitive fine grain silver halide. The expression "nonlightsensitive fine grain silver halide" refers to silver halide fine grains which are not sensitive at the time of imagewise exposure for obtaining dye image and which are substantially not developed at the time of development processing thereof. Those not fogged in advance are preferred. The fine grain silver halide has a silver bromide content of 0 to 100 mol %, and, if necessary, may contain silver chloride and/or silver iodide. Preferably, silver iodide is contained in an amount of 0.5 to 10 mol %. The average grain size (average of equivalent circular diameter of projected area) of fine grain silver halide is preferably in the range of 0.01 to 0.5 μm, more preferably 0.02 to 0.2 μm.

The fine grain silver halide can be prepared by the same process as used in the preparation of common lightsensitive silver halide. It is not needed to optically sensitize the surface of silver halide grains. Further, a spectral sensitization thereof is also not needed. However, it is preferred to add known stabilizers such as triazole, azaindene, benzothiazolium and mercapto compounds and zinc compounds thereto prior to the addition thereof to a coating liquid. Colloid silver can be contained in the fine grain silver halide containing layers.

In the lightsensitive material of the present invention, the coating amount of silver is preferably 8.0 g/m$^2$ or less.

The above various additives can be used in the lightsensitive material according to the present tech-nology, to which other various additives can also be added in conformity with the object.

The additives are described in detail in Research Disclosure Item 17643 (December 1978), Item 18716 (November 1979) and Item 308119 (December 1989), the disclosures of which are herein incorporated by reference. A summary of the locations where they are described will be listed in the following table. The disclosures of the listed documents are herein incorporated by reference.

| | Types of additives | RD17643 | RD18716 | RD308119 |
|---|---|---|---|---|
| 1 | Chemical sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

Layer arrangement and related techniques, silver halide emulsions, dye forming couplers, DIR couplers and other functional couplers, various additives and development processing which can be used in the emulsion of the present invention and in the photographic lightsensitive material including the emulsion are described in EP 0565096A1 (published on Oct. 13, 1993) and patents cited therein, the disclosures of which are herein incorporated by reference. Indi-vidual particulars and the locations where they are described will be listed below.

1. Layer construction: page 61 lines 23 to 35, page 61 line 41 to page 62 line 14,
2. Interlayers: page 61 lines 36 to 40,
3. Interlayer effect imparting layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion production methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical ripening of emulsion: page 63 lines 6 to 9,
13. Emulsion mixing: page 63 lines 10 to 13,
14. Fogging emulsions: page 63 lines 14 to 31,
15. Nonlightsensitive emulsions: page 63 lines 32 to 43,
16. Amounts of coated silver: page 63 lines 49 to 50,
17. Photographic additives: The additives are described in Research Disclosure (RD) Item 17643 (December 1978), Item 18716 (November 1979) and Item 307105 (November 1989), the disclosures of which are herein incorporated by reference. Individual particulars and the locations where they are described will be listed below.

| | Types of additives | RD17643 | RD18716 | RD307105 |
|---|---|---|---|---|
| 1 | Chemical sensitizers | page 23 | page 648 right column | page 866 |
| 2 | Sensitivity increasing agents | | page 648 right column | |
| 3 | Spectral sensitizers, super-sensitizers | pages 23–24 | page 648, right column to page 649, right column | pages 866–868 |

-continued

| | Types of additives | RD17643 | RD18716 | RD307105 |
|---|---|---|---|---|
| 4 | Brighteners | page 24 | page 647, | page 868 right column |
| 5 | Antifoggants, stabilizers | pages 24–25 | page 649 right column | pages 868–870 |
| 6 | Light absorbents, filter dyes, ultraviolet absorbents | pages 25–26 | page 649, right column to page 650, left column | page 873 |
| 7 | Stain preventing agents | page 25, right column | page 650, left to right columns | page 872 |
| 8 | Dye image stabilizers | page 25 | page 650, left column | page 872 |
| 9 | Film hardeners | page 26 | page 651, left column | pages 874–875 |
| 10 | Binders | page 26 | page 651, left column | pages 873–874 |
| 11 | Plasticizers, lubricants | page 27 | page 650, right column | page 876 |
| 12 | Coating aids, surfactants | pages 26–27 | page 650, right column | pages 875–876 |
| 13 | Antistatic agents | page 27 | page 650, right column | pages 876–877 |
| 14 | Matting agents | | | pages 878–879. |

18. Formaldehyde scavengers: page 64 lines 54 to 57,
19. Mercapto antifoggants: page 65 lines 1 to 2,
20. Fogging agent, etc. releasing agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye forming couplers: page 65 lines 29 to 31,
26. Colored couplers: page 65 lines 32 to 38,
27. Functional coupler summary: page 65 lines 39 to 44,
28. Bleaching accelerator releasing couplers: page 65 lines 45 to 48,
29. Development accelerator releasing couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swelling velocity: page 66 line 40 to page 67 line 1,
35. Back layers: page 67 lines 3 to 8,
36. Development processing summary: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution aperture ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. Washing with water, rinse and stabilization: page 69 line 41 to page 70 line 18,
45. Processing solution replenishment and recycling: page 70 lines 19 to 23,
46. Containment of developing agent and sensitive material: page 70 lines 24 to 33,
47. Development processing temperature: page 70 lines 34 to 38, and
48. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP 602,600. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contain an organic acid such as acetic acid, succinic acid, maleic acid, glutaric acid or adipic acid in an amount of 0.1 to 2 mol/liter (hereinafter liter referred to as "L").

Processing agent E-6 available from Eastman Kodak and processing agent CR-56 available from Fuji Photo Film Co., Ltd. can be mentioned as preferred color reversal film processing agents including the above feature.

The magnetic recording layer preferably used in the present invention will be described below.

The magnetic recording layer preferably used in the present invention is obtained by coating a support with a water-base or organic solvent coating liquid having magnetic material grains dispersed in a binder.

The magnetic material grains for use in the present invention can be composed of any of ferromagnetic iron oxides such as $\gamma Fe_2O_3$, Co coated $\gamma Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated $\gamma Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of $S_{BET}$.

The saturation magnetization ($\sigma_S$) of the ferromagnetic material preferably ranges from $3.0\times10^{-4}$ to $3.0\times10^{-5}$ A/m, more preferably from $4.0\times10^{-4}$ to $2.5\times10^{-5}$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A-4-259911 and JP-A-5-81652.

The binder for use in the magnetic material grains can be composed of any of natural polymers (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million. For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred. The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The weight ratio of magnetic material grains to binder is preferably in the range of 0.5:100 to 60:100, more preferably 1:100 to 30:100. The coating amount of magnetic material grains ranges from 0.005 to 3 g/m$^2$, preferably from 0.01 to 2 g/m$^2$, and more preferably from 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as mentioned above and, preferably, the same as the that of the magnetic recording layer. The lightsensitive material having the magnetic recording layer is described in U.S. Pat. Nos. 5,336,589, 5,250,404, 5,229,259, and 5,215,874 and EP No. 466,130.

The polyester support preferably used in the present invention will be described below. Particulars thereof together with the below mentioned lightsensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester of the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

In the present invention, a surface treatment is preferably conducted for bonding a support and a lightsensitive material constituting layer to each other. The surface treatment is, for example, a surface activating treatment such as chemical treatment, mechanical treatment, corona discharge treatment, flame treatment, ultraviolet treatment, high frequency treatment, glow discharge treatment, active plasma treatment, laser treatment, mixed acid treatment or ozone oxidation treatment. Of these surface treatments, ultraviolet irradiation treatment, flame treatment, corona treatment and glow treatment are preferred.

The subbing method will be described below. The substratum may be composed of either a single layer or at least two layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose and gelatin. Resorcin or p-chlorophenol is used as a support swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-S-triazine), an epichlorohydrin resin or an active vinyl sulfone compound can be used in the subbing layer. Also, $SiO_2$, $TiO_2$, inorganic fine grains or polymethyl methacrylate copolymer fine grains (0.01 to 10 $\mu$m) may be incorporated therein as a matting agent.

Further, an antistatic agent is preferably used in the present invention. Examples of suitable antistatic agents include carboxylic acids and carboxylic salts, sulfonic acid salt containing polymers, cationic polymers and ionic surfactant compounds.

Most preferred as the antistatic agent are fine grains of at least one crystalline metal oxide selected from among ZnO, $TiO_2$, $SnO_2$, $Al_2O_3$, $In_2O_3$, $SiO_2$, MgO, BaO, $MoO_3$ and $V_2O_5$ having a volume resistivity of 107 Ω·cm or less, preferably 105 Ω·cm or less, and having a grain size of 0.001 to 1.0 μm or a composite oxide thereof (Sb, P, B, In, S, Si, C, etc.) and fine grains of sol form metal oxides or composite oxides thereof.

The content thereof in the lightsensitive material is preferably in the range of 5 to 500 mg/$m^2$, more preferably 10 to 350 mg/$m^2$. The ratio of amount of conductive crystalline oxide or composite oxide thereof to binder is preferably in the range of 1/300 to 100/1, more preferably 1/100 to 100/5.

It is preferred that the lightsensitive material of the present invention have lubricity. The lubricant containing layer is preferably provided on both the lightsensitive layer side and the back side.

Preferred lubricity ranges from 0.25 to 0.01 in terms of dynamic friction coefficient. The measured lubricity is a value obtained by conducting a carriage on a stainless steel ball of 5 mm in diameter at 60 cm/min (25° C., 60% RH). In this evaluation, value of approximately the same level is obtained even when the opposite material is replaced by the lightsensitive layer side.

The lubricant which can be used in the present invention is, for example, a polyorganosiloxane, a higher fatty acid amide, a higher fatty acid metal salt or an ester of higher fatty acid and higher alcohol. Examples of suitable polyorganosiloxanes include polydimethylsiloxane, polydiethylsiloxane, polystyrylmethylsiloxane and polymethylphenylsiloxane. The lubricant is preferably added to the back layer or the outermost layer of the emulsion layer. Especially, polydimethylsiloxane and an ester having a long chain alkyl group are preferred.

A matting agent is preferably used in the lightsensitive material of the present invention. Although the matting agent may be used on the emulsion side or the back side indiscriminately, it is especially preferred that the matting agent be added to the outermost layer of the emulsion side. The matting agent may be soluble in the processing solution or insoluble in the processing solution, and it is preferred to use the soluble and insoluble matting agents in combination. For example, polymethyl methacrylate, poly(methyl methacrylate/methacrylic acid) (9/1 or 5/5 in molar ratio) and polystyrene grains are preferred. The grain size thereof preferably ranges from 0.8 to 10 μm. Narrow grain size istribution thereof is preferred, and it is desired hat at least 90% of the whole number of grains be included in the range of 0.9 to 1.1 times the average grain size. Moreover, for enhancing the mat properties, it is preferred that fine grains of 0.8 μm or less be simultaneously added, which include, for example, fine grains of polymethyl methacrylate (0.2 μm), poly(methyl methacrylate/methacrylic acid) (9/1 in molar ratio, 0.3 μm), polystyrene (0.25 μm) and colloidal silica (0.03 μm).

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A-1-312537 and JP-A-1-312538. The resistance thereof at 25° C. in 25% RH is preferably $10^{12}$Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. No. 4,834,306 and U.S. Pat. No. 5,226,613. The photographic film for use in the present invention may be a generally so termed raw stock having not yet been developed or a developed photographic film. The raw stock and the developed photographic film may be accommodated in the same new patrone or in different patrones.

The color photographic lightsensitive material of the present invention is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Utsurundesu (Quick snap) Super Slim produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) rear touching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is preferably Fuji Film Minilabo Champion Super FA-298/FA-278/FA-258/FA-238 or Fuji Film Digital Labo System Frontier. Film processor of the Minilabo Champion is, for example, FP922AL/FP562B/FP562B, AL/FP362B/FP3622B, AL, and recommended processing chemical is Fuji Color Just It CN-16L or CN-16Q. Printer processor is, for example, PP3008AR/PP3008A/PP1828AR/PP1828A/PP1258AR/PP1258A/PP728AR/PP728A, and recommended processing chemical thereof is Fuji Color Just It CP-47L or CP-40FAII. In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as rear toucher in the rear touching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photography can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in the personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from the personal computer.

Fuji Color Pocket Album AP-5 Pop L, AP-1 Pop L or AP-1 Pop KG or Cartridge File 16 is preferably employed for storing the developed AP system cartridge film.

EXAMPLE

Examples of the present invention will be described below, which, however, in no way limit the scope of the present invention.

Example 1

Demonstration of Embodiment I and Embodiment II (Production of Em-1)

1200 milliliters (hereinafter, milliliter referred to as "mL") of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 5.0 g of KBr was added and heated to 75° C., and the mixture was ripened. After the completion of ripening, 35 g of a gelatin converted to phthalate at a ratio of 97%, the gelatin containing methionine in an amount of 35 $\mu$mol per g and having a molecular weight of 100,000, was added. The pH was adjusted to 5.6. An aqueous solution of KBr and 150 mL of an aqueous solution containing 30 g of $AgNO_3$ were added by the double jet method over a period of 16 min (growth step 1). During this period, the silver potential was maintained at −20 mV against saturated calomel electrode. Further, an aqueous solution containing 110 g of $AgNO_3$ and an aqueous solution of KBr (15 wt. %) containing 3.8 mol % of KI were added by the double jet method over a period of 15 min while increasing the flow rate so that the final flow rate was 1.2 times the initial flow rate (growth step 2). During this period, the silver potential was maintained at −20 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was +20 mv. 2 mg of sodium benzenethiosulfonate was added, and KBr was added to thereby adjust the silver potential to −20 mv. 100 mL of an aqueous solution containing 6.8 g of $AgNO_3$ and 900 mL of an aqueous solution containing 17.1 g of KI were added by the double jet method over a period of 10 min. Immediately after the completion of the addition, 250 mL of an aqueous solution containing 70 g of $AgNO_3$ and 170 mL of an aqueous solution containing 50 g of KBr were added over a period of 20 min. The mixture was washed with water, and 45 g of gelatin was added, adjusting the pH and pAg thereof at 40° C. to 5.8 and 8.7, respectively.

(Preparation of Em-2)

Em-2 was prepared in the same manner as Em-1, except that the disperse gelatin added after water washing (alkali treated bone gelatin wherein the content of components of 280 thousand or more molecular weight was 28%) was replaced by alkali treated bone gelatin wherein the content of components of 280 thousand or more molecular weight was 40% (prepared by a method in which the gelatin crosslinking described in the portion of detailed description was not carried out).

(Preparation of Em-3)

Em-3 was prepared in the same manner as Em-1, except that the amount of KI used in the growth step 2 was changed to 0 mol %, and that the amounts of $AgNO_3$ and KI added by the double jet method after the growth step 2 were changed to 1.0 g and 1.1 g, respectively.

(Preparation of Em-4)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation.

During the period, KBr excess concentration was held constant. 5.0 g of KBr was added and heated to 75° C, and the mixture was ripened. After the completion of ripening, 35 g of a gelatin converted to phthalate at a ratio of 97%, the gelatin containing methionine in an amount of 35 $\mu$mol per g and having a molecular weight of 100,000, was added. The pH was adjusted to 5.6. An aqueous solution of KBr and 150 mL of an aqueous solution containing 30 g of $AgNO_3$ were added by the double jet method over a period of 16 min (growth step 1). During this period, the silver potential was maintained at −20 mV against saturated calomel electrode. Further, an aqueous solution containing 110 g of $AgNO_3$ and an aqueous solution of KBr (15 wt. %) containing 9.9 mol % of KI were added by the double jet method over a period of 15 min while increasing the flow rate so that the final flow rate was 1.2 times the initial flow rate (growth step 2). During this period, the silver potential was maintained at −20 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. 2 mg of sodium benzenethiosulfonate was added, and KBr was added to thereby adjust the silver potential to −20 mV. 250 mL of an aqueous solution containing 76.8 g of $AgNO_3$ and 170 mL of an aqueous solution containing 54.9 g of KBr were added over a period of 20 min. The mixture was washed with water, and 45 g of gelatin was added, adjusting the pH and pAg thereof at 40° C. to 5.8 and 8.7, respectively.

(Preparation of Em-5)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 5.0 g of KBr was added and heated to 75° C., and the mixture was ripened. After the completion of ripening, 15 g of a gelatin converted to trimellitate at a ratio of 98%, the gelatin containing methionine in an amount of 35 $\mu$mol per g and having a molecular weight of 100,000, together with 10 g of a gelatin converted to succinate and 10 g of an oxidized gelatin, were added. The pH was adjusted to 5.6. An aqueous solution of KBr and 150 mL of an aqueous solution containing 30 g of $AgNO_3$ were added by the double jet method over a period of 16 min. During this period, the silver potential was maintained at −30 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, a 0.03 $\mu$m size AgI fine grain emulsion was simultaneously added while conducting a flow rate increase so that the silver iodide content was 3.8%, and the silver potential was maintained at −30 mv. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mv. The temperature was changed to 40° C., and 7.1 g, in terms of KI, of sodium p-iodoacetoamidobenzenesulfonate (compound 1) was added. Further, 64 cc of a 0.8 M aqueous sodium sulfite solution was added. Still further, an aqueous solution of NaOH was added to thereby increase the pH to 9.0, and held undisturbed for 4 min so that iodide ions were rapidly formed. The pH was returned to 5.5 and the temperature to 75° C., and 2 mg of sodium benzenethiosulfonate was added. Further, 13 g of gelatin was added. After the completion of the addition, an aqueous solution of KBr and 250 mL of an aqueous solution containing 70 g of $AgNO_3$ were added over a period of 20 min while maintaining the potential at 0 mV. The mixture was washed with water, and 45 g of gelatin was added, adjusting the pH and pAg thereof at 40° C. to 5.8 and 8.7, respectively. Thus, Em-5 was obtained.

Compound 1

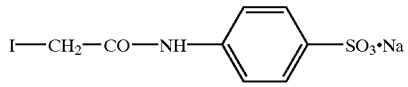

Em-1 to Em-5 were subjected to an observation through transmission electron microscope at liquid nitrogen temperature. In all the emulsions except Em-4, dislocation lines were observed at a high density at fringe portions of the grains. It was apparent that the number of dislocation lines per grain was at least 20. Further, the average aspect ratio, tabular grain occupancy in emulsion and average iodine content of Em-1 to Em-5 were as shown in Table 1. The concentrations of calcium, magnesium and strontium were measured by ICP emission spectral analytical method to relveal that the concentrations of each of Em-1 to Em-5 were 18 ppm, 2 ppm, and 0 ppm, respectively.

TABLE 1

| Emulsion | Av. aspect ratio | Ratio of occupancy by tabular grains (%) | Av. iodine content (mol %) | Ratio of Se/Au | Added metal ion | Component of 280 thousand or more mol. wt. in disperse gelatin (%) | Sensitivity | RMS | |
|---|---|---|---|---|---|---|---|---|---|
| Em-1-A | 9.0 | 90 | 4.3 | 0.7 | none | 28 | 100 | 100 | Comp. Ex. |
| Em-1-B | 9.0 | 90 | 4.3 | 1.2 | none | 28 | 123 | 104 | Comp. Ex. |
| Em-1-C | 9.0 | 90 | 4.3 | 0.7 | Ca | 28 | 100 | 80 | Comp. Ex. |
| Em-1-D | 9.0 | 90 | 4.3 | 1.2 | Ca | 28 | 123 | 81 | Invention (corresponding to Embodiments I & II) |
| Em-1-DA | 9.0 | 90 | 4.3 | 1.2 | Ca | 28 | 102 | 80 | Comp. Ex. |
| Em-1-DB | 9.0 | 90 | 4.3 | 1.2 | Ca | 28 | 105 | 80 | Comp. Ex. |
| Em-1-DC | 9.0 | 90 | 4.3 | 1.2 | Ca | 28 | 110 | 80 | Comp. Ex. |
| Em-1-DD | 9.0 | 90 | 4.3 | 1.2 | Ca | 28 | 102 | 90 | Comp. Ex. |
| Em-1-DE | 9.0 | 90 | 4.3 | 1.2 | Ca | 28 | 123 | 81 | Invention (corresponding to Embodiments I & II) |
| Em-1-E | 9.0 | 90 | 4.3 | 1.2 | Mg | 28 | 122 | 84 | Invention (corresponding to Embodiments I & II) |
| Em-1-F | 9.0 | 90 | 4.3 | 1.2 | Sr | 28 | 122 | 82 | Invention (corresponding to Embodiments I & II) |
| Em-1-G | 9.0 | 90 | 4.3 | 1.2 | Zn | 28 | 120 | 102 | Comp. Ex. |
| Em-2-A | 9.0 | 90 | 4.3 | 1.2 | none | 40 | 123 | 82 | Invention (corresponding to |

TABLE 1-continued

| Emulsion | Av. aspect ratio | Ratio of occupancy by tabular grains (%) | Av. iodine content (mol %) | Ratio of Se/Au | Added metal ion | Component of 280 thousand or more mol. wt. in disperse gelatin (%) | Sensitivity | RMS | |
|---|---|---|---|---|---|---|---|---|---|
| | | | | | | | | | Embodiments I & II) |
| Em-3-A | 9.0 | 90 | 0.5 | 1.2 | Ca | 28 | 120 | 98 | Comp. Ex. |
| Em-4-A | 9.0 | 90 | 4.3 | 1.2 | Ca | 28 | 88 | 80 | Comp. Ex. |
| Em-5-A | 16 | 90 | 4.3 | 1.2 | Ca | 28 | 142 | 84 | Invention (corresponding to Embodiments I & II) |
| Em-5-B | 16 | 90 | 4.3 | 2.4 | Ca | 28 | 158 | 84 | Invention (corresponding to Embodiments I & II) |
| Em-5-C | 16 | 90 | 4.3 | 19.0 | Ca | 28 | 92 | 84 | Comp. Ex. |

Chemical Sensitization and Spectral Sensitization

Preparation of Solid Fine Dispersion of Sensitizing Dye

Solid fine dispersions of sensitizing dyes 1 to 3 were prepared in the following manner. Preparation conditions are given in Table 2. An inorganic salt was dissolved in iox-exchanged water, and a sensitizing dye was added thereto. The mixture was dispersed at 60° C. for 20 min while revolving a dissolver blade at 2000 rpm. Thus, there were obtained solid fine dispersions of sensitizing dyes 1 to 3.

TABLE 2

| Sensitizing dye | Amount of sensitizing dye (pts. wt.) | $NaNO_3/Na_2SO_4$ (pts. wt./pts. wt.) | water (pts. wt.) | Dispersion time (min) | Dispersion temp. (° C.) |
|---|---|---|---|---|---|
| 1 | 3 | 0.8/3.2 | 43 | 20 | 60 |
| 2 | 4 | 0.6/2.4 | 42.8 | 20 | 60 |
| 3 | 0.12 | | | | |

(Preparation of Em-1-A and Em-1-B)

Em-1 was divided into two parts, and both heated to 56° C. Sensitizing dyes 1, 2 and 3 were added at a molar ratio of 58:36:1 in the form of solid fine dispersion. Thereafter, potassium thiocyanate, chloroauric acid, sodium thiosulfate and N,N-dimethylselenourea were added to thereby effect optimum chemical sensitization. Chloroauric acid and N,N-dimethylselenourea were added in the amounts listed in Table 3. Compound 2 was added at the completion of chemical sensitization, thereby obtaining Em-1-A and Em-1-B.

The amount of selenium contained in grains was measured in the following manner. Coating on a support was swollen with water, and the silver halide emulsion was peeled from the support by enzymatic decomposition. A 0.1 N KBr solution was added, and the selenium compound adsorbed on silver halide was fully washed away with such a care that fixing of the silver halide could be avoided. Thereafter, centrifugal separation was performed, and the amount of selenium in separated grains was determined. Subsequently, the amount of gold contained in grains was measured in the following manner. Coating on a support was swollen with water, and the silver halide emulsion was peeled from the support by enzymatic decomposition. Separation into grains and a supernatant was performed by centrifugation, and the amount of gold in grains was determined. As a result of the measurement of the amounts of selenium and gold contained in grains, it was found that the Se/Au ratios of Em-1-A and Em-1-B 5 were 0.7 and 1.2, respectively.

TABLE 3

| Emulsion | Chloroauric acid (mol/mol Ag) | Se sensitizer (mol/mol Ag) |
|---|---|---|
| Em-1-A | $2.89 \times 10^{-6}$ | $1.45 \times 10^{-6}$ |
| Em-1-B | $2.89 \times 10^{-6}$ | $2.50 \times 10^{-6}$ |
| Em-1-C | $2.89 \times 10^{-6}$ | $1.45 \times 10^{-6}$ |

TABLE 3-continued

| | | |
|---|---|---|
| Em-1-D | $2.89 \times 10^{-6}$ | $2.50 \times 10^{-6}$ |
| Em-1-E | $2.89 \times 10^{-6}$ | $2.50 \times 10^{-6}$ |
| Em-1-F | $2.89 \times 10^{-6}$ | $2.50 \times 10^{-6}$ |
| Em-1-G | $2.89 \times 10^{-6}$ | $2.50 \times 10^{-6}$ |
| Em-2-A | $2.89 \times 10^{-6}$ | $2.50 \times 10^{-6}$ |
| Em-3-A | $2.89 \times 10^{-6}$ | $2.50 \times 10^{-6}$ |
| Em-4-A | $2.89 \times 10^{-6}$ | $2.50 \times 10^{-6}$ |
| Em-5-A | $3.95 \times 10^{-6}$ | $3.29 \times 10^{-6}$ |
| Em-5-B | $3.95 \times 10^{-6}$ | $6.58 \times 10^{-6}$ |
| Em-5-C | $3.95 \times 10^{-6}$ | $5.50 \times 10^{-5}$ |

Sensitizing dye 1

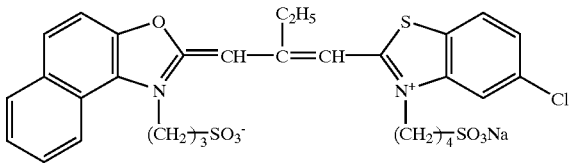

Sensitizing dye 2

TABLE 3-continued

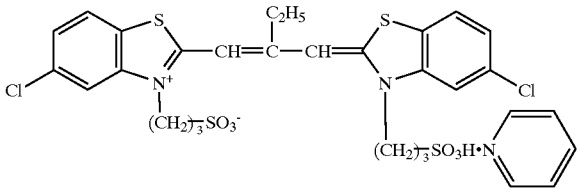

Sensitizing dye 3

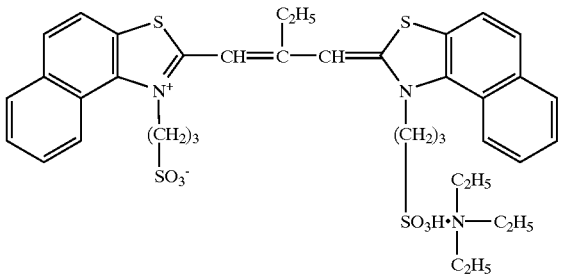

Compound 2=compound example II-1-1.

(Preparation of Em-1-C and Em-1-D)

Em-1-C was prepared in the same manner as Em-1-A, except that the solid fine dispersion of the sensitizing dyes were added, and, when the sensitizing dyes were adsorbed to the grains in an amounts of 90% of the amounts of adsorption thereof at equilibrium, 180 ppm, based on emulsion, of calcium nitrate was added, and then chemical sensitization was performed. Em-1-D was prepared in the same manner as Em-1-C, except that the amounts of chloroauric acid and N,N-dimethylselenourea were changed.

The amounts of selenium and gold contained in grains were measured by the atomic absorption method. As a result, it was found that the intragranular Se/Au ratios of Em-1-C and Em-1-D were 0.7 and 1.2, respectively.

(Preparation of Em-1-DA, Em-1-DB and Em-1-DC)

Em-1-DA was prepared in the same manner as in Em-1-D, except that calcium nitrate was added when the amount of the adsorbed sensitizing dyes reached to 50% of the amount of the adsorption thereof at equilibrium. Em-1-DB was prepared in the same manner as in Em-1-D, except that calcium nitrate was added when the chemical sensitization was terminated. Em-1-DC was prepared in the same manner as in Em-1-D, except that calcium nitrate was added before the spectral sensitizing dyes were added.

(Preparation of Em-1-DD, Em-1-DE and Em-1-DF)

Em-1-DD, Em-1-DE and Em-1-DF were prepared in the same manner as Em-1-D, except that calcium nitrate was added so that calcium concentration became 50, 1800, and 3000 ppm, respectively.

(Preparation of Em-1-E, Em-1-F and Em-1-G)

Em-1-E, Em-1-F and Em-1-G were prepared in the same manner as Em-1-D, except that magnesium nitrate, strontium nitrate and zinc nitrate were added, respectively, in place of the addition of calcium nitrate.

(Preparation of Em-2-A)

Em-2-A was prepared by subjecting the Em-2 to the same spectral sensitization and chemical sensitization as in Em-1-B. The ratio of Se/Au contained in grains was measured by the atomic absorption method. It was 1.2.

(Preparation of Em-3-A and Em-4-A)

Em-3-A and Em-4-A were prepared by subjecting the Em-3 and Em-4, respectively, to the same spectral sensitization and chemical sensitization as in Em-1-D. The ratios of Se/Au contained in grains were measured by the atomic absorption method. Both the emulsions exhibited the same value, 1.2.

(Preparation of Em-5-A, Em-5-B and Em-5-C)

Em-5-A, Em-5-B and Em-5-C were prepared by subjecting the Em-5 to the same spectral sensitization and chemical sensitization as in Em-1-D, except for the amounts of chloroauric acid and Se sensitizer were set as listed in Table 3. The ratios of Se/Au were measured by the atomic absorption method, which were 1.2, 2.4 and 19.0, respectively.

Samples were prepared by coating cellulose triacetate film supports each having a subbing layer with the emulsions Em-1-A to Em-5-C having undergone the above chemical sensitization, with protective layers superimposed, under the coating conditions given in the following Table 4. With regard to Em-1-DF, evaluation of photographic properties could not be done, because the surface condition of the coated sample was poor, due to a large amount of calcium.

TABLE 4

| Emulsion coating condition | |
|---|---|
| (1) Emulsion layer | |
| emulsion . . . various emulsions | |
| (Ag $2.1 \times 10^{-2}$ mol/m$^2$) | |
| coupler ($1.5 \times 10^{-3}$ mol/m$^2$) | |

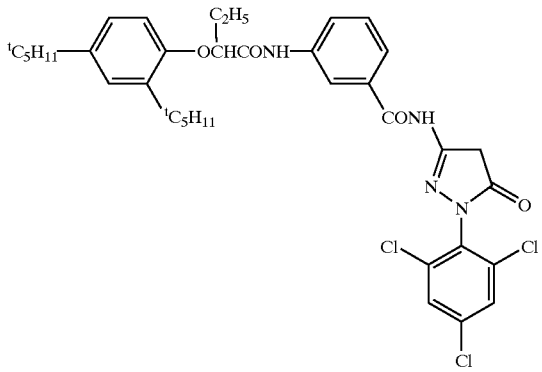

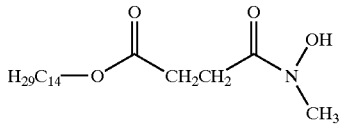

($1.1 \times 10^{-4}$ mol/m$^2$)

| | |
|---|---|
| tricresyl phosphate | (1.10 g/m$^2$) |
| gelatin | (2.30 g/m$^2$) |
| (2) Protective layer | |
| sodium salt of 2,4-dichloro-6-hydroxy-s-triazine | (0.08 g/m$^2$) |
| gelatin | (1.80 g/m$^2$) |

These samples were allowed to stand still at 40° C. in a relative humidity of 70% for 14 hr. Thereafter, the samples were exposed through gelatin filter SC-50 produced by Fuji Photo Film Co., Ltd. and continuous wedge for 1/100 sec.

The samples were processed with the use of Negative Processor FP-350 manufactured by Fuji Photo Film Co., Ltd. in accordance with the following method (until the cumulative amount of replenisher became thrice the tank volume of mother liquor).

(Processing Steps)

| Step | Time | Temp. ° C. | Replenishment rate |
|---|---|---|---|
| Color development | 3 min 15 sec | 38 | 45 mL |
| Bleaching | 1 min 00 sec | 38 | 20 mL whole of bleaching soln. overflow flows into bleach-fix tank |
| Bleach-fix | 3 min 15 sec | 38 | 30 mL |
| Water washing (1) | 40 sec | 35 | countercurrent piping from (2) to (1) |
| Water washing (2) | 1 min 00 sec | 35 | 30 mL |
| Stabilization | 40 sec | 38 | 20 mL |
| Drying | 1 min 15 sec | 55 | |

The replenishment rate is represented by a value per 1.1 m of a 35-mm wide sample (equivalent to one 24 Ex. film).

The composition of each processing solution was as follows.

| (Color developer) | Tank soln. (g) | Replenisher (g) |
|---|---|---|
| Diethylenetriamine pentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]-2-methylaniline sulfate | 4.5 | 5.5 |
| Water | q.s. ad 1.0 L | |
| pH | 10.05 | 10.10 |

This pH was adjusted by the use of sulfuric acid and potassium hydroxide.

(Bleaching Soln.) Common to Tank Soln. and Replenisher (Unit: g)

| | |
|---|---|
| Fe(III) ammonium ethylenediaminetetraacetate dihydrate | 20.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2 \cdot 2HCl$ | 0.005 mol |
| Aq. ammonia (27%) | 15.0 mL |
| Water | q.s. ad 1.0 L |
| pH | 6.3 |

This pH was adjusted by the use of aqueous ammonia and nitric acid.

| (Bleach-fix) | Tank soln. (g) | Replenisher (g) |
|---|---|---|
| Fe(III) ammonium ethylenediaminetetraacetate dihydrate | 50.0 | — |
| Disodium ethylenediaminetetraacetate | 5.0 | 2.0 |
| Sodium sulfite | 12.0 | 20.0 |
| Aq. soln. of ammonium thiosulfate (700 g/L) | 240.0 mL | 400.0 mL |
| Aq. ammonia (27%) | 6.0 mL | — |
| Water | q.s. ad 1.0 L | |
| pH | 7.2 | 7.3 |

This pH was adjusted by the use of aqueous ammnia and acetic acid.

(Washing Water): Common to Tank Solution and Replenisher.

Tap water was passed through a mixed-bed column filled with an H type strongly acidic cation exchange resin (Amberlite IR-120B: available from Rohm & Haas Co.) and an OH type anion exchange resin (Amberlite IR-400) to adjust the concentrations of calcium and magnesium ions to be 3 mg/L or less. Subsequently, 20 mg/L of sodium dichloroisocyanurate and 0.15 g/L of sodium sulfate were added. The pH of the solution ranged from 6.5 to 7.5.

(Stabilizer): Common to Tank Solution and Replenisher (Unit: g)

| | |
|---|---|
| Sodium p-toluenesulfinate | 0.03 |
| Polyoxyethylene p-monononylphenyl ether (average polymerization degree 10) | 0.2 |
| Disodium ethylenediaminetetraacetate | 0.05 |
| 1,2,4-triazole | 1.3 |
| 1,4-bis(1,2,4-triazol-1-ylmethyl)-piperazine | 0.75 |
| Water | q.s. ad 1.0 L |
| pH | 8.5 |

The density of each of the processed samples was measured with the use of a green filter. The sensitivity was expressed by the relative value of inverse number of exposure required for producing a density of fog density plus 0.2. The RMS granularity was determined by performing uniform exposure with a light quantity capable of realizing a density of 0.2, the above development processing and measuring in accordance with the method described on page 619 of "The Theory of The Photographic Process" published by Macmillan. The obtained results are listed in Table 1 above. Through all the Examples, the sensitivity and RMS granularity of Em-1-A were made standard.

It is apparent from Table 1 that a high sensitivity and a desirable granularity can be accomplished when the addition timing and amount of calcium are within the specified ranges, or use is made of a disperse gelatin which contains components of 280 thousand or more, molecular weight in an amount of 30% or more and when the ratio of selenium/gold in grains is at least 0.8 or the amount of selenium sensitizer exceeds $2.5\times10^{-6}$ mol/molAg. Moreover, it is seen that desirable granularity can be obtained by the addition of potassium nitrate, magnesium nitrate and strontium nitrate but the effect of the present invention cannot be exerted by the addition of zinc nitrate.

Thus, the present invention accomplishes enhancement of the sensitivity and granularity of tabular grains.

Example 2

Demonstration of Embodiment III (Preparation of Em-6)

Em-6 was prepared in the same manner as Em-1 of Example 1, except that, in the nucleation thereof, the aqueous solution was replaced by an aqueous solution containing 3.0 g of gelatin of 15,000 molecular weight and 2.0 g of KBr and further the growth potential was lowered so as to cause the average aspect ratio to become approximately equal to that of Em-1.

(Preparation of Em-7)

Em-7 was prepared in the same manner as Em-1 of Example 1, except that, in the nucleation thereof, the aqueous solution was replaced by an aqueous solution containing 9.0 g of gelatin of 15,000 molecular weight and 5.0 g of KBr and further the growth potential was lowered so as to cause the average aspect ratio to become approximately equal to that of Em-1.

The twin face spacings of Em-1, Em-6 and Em-7 were measured, which were 0.015, 0.0165 and 0.018$\mu$, respectively.

(Preparation of Em-6-A and Em-7-A)

Em-6-A and Em-7-A were prepared by subjecting the Em-6 and Em-7, respectively, to the same chemical sensitization and spectral sensitization as in Em-1-D of Example 1.

The photographic performance was evaluated in the same manner as in Example 1. The evaluation of granularity was conducted in the same manner as in Example 1, except that uniform exposure was performed with a light quantity capable of realizing a density of fog+2.0.

TABLE 5

| Emulsion | Twin face spacing ($\mu$m) | sensitivity | RMS | |
|---|---|---|---|---|
| Em-1-D | 0.015 | 123 | 81 | Invention (corresponding to Embodiment III) |
| Em-6-A | 0.0165 | 119 | 83 | Invention (corresponding to Embodiment III) |
| Em-7-A | 0.018 | 100 | 85 | Comp. Ex. (not corresponding to Embodiment III) |

It is apparent from Table 5 that the emulsion of 0.015 or 0.0165 $\mu$m twin face spacing is superior to the emulsion of 0.018 $\mu$m twin face spacing in the sensitivity and granularity.

Example 3

Demonstration of Embodiment IV (Preparation of Em-8)

1200 mL of an aqueous solution containing 1.0 g of a low-molecular-weight gelatin whose molecular weight was 15,000 and 1.0 g of KBr was vigorously agitated while maintaining the temperature at 35° C. 30 mL of an aqueous solution containing 1.9 g of $AgNO_3$ and 30 mL of an aqueous solution containing 1.5 g of KBr and 0.7 g of a low-molecular-weight gelatin whose molecular weight was 15,000 were added by the double jet method over a period of 30 sec to thereby effect a nucleation. During the period, KBr excess concentration was held constant. 5.0 g of KBr was added and heated to 75° C., and the mixture was ripened. After the completion of ripening, 15 g of a gelatin converted to trimellitate at a ratio of 98%, the gelatin containing methionine in an amount of 35 $\mu$mol per g and having a molecular weight of 100,000, together with 10 g of a gelatin converted to succinate and 10 g of an oxidized gelatin, were added. The pH was adjusted to 5.6. An aqueous solution of KBr and 150 mL of an aqueous solution containing 30 g of $AgNO_3$ were added by the double jet method over a period of 16 min. During this period, the silver potential was maintained at −30 mV against saturated calomel electrode. Further, an aqueous solution containing 110 g of $AgNO_3$ and an aqueous solution of KBr were added by the double jet method over a period of 15 min while increasing the flow rate so that the final flow rate was 1.2 times the initial flow rate. During this period, the aforementioned AgI fine grain emulsion was simultaneously added while conducting a flow rate increase so that the silver iodide content was 3.8%, and the silver potential was maintained at −30 mV. Still further, an aqueous solution of KBr and 132 mL of an aqueous solution containing 35 g of $AgNO_3$ were added by the double jet method over a period of 7 min. The addition of the aqueous solution of KBr was regulated so that the potential at the completion of the addition was −20 mV. Thereafter, KBr was added to thereby adjust the potential to −60 mV, and 2 mg of sodium benzenethiosulfonate and 7 g of gelatin were added. After the completion of the addition, while continuously adding 7.1 g, in terms of KI, of AgI fine grain emulsion of 0.008 $\mu$m grain size (prepared by, just prior to addition, mixing together an aqueous solution of a low-molecular-weight gelatin whose molecular weight was 15,000, an aqueous solution of $AgNO_3$ and an aqueous solution of KI in a separate chamber furnished with a magnetic coupling induction type agitator as described in JP-A-10-43570, the disclosure of which is herein incorporated by reference), an aqueous solution of KBr and 250 mL of an aqueous solution containing 70 g of $AgNO_3$ were added over a period of 20 min. The mixture was washed with water, and 45 g of gelatin was added, adjusting the pH and pAg thereof at 40° C. to 5.8 and 8.7, respectively. Thus, Em-8 was obtained.

(Preparation of Em-8-A)

Em-8-A was prepared by subjecting the Em-8 to the same chemical sensitization and spectral sensitization as in Em-5-B of Example 1.

The photographic performance and granularity were evaluated in the same manner as in Example 2.

TABLE 6

| Emulsion | Sensitivity | RMS | |
|---|---|---|---|
| Em-5-B | 158 | 84 | Invention (not corresponding to Embodiment IV) |
| Em-8-A | 165 | 81 | Invention (corresponding to Embodiment IV) |

It is apparent from Table 6 that Em-8-A is superior to Em-5-B in the sensitivity and granularity.

Example 4

Demonstration of Embodiment V

Em-8-B was prepared in the same manner as Em-8-A of Example 3, except that 0.5 mol %, based on host grains, of a fine grain emulsion of 0.05 $\mu$m size pure AgBr was added at the time of initiation of spectral sensitization and chemical sensitization. The photographic performance and granularity were evaluated in the same manner as in Example 1. Further, exposed samples were stored at 50° C. in a relative humidity of 60% for 7 days in order to evaluate the aging deterioration (storage life) thereof.

TABLE 7

| Emulsion | Addn. of fine-grain emulsion | Sensitivity | RMS | Pre-aging/ post-aging Δ fog | |
|---|---|---|---|---|---|
| Em-8-A | no | 165 | 81 | 0.15 | Invention (not corresponding to Embodiment V) |
| Em-8-B | yes | 169 | 83 | 0.08 | Invention (corresponding to Embodiment V) |

It is apparent from Table 7 that the emulsion in which pure AgBr fine grains were incorporated at the initiation of spectral sensitization and chemical sensitization is similar in sensitivity and granularity, but is superior in storage life, to the emulsion in which pure AgBr fine grains were not incorporated.

Example 5

Demonstration of Embodiment VI

Em-9 and Em-10 were prepared in the same manner as Em-8 of Example 3, except that yellow prussiate of potash and potassium hexacyanoruthenate, respectively, were added in an amount of $1.0\times10^{-5}$ mol per mol of silver at the final addition during grain formation. Further, Em-9 and Em-10 were subjected to the same chemical sensitization and spectral sensitization as Em-8-B, thereby obtaining Em-9-A and Em-10-A, respectively. The photographic performance, granularity and storage life were evaluated in the same manner as in the above Example.

TABLE 8

| Emulsion | Metal doped | Sensitivity | RMS | Pre-aging/ post-aging Δ fog | |
|---|---|---|---|---|---|
| Em-8-B | none | 169 | 83 | 0.08 | Invention (not corresponding to Embodiment VI) |
| Em-9-A | yellow prussiate of potash | 178 | 83 | 0.05 | Invention (corresponding to Embodiment VI) |
| Em-10-A | Ru | 176 | 83 | 0.05 | Invention (corresponding to Embodiment VI) |

It is apparent from Table 8 that the addition of yellow prussiate of potash and potassium hexacyanoruthenate enables exhibiting excellent sensitivity and granularity and enables inhibiting a fog increase during storage.

Example 6

Demonstration of Embodiment VIII (2)-1, with a Use of Single Layer Coating System The Em-1 used in Example 1 was subjected to similar chemical sensitization, thereby obtaining Em-1-D once more. Mercapto compounds set forth in Table 9 were added in place of the compound 2 at the time of terminating the chemical sensitization of Em-1-D, thereby obtaining Em-1-DG to Em-1-DN.

The photographic performance of prepared emulsions were evaluated in the same manner as in Example 1. Further, for evaluating the storage life, unexposed samples were stored at 50° C. in a relative humidity of 60% for two weeks. These samples together with samples stored at 5° C. for two weeks were subjected to the same exposure, development processing and density measurement as in Example 1. The difference between the fog value of sample stored at 50° C. and the fog value of sample stored at 5° C. (Δfog) was determined. The results are given in the following Table 9.

TABLE 9

| No. | Sample | Compd. | Addn. amt. (mol/mol Ag) | Rel. sensitivity | RMS | Δ fog | Relation with invention |
|---|---|---|---|---|---|---|---|
| 1 | Em-1-D | Compd. 2 (=II-1-1) | $2.6\times10^{-4}$ | 100 | 100 | 0.17 | Invention (not corresponding to Embodiment VIII) |
| 2 | Em-1-DG | II-1-2 | $2.1\times10^{-4}$ | 92 | 98 | 0.12 | Invention |
| | | STO-A | $0.5\times10^{-4}$ | | | | (not corresponding to Embodiment VIII) |
| 3 | Em-1-DH | II-1-1 | $2.1\times10^{-4}$ | 100 | 101 | 0.12 | Invention |
| | | II-2-1 | $0.5\times10^{-4}$ | | | | (corresponding to Embodiment VIII) |
| 4 | Em-1-DI | II-1-2 | $2.1\times10^{-4}$ | 100 | 100 | 0.12 | Invention |
| | | II-2-1 | $0.5\times10^{-4}$ | | | | (corresponding to Embodiment VIII) |
| 5 | Em-1-DJ | II-1-4 | $2.1\times10^{-4}$ | 100 | 99 | 0.12 | Invention |
| | | II-2-1 | $0.5\times10^{-4}$ | | | | (corresponding to Embodiment VIII) |
| 6 | Em-1-DK | II-1-7 | $2.1\times10^{-4}$ | 99 | 99 | 0.13 | Invention |
| | | II-2-1 | $0.5\times10^{-4}$ | | | | (corresponding to Embodiment VIII) |
| 7 | Em-1-DL | II-1-1 | $2.1\times10^{-4}$ | 98 | 100 | 0.13 | Invention |
| | | II-2-2 | $0.5\times10^{-4}$ | | | | (corresponding to Embodiment VIII) |
| 8 | Em-1-DM | II-1-1 | $2.1\times10^{-4}$ | 99 | 99 | 0.13 | Invention |
| | | II-2-3 | $0.5\times10^{-4}$ | | | | (corresponding to Embodiment VIII) |
| 9 | Em-1-DN | II-1-1 | $2.1\times10^{-4}$ | 100 | 102 | 0.13 | Invention |
| | | II-2-4 | $0.5\times10^{-4}$ | | | | (corresponding to Embodiment VIII) |

Comparative compound STO-A (compound described in JP-A-4-16838), the disclosure of which is herein incorporated by reference:

Comparative compound STO-A

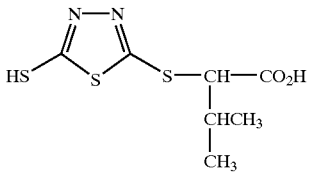

As apparent from Table 9, the joint use of two compounds according to the present invention was superior to conventional compound 2 (compound example II-1-1) in the inhibition of fog increase during storage. It was found that any sensitivity drop and RMS granularity deterioration did not occur during the storage.

On the other hand, it has become apparent that the conventional joint use of compound example II-1-1 described in JP-A-4-16838 and comparative compound STO-A invites a sensitivity drop when used in high-speed emulsions such as that of the present invention.

Moreover, Em-5-BA to Em-5-BH were obtained by using Em-5 in place of Em-1 and subjecting to the same after-ripening as Em-5-B, except that only mercapto compounds added at the final stage of the after-ripening was changed as in the above experiment. Likewise, with the use of Em-8, Em-8-AA to Em-8-AH were obtained through the same after-ripening as Em-8-A, and Em-8-BA to Em-8-BH were obtained through the same after-ripening as Em-8-B. Similarly, with the use of Em-9, Em-9-AA to Em-9-AH were obtained through the same after-ripening as Em-9-A. With respect to these, the same experiment as Em-1-D and Em-1-DG to Em-1-DN mentioned above was carried out. Thus, the same results as Em-1-D and Em-1-DG to Em-1-DN were obtained.

Example 7

Silver halide emulsions Em-A to Em-D and Em-F to Em-P were prepared by the following process.

(Production of Em-A)

42.2 L of an aqueous solution containing 31.7 g of a low-molecular-weight gelatin of 15,000 molecular weight converted to phthalate at a ratio of 97% and 31.7 g of KBr was vigorously agitated while maintaining the temperature at 35° C. 1583 mL of an aqueous solution containing 316.7 g of $AgNO_3$ and 1583 mL of an aqueous solution containing 221.5 g of KBr and 52.7 g of a low-molecular-weight gelatin whose molecular weight was 15,000 were added by the double jet method over a period of 1 min. Immediately after the completion of the addition, 52.8 g of KBr was added, 2485 mL of an aqueous solution containing 398.2 g of $AgNO_3$ and 2581 mL of an aqueous solution containing 291.1 g of KBr were added by the double jet method over a period of 2 min. Immediately after the completion of the addition, 44.8 of KBr was added and heated to 40° C., and the mixture was ripened. After the completion of the ripening, 923 g of a gelatin of 100,000 molecular weight converted to phthalate at a ratio of 97% and 79.2 g of KBr were added, and an aqueous solution of KBr and 15,947 mL of an aqueous solution containing 5103 g of $AgNO_3$ were added by the double jet method over a period of 10 min while increasing the flow rate so that the final flow rate was 1.4 times the initial flow rate. During this period, the silver potential was maintained at −60 mV against saturated calomel electrode. The mixture was washed with water, and gelatin was added, effecting adjustments to a pH of 5.7, a pAg of 8.8, and a gelatin weight to 64.1 g and weight of the emulsion, in terms of silver, to 131.8 g per kg of emulsion. Thus, a seed emulsion was obtained. 1211 mL of an aqueous solution containing 46 g of a gelatin converted to phthalate at a ratio of 97% and 1.7 g of KBr was vigorously agitated while maintaining the temperature at 75° C. 9.9 g of the above seed emulsion and then 0.3 g of modified silicon oil (L7602, produced by Nippon Unicar Company, Limited) were added thereto. $H_2SO_4$ was added to thereby adjust the pH to 5.5, and 67.6 mL of an aqueous solution containing 7.0 g of $AgNO_3$ and an aqueous solution of KBr were added by the double jet method over a period of 6 min while increasing the flow rate so that the final flow rate was 5.1 times the initial flow rate. During this period, the silver potential was maintained at −20 mV against saturated calomel electrode. 2 mg of sodium benzenethiosulfonate and 2 mg of thiourea dioxide were added, and 328 mL of an aqueous solution containing 105.6 g of $AgNO_3$ and an aqueous solution of KBr were added by the double jet method over a period of 56 min while increasing the flow rate so that the final flow rate was 3.7 times the initial flow rate. During this period, a AgI fine grain emulsion of 0.037 $\mu$m grain size was simultaneously added while conducting a flow rate increase so that the silver iodide content was 27 mol %, and the silver potential was maintained at −50 mV against saturated calomel electrode. Still further, an aqueous solution of KBr and 121.3 mL of an aqueous solution containing 45.6 g of $AgNO_3$ were added by the double jet method over a period of 22 min. During this period, the silver potential was maintained at +20 mV against saturated calomel electrode. The mixture was heated to 82° C., and KBr was added to thereby adjust the silver potential to −80 mv. Thereafter, the above AgI fine grain emulsion was added in an amount, in terms of the weight of KI, of 6.33 g. Immediately after the completion of the addition, 206.2 mL of an aqueous solution containing 66.4 g of $AgNO_3$ was added over a period of 16 min. For 5 min in the initial stage of addition, the silver potential was maintained at −80 mV by the use of an aqueous solution of KBr. The mixture was washed with water, and gelatin was added, adjusting the pH and pAg thereof at 40° C. to 5.8 and 8.7, respectively. Compounds 3 and 4 were added, and the mixture was heated to 60° C. Sensitizing dyes 4 and 5 were added in the form of a solid fine dispersion, and potassium thiocyanate, chloroauric acid, sodium thiosulfate and N,N-dimethylselenourea were added to thereby effect optimum chemical sensitization. At the completion of chemical sensitization, compound 5 and compound 6 were added. The terminology "optimum chemical sensitization" used herein means that the addition amount of sensitizing dye or each compound has been selected so as to fall within the range of $10^{-1}$ to $10^{-8}$ mol per mol of silver halide.

Compound 3

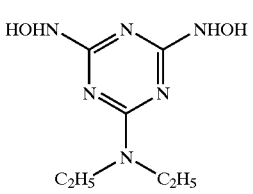

Compound 4

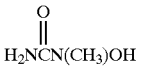

-continued

Sensitizing dye 4

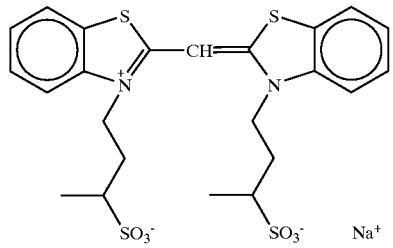

Sensitizing dye 5

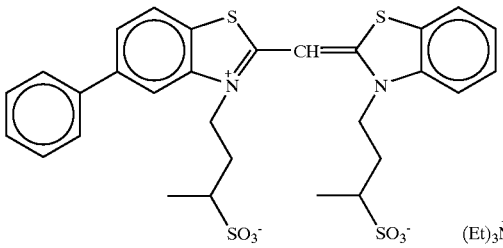

Compound 5

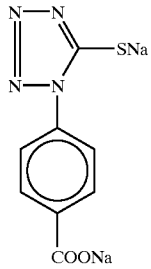

Compound 6

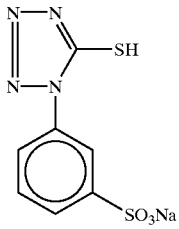

(Production of Em-B)

1192 mL of an aqueous solution containing 0.96 g of a low-molecular-weight gelatin and 0.9 g of KBr was vigorously agitated while maintaining the temperature at 40° C. 37.5 mL of an aqueous solution containing 1.49 g of $AgNO_3$ and 37.5 mL of an aqueous solution containing 1.05 g of KBr were added by the double jet method over a period of 30 sec. 1.2 g of KBr was added and heated to 75° C., and the mixture was ripened. After the completion of the ripening, 35 g of a gelatin of 100,000 molecular weight converted to trimellitate by chemically modifying amino groups thereof with trimellitic acid was added, and the pH was adjusted to 7.6 mg of thiourea dioxide was added. An aqueous solution of KBr and 116 mL of an aqueous solution containing 29 g of $AgNO_3$ were added by the double jet method while increasing the flow rate so that the final flow rate was 3 times the initial flow rate. During this period, the silver potential was maintained at −20 mV against saturated calomel electrode. An aqueous solution of KBr and 440.6 mL of an aqueous solution containing 110.2 g of $AgNO_3$ were added by the double jet method over a period of 30 min while increasing the flow rate so that the final flow rate was 5.1 times the initial flow rate. During this period, the AgI fine grain emulsion used in the preparation of Em-A was simultaneously added while conducting a flow rate increase so that the silver iodide content was 15.8 mol %, and the silver potential was maintained at 0 mV against saturated calomel electrode. An aqueous solution of KBr and 96.5 mL of an aqueous solution containing 24.1 g of $AgNO_3$ were added by the double jet method over a period of 3 min. During this period, the silver potential was maintained at 0 mV. 26 mg of sodium ethylthiosulfonate was added, and the mixture was cooled to 55° C. An aqueous solution of KBr was added to thereby adjust the silver potential to −90 mV. The above AgI fine grain emulsion was added in an amount, in terms of the weight of KI, of 8.5 g. Immediately after the completion of the addition, 228 mL of an aqueous solution containing 57 g of $AgNO_3$ was added over a period of 5 min. An adjustment was made with an aqueous solution of KBr so that the potential at the completion of the addition became +20 mv. Washing and chemical sensitization were performed in substantially the same manner as Em-A.

(Production of Em-C)

1192 mL of an aqueous solution containing 1.02 g of a gelatin converted to phthalate at a ratio of 97%, the gelatin containing methionine in an amount of 35 $\mu$mol per g and having a molecular weight of 100,000, and 0.9 g of KBr was vigorously agitated while maintaining the temperature at 35° C. 42 mL of an aqueous solution containing 4.47 g of $AgNO_3$ and 42 mL of an aqueous solution containing 3.16 g of KBr were added by the double jet method over a period of 9 sec. 2.6 g of KBr was added and heated to 63° C., and the mixture was ripened. After the completion of the ripening, 41.2 g of a gelatin of 100,000 molecular weight converted to trimellitate, which was used in the preparation of Em-B, and 18.5 g of NaCl were added, and the pH was adjusted to 7.2. 8 mg of dimethylaminoborane was added. An aqueous solution of KBr and 203 mL of an aqueous solution containing 26 g of $AgNO_3$ were added by the double jet method so that the final flow rate was 3.8 times the initial flow rate. During this period, the silver potential was maintained at −30 mV against saturated calomel electrode. An aqueous solution of KBr and 440.6 mL of an aqueous solution containing 110.2 g of $AgNO_3$ were added by the double jet method over a period of 24 min while increasing the flow rate so that the final flow rate was 5.1 times the initial flow rate. During this period, the AgI fine grain emulsion used in the preparation of Em-A was simultaneously added while conducting a flow rate increase so that the silver iodide content was 2.3 mol %, and the silver potential was maintained at −20 mV against saturated calomel electrode. 10.7 mL of a 1N aqueous solution of potassium thiocyanate was added, and an aqueous solution of KBr and 153.5 mL of an aqueous solution containing 24.1 g of $AgNO_3$ were added by the double jet method over a period of 2 min and 30 sec. During this period, the silver potential was maintained at 10 mv. An aqueous solution of KBr was added to thereby adjust the silver potential to −70 mV. The above AgI fine grain emulsion was added in an amount, in terms of the weight of KI, of 6.4 g. Immediately after the completion of the addition, 404 mL of an aqueous solution containing 57 g of $AgNO_3$ was added over a period of 45 min. An adjustment was made with an aqueous solution of KBr so that the potential at the completion of the addition became −30 mV. Washing and chemical sensitization were performed in substantially the same manner as Em-A.

(Production of Em-D)

Em-D was prepared in substantially the same manner as Em-C, except that the addition amount of $AgNO_3$ at the time of nucleation was increased to 2.3-fold and that an adjustment was made with the use of an aqueous solution of KBr so that the potential at the completion of final addition of 404 mL of an aqueous solution containing 57 g of $AgNO_3$ was +90 mV.

(Production of Em-F)

1200 mL of an aqueous solution containing 0.75 g of a low-molecular-weight gelatin of 15,000 molecular weight and 0.9 g of KBr was held at 39° C., had its pH adjusted to 1.8 and was vigorously agitated. An aqueous solution containing 1.85 g of $AgNO_3$ and an aqueous solution of KBr containing 1.5 mol % KI were added by the double jet method over a period of 16 sec. During the period, KBr excess concentration was held constant. The mixture was heated to 54° C. and ripened. After the completion of the ripening, 20 g of a gelatin converted to phthalate at a ratio of 97%, the gelatin containing methionine in an amount of 35 $\mu$mol per g and having a molecular weight of 100,000, was added, and the pH was adjusted to 5.9. 2.9 g of KBr was added. An aqueous solution of KBr and 288 mL of an aqueous solution containing 27.4 g of $AgNO_3$ were added by the double jet method over a period of 53 min. During this period, a AgI fine grain emulsion of 0.03 $\mu$m grain size was simultaneously added so that the silver iodide content was 4.1 mol %, and the silver potential was maintained at −60 mV against saturated calomel electrode. 2.5 g of KBr was added, and an aqueous solution of KBr and an aqueous solution containing 87.7 g of $AgNO_3$ were added by the double jet method over a period of 63 min while increasing the flow rate so that the final flow rate was 1.2 times the initial flow rate. During this period, the above AgI fine grain emulsion was simultaneously added while conducting a flow rate increase so that the silver iodide content was 10.5 mol %, and the silver potential was maintained at −70 mV. An aqueous solution of KBr and 132 mL of an aqueous solution containing 41.8 g of $AgNO_3$ were added by the double jet method over a period of 25 min. The addition of the aqueous solution of KBr was regulated so that the potential at the completion of the addition was +20 mV. The pH was adjusted to 7.3, and 1 mg of thiourea dioxide was added. KBr was added to thereby adjust the silver potential to −70 mV. The above AgI fine grain emulsion was added in an amount, in terms of the weight of KI, of 5.73 g. Immediately after the completion of the addition, 609 mL of an aqueous solution containing 66.4 g of $AgNO_3$ was added over a period of 10 min. For 6 min in the initial stage of the addition, the silver potential was maintained at −70 mV by the use of an aqueous solution of KBr. The mixture was washed with water, and gelatin was added, adjusting the pH and pAg thereof at 40° C. to 6.5 and 8.2, respectively.

Compounds 3 and 4 were added, and the mixture was heated to 56° C. Sensitizing dyes 6, 7 and 8 were added in the form of a solid fine dispersion. Thereafter, per mol of silver halide, potassium thiocyanate, chloroauric acid, sodium thiosulfate and N,N-dimethylselenourea were added to thereby effect optimum chemical sensitization. At the completion of chemical sensitization, compounds 5 and 6 were added.

Sensitizing dye 6

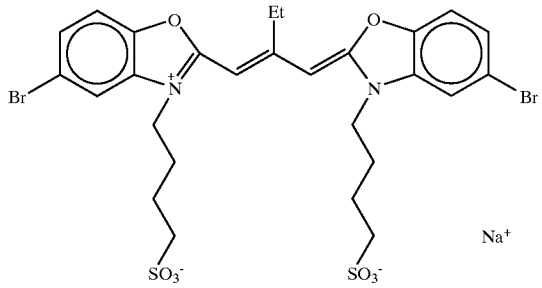

Sensitizing dye 7

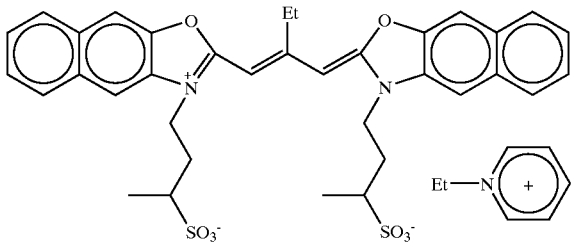

Sensitizing dye 8

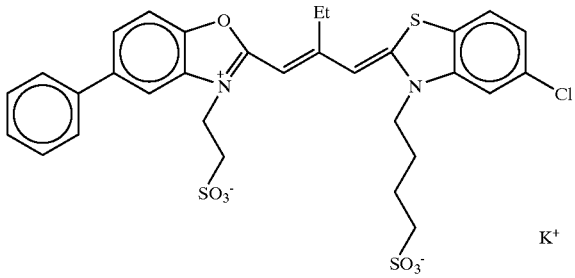

(Production of Em-G)

1200 mL of an aqueous solution containing 0.70 g of a low-molecular-weight gelatin of 15,000 molecular weight, 0.9 g of KBr, 0.175 g of KI and 0.2 g of modified silicone oil mentioned in the preparation of Em-A was held at 33° C., had its pH adjusted to 1.8 and was vigorously agitated. An aqueous solution containing 1.8 g of $AgNO_3$ and an aqueous solution of KBr containing 3.2 mol % KI were added by the double jet method over a period of 9 sec. During the period, KBr excess concentration was held constant. The mixture was heated to 62° C. and ripened. After the completion of the ripening, 27.8 g of a gelatin converted to trimellitate by chemically modifying amino groups thereof with trimellitic acid, the gelatin containing methionine in an amount of 35 $\mu$mol per g and having a molecular weight of 100,000, was added, and the pH was adjusted to 6.3. 2.9 g of KBr was added. An aqueous solution of KBr and 270 mL of an aqueous solution containing 27.58 g of $AgNO_3$ were added by the double jet method over a period of 37 min. During this period, AgI fine grain emulsion of 0.008 $\mu$m grain size (prepared by, just prior to addition, mixing together an aqueous solution of a low-molecular-weight gelatin whose molecular weight was 15,000, an aqueous solution of $AgNO_3$ and an aqueous solution of KI in a separate chamber furnished with a magnetic coupling induction type agitator as described in JP-A-10-43570, the disclosure of which is herein incorporated by refernece) was simultaneously added so that the silver iodide content was 4.1 mol %, and the silver potential was maintained at −60 mV against saturated calomel electrode. 2.6 g of KBr was added, and an aqueous solution of KBr and an aqueous solution containing 87.7 g of $AgNO_3$ were added by the double jet method over a period of 49 min while increasing the flow rate so that the final flow rate was 3.1 times the initial flow rate. During this period, the above AgI fine grain emulsion prepared by mixing just prior to addition was simultaneously added while conducting a flow rate increase so that the silver iodide content was 7.9 mol %, and the silver potential was maintained at −70 mV. 1 mg of thiourea dioxide was added, and an aqueous solution of KBr and 132 mL of an aqueous solution containing 41.8 g of $AgNO_3$ were added by the double jet method over a period of 20 min. The addition of the aqueous solution of KBr was regulated so that the potential at the completion of the addition was +20 mV. The temperature was raised to 78° C., and the pH was adjusted to 9.1. KBr was added to thereby adjust the potential to −60 mV. The AgI fine grain emulsion used in the preparation of Em-A was added in an amount, in terms of the weight of KI, of 5.73 g. Immediately after the completion of the addition, 321 mL of an aqueous solution containing 66.4 g of $AgNO_3$ was added over a period of 4 min. For 2 min in the initial stage of the addition, the silver potential was maintained at −60 mV by the use of an aqueous solution of KBr. Washing and chemical sensitization were performed in substantially the same manner as Em-E.

(Production of Em-H)

An aqueous solution containing 17.8 g of an ion exchanged gelatin of 100,000 molecular weight, 6.2 g of KBr and 0.46 g of KI was vigorously agitated while maintaining the temperature at 45° C. An aqueous solution containing 11.85 g of $AgNO_3$ and an aqueous solution containing 3.8 g of KBr were added by the double jet method over a period of 45 sec. The temperature was raised to 63° C., and 24.1 g of an ion exchanged gelatin of 100,000 molecular weight was added. The mixture was ripened. After the completion of the ripening, an aqueous solution of KBr and an aqueous solution containing 133.4 g of $AgNO_3$ were added by the double jet method over a period of 20 min so that the final flow rate was 2.6 times the initial flow rate. During this period, the silver potential was maintained at +40 mv against saturated calomel electrode. 10 min after the initiation of the addition, 0.1 mg of $K_2IrCl_6$ was added. Further, 7 g of NaCl was added, and an aqueous solution of KBr and an aqueous solution containing 45.6 g of $AgNO_3$ were added by the double jet method over a period of 12 min. During this period, the silver potential was maintained at +90 mV. Still further, 100 mL of an aqueous solution containing 29 mg of yellow prussiate of potash was added over a period of 6 min from the initiation of the addition. 14.4 g of KBr was added, and the AgI fine grain emulsion used in the preparation of Em-A was added in an amount, in terms of the weight of KI, of 6.3 g. Immediately after the completion of the addition, an aqueous solution containing 42.7 g of $AgNO_3$ and an aqueous solution of KBr were added by the double jet method over a period of 11 min. During this period, the silver potential was maintained at +90 mV. Washing and chemical sensitization were performed in substantially the same manner as Em-E.

(Production of Em-I)

Em-I was prepared in substantially the same manner as Em-H, except that the temperature during formation of nuclei was changed to 35° C.

(Production of Em-J)

1200 mL of an aqueous solution containing 0.75 g of a low-molecular-weight gelatin of 15,000 molecular weight and 0.9 g of KBr was held at 39° C., had its pH adjusted to 1.8 and was vigorously agitated. An aqueous solution containing 0.45 g of $AgNO_3$ and an aqueous solution of KBr containing 1.5 mol % KI were added by the double jet method over a period of 16 sec. During the period, KBr excess concentration was held constant. The mixture was heated to 54° C. and ripened. After the completion of the ripening, 20 g of a gelatin converted to phthalate at a ratio of 97%, the gelatin containing methionine in an amount of 35 $\mu$mol per g and having a molecular weight of 100,000, was added, and the pH was adjusted to 5.9. 2.9 g of KBr was added. Further, 3 mg of thiourea dioxide was added, and 1.5 g of disodium salt of 3,5-disulfocatechol was added. An aqueous solution of KBr and 288 mL of an aqueous solution containing 28.8 g of $AgNO_3$ were added by the double jet method over a period of 53 min. During this period, a AgI fine grain emulsion of 0.03 $\mu$m grain size was simultaneously added so that the silver iodide content was 4.1 mol %, and the silver potential was maintained at −60 mV against saturated calomel electrode. 2.5 g of KBr was added, and an aqueous solution of KBr and an aqueous solution containing 87.7 g of $AgNO_3$ were added by the double jet method over a period of 63 min while increasing the flow rate so that the final flow rate was 1.2 times the initial flow rate. During this period, the above AgI fine grain emulsion was simultaneously added while conducting a flow rate increase so that the silver iodide content was 10.5 mol %, and the silver potential was maintained at −70 mV. An aqueous solution of KBr and 132 mL of an aqueous solution containing 41.8 g of $AgNO_3$ were added by the double jet method over a period of 25 min. The addition of the aqueous solution of KBr was regulated so that the potential at the completion of the addition was +20 mV. 2 mg of sodium benzenethiosulfonate was added. KBr was added to thereby adjust the silver potential to −70 mV. The above AgI fine grain emulsion was added in an amount, in terms of the weight of KI, of 5.73 g. Immediately after the completion of the addition, 609 mL of an aqueous solution containing 66.4 g of $AgNO_3$ was added over a period of 10 min. For 6 min in the initial stage of the addition, the silver potential was maintained at −70 mV by the use of an aqueous solution of KBr. The mixture was washed with water, and gelatin was added, adjusting the pH and pAg thereof at 40° C. to 6.5 and 8.2, respectively.

The temperature was raised to 56° C. Sensitizing dyes 9, 10 and 11 were added in the form of a solid fine dispersion in an amount of $5.3\times10^{-4}$ mol, $2.1\times10^{-4}$ mol and $1.0\times10^{-4}$ mol, respectively, per mol of silver halide. Thereafter, per mol of silver halide, $3.3\times10^{-3}$ mol of potassium thiocyanate, $2.9\times10^{-6}$ mol of chloroauric acid, $3.4\times10^{-6}$ mol of sodium thiosulfate and $3.1\times10^{-6}$ mol of N,N-dimethylselenourea were added and ripened to thereby effect optimum chemical sensitization. At the completion of chemical sensitization, compounds 7 and 8 were added in an amount of $2.6\times10^{-4}$ mol and $6.0\times10^{-6}$ mol, respectively, per mol of silver halide.

Sensitizing dye 9

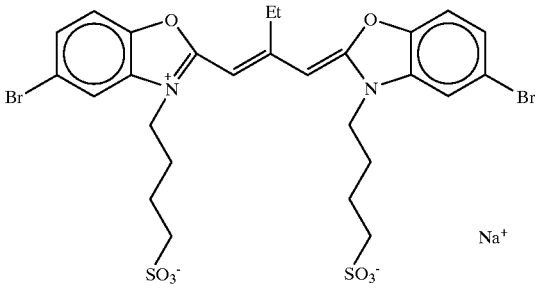

Sensitizing dye 10

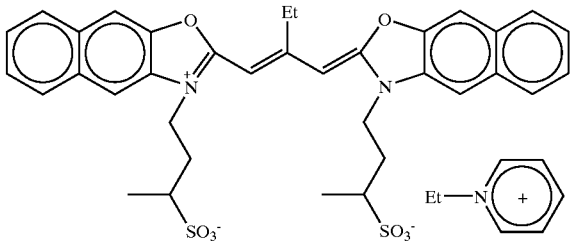

Sensitizing dye 11

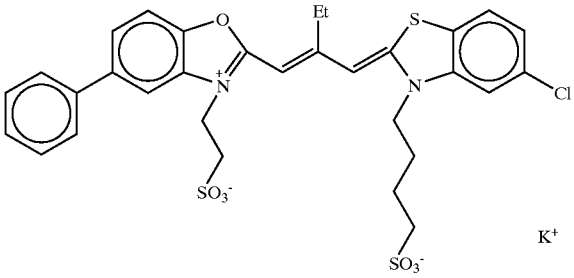

Compound 7

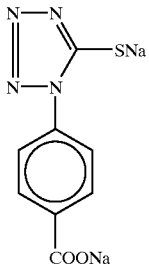

Compound 8

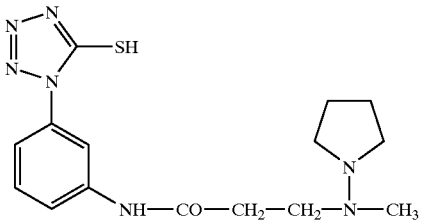

(Production of Em-K)

1200 mL of an aqueous solution containing 4.9 g of a low-molecular-weight gelatin of 15,000 molecular weight and 5.3 g of KBr was vigorously agitated, while maintaining the temperature at 60° C. 27 mL of an aqueous solution containing 8.75 g of $AgNO_3$ and 36 mL of an aqueous solution containing 6.45 g of KBr were added by the double jet method over a period of 1 min. The temperature was raised to 75° C., and 21 mL of an aqueous solution containing 6.9 g of $AgNO_3$ was added over a period of 2 min. 26 g of $NH_4NO_3$ and 56 mL of 1 N NaOH were sequentially added, and ripened. After the completion of the ripening, the pH was adjusted to 4.8. 438 mL of an aqueous solution containing 141 g of $AgNO_3$ and 458 mL of an aqueous solution containing 102.6 of KBr were added by the double jet method so that the final flow rate was 4 times the initial flow rate. The temperature was lowered to 55° C., and an aqueous solution containing 6.46 g of KI and 240 mL of an aqueous solution containing 7.1 g of $AgNO_3$ were added by the double jet method over a period of 5 min. 7.1 g of KBr was added, and 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added by the double jet method over a period of 8 min. Washing and chemical sensitization were performed in substantially the same manner as Em-J.

(Production of Em-L)

Em-L was prepared in substantially the same manner as Em-K, except that the temperature at nucleation was changed to 40° C.

(Production of Em-M, -N, -O)

These were prepared in substantially the same manner as Em-H or Em-I, except that the chemical sensitization was performed in substantially the same manner as that of Em-J.

(Production of Em-P)

Em-P was prepared in substantially the same manner as the emulsion of the layer capable of exerting an interlayer effect onto a red-sensitive layer as described in Examples of JP-A-3-237450, the disclosure of which is herein incorporated by reference.

Properties of the silver halide emulsions Em-A to Em-O are summarized in Table 10.

TABLE 10

| Emulsion No. | Equiv. circular diam. (μm) Var. coefficient (%) | Thickness (μm) Var. coefficient (%) | Av. aspect ratio Var. coefficient (%) | Tabularity | Twin face spacing (μm) Var. coefficient (%) | Ratio of tabular grain occupancy in all projected area (%) | Ratio of of face (100) to side faces (%) | Av. I content (mol %) Var. coefficient (%) | Cl content (mol %) | Surface I content (mol %) |
|---|---|---|---|---|---|---|---|---|---|---|
| Em-A | 1.98 | 0.198 | 10 | 51 | 0.014 | 92 | 23 | 15 | 0 | 4.3 |
| | 23 | 28 | 35 | | 32 | | | 17 | | |
| Em-B | 1.30 | 0.108 | 12 | 111 | 0.013 | 93 | 22 | 11 | 0 | 3.6 |
| | 25 | 27 | 38 | | 30 | | | 16 | | |
| Em-C | 1.00 | 0.083 | 12 | 145 | 0.012 | 93 | 18 | 4 | 1 | 1.8 |
| | 27 | 26 | 37 | | 30 | | | 8 | | |
| Em-D | 0.75 | 0.075 | 10 | 133 | 0.010 | 91 | 33 | 4 | 2 | 1.9 |
| | 31 | 18 | 29 | | 27 | | | 8 | | |
| Em-F | 1.54 | 0.077 | 20 | 260 | 0.013 | 99 | 23 | 7 | 0 | 2.5 |
| | 26 | 18 | 33 | | 26 | | | 7 | | |
| Em-G | 1.08 | 0.072 | 15 | 208 | 0.008 | 97 | 23 | 6 | 0 | 2.0 |
| | 18 | 15 | 19 | | 22 | | | 5 | | |
| Em-H | 0.44 | 0.22 | 2 | 9 | 0.013 | 90 | 38 | 3 | 2 | 1 |
| | 16 | 13 | 9 | | 18 | | | 6 | | |
| Em-I | 0.33 | 0.165 | 2 | 12 | 0.013 | 88 | 42 | 3 | 2 | 1 |
| | 17 | 13 | 12 | | 18 | | | 6 | | |
| Em-J | 2.02 | 0.101 | 20 | 198 | 0.013 | 99 | 20 | 7 | 0 | 2.4 |
| | 31 | 19 | 33 | | 33 | | | 6 | | |
| Em-K | 1.09 | 0.156 | 7 | 45 | 0.013 | 99 | 22 | 3 | 0 | 2.7 |
| | 16 | 18 | 19 | | 16 | | | 7 | | |
| Em-L | 0.84 | 0.12 | 7 | 58 | 0.013 | 99 | 25 | 3 | 0 | 2.7 |
| | 17 | 18 | 19 | | 16 | | | 7 | | |
| Em-M | 0.55 | 0.275 | 2 | 7 | 0.013 | 90 | 38 | 2 | 2 | 1 |
| | 16 | 13 | 9 | | 18 | | | 6 | | |
| Em-N | 0.44 | 0.22 | 2 | 9 | 0.013 | 88 | 42 | 2 | 2 | 1 |
| | 17 | 13 | 12 | | 18 | | | 6 | | |
| Em-O | 0.33 | 0.165 | 2 | 12 | 0.013 | 88 | 46 | 1 | 2 | 0.5 |
| | 17 | 13 | 12 | | 18 | | | 6 | | |

1) Support:

The support employed in this Example was prepared by the following method.

100 parts by weight of polyethylene 2,6-naphthalate polymer and 2 parts by weight of Tinuvin P.326 (produced by Ciba-Geigy) as an ultraviolet absorber were dried, melted at 300° C., extruded through a T die, longitudinally oriented at 140° C. to a 3.3-fold length, laterally oriented at 130° C. to a 3.3-fold width and thermally set at 250° C. for 6 sec. Thus, a'PEN (polyethylene naphthalate) film having a thickness of 90 μm was obtained. Appropriate amounts of blue dye, magenta dye and yellow dye (I-1, I-4, I-6, I-24, I-26, I-27 and II-5 described in JIII Journal of Technical Disclosure No. 94-6023) were mixed in this PEN film. Further, this PEN film was wound round a stainless steel core with a diameter of 20 cm, and a 110° C./48 hr heat history was imparted thereto. Thus, a support with a low tendency to curl was obtained.

2) Application of Subbing Layer by Coating:

Both sides of the above support were treated by corona discharge, UV irradiation and glow discharge. Thereafter, a subbing liquid consisting of 0.1 g/m$^2$ of gelatin, 0.01 g/m$^2$ of sodium α-sulfo-di-2-ethylhexyl succinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of polyamide/epichlorohydrin polyconden-sate was applied onto each of the sides (10 mL/m$^2$ by the use of a bar coater) so that a subbing layer was provided on a side exposed to high temperature at the time of orientation. Drying was conducted at 115° C. for 6 min (all of the rollers and conveyor of drying zone were heated at 115° C.).

3) Application of Back Layer by Coating:

After the subbing, an antistatic layer, a magnetic recording layer and a slide layer of the following respective compositions as back layers were applied by coating to one side of the support.

3-1) Application of Antistatic Layer by Coating:

Coating was made with 0.2 g/m$^2$ of a dispersion of fine grain powder with a resistivity of 5 Ω·cm (secondary aggregate grain diameter: approximately 0.08 μm) composed of a tin oxide/antimony oxide composite having an average particle size of 0.005 μm, 0.05 g/m$^2$ of gelatin, 0.02 g/m$^2$ of $(CH_2{=}CHSO_2CH_2CH_2NHCO)_2CH_2$, 0.005 g/M$^2$ of polyoxyethylene-p-nonylphenol (polymerization degree 10) and 0.22 g/m$^2$ of resorcinol.

3-2) Application of Magnetic Recording Layer by Coating:

A magnetic recording layer having a thickness of 1.2 μm was obtained by applying, by means of a bar coater, 0.06 g/m$^2$ of cobalt/γ-iron oxide (specific surface area: 43 m$^2$/g, major axis: 0.14 μm, minor axis: 0.03 μm, saturation magnetization: 89 emu/g, $Fe^{2+}/Fe^{3+}$=6/94, surface treated with aluminum oxide/silicon oxide in an amount of 2% by weight based on iron oxide) coated with 3-polyoxyethylene-propyloxytrimethoxysilane (polymerization degree: 15; 15% by weight), 1.2 g/m$^2$ of diacetylcellulose (iron oxide dispersed by the use of an open kneader and a sand mill) and 0.3 g/m$^2$ of $C_2H_5C(CH_2OCONH{-}C_6H_3(CH_3)NCO)_3$ as a hardener together with acetone, methyl ethyl ketone and cyclohexanone as a solvent. As a matting agent, silica particles (0.3 μm) and abrasive aluminum oxide (0.15 μm) coated with 3-polyoxyethylene-propyloxytrimethoxysilane (polymerization degree 15; 15% by weight) were each added in an amount of 10 mg/m$^2$, Drying was conducted at 115° C. for 6 min (all of the rollers and conveyor of drying zone were heated at 115° C.). With respect to the obtained magnetic recording layer, the DB color density increment with X-lite (blue filter), saturation magnetization moment, coercive force and rectangular ratio were approximately 0.1, 4.2 emu/g, $7.3\times10^4$ A/m and 65%, respectively.

3-3) Preparation of Slide Layer:

Coating was made with a mixture of diacetylcellulose (25 mg/m$^2$) and $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). This mixture was prepared by melting in xylene/propylene monomethyl ether (1/1) at 105° C. and pouring and dispersing in propylene monomethyl ether (10-fold amount) at ordinary temperature and formed into a dispersion (average particle size: 0.01 μm) in acetone before addition. As a matting agent, silica particles (0.3 μm) and abrasive aluminum oxide (0.15 μm) coated with 3-polyoxyethylene-propyloxytrimethoxysilane (polymerization degree 15; 15% by weight) were each added in an amount of 15 mg/m$^2$. Drying was conducted at 115° C. for 6 min (all of the rollers and conveyor of drying zone were heated at 115° C.). With respect to the obtained slide layer, the kinematic friction coefficient (stainless steel hard ball with a diameter of 5 mm, load: 10 g, speed: 6 cm/min), static friction coefficient (clip method) and kinematic friction coefficient between emulsion face and slide layer as described later were 0.06, 0.07 and 0.12, respectively, ensuring excellent performance.

4) Application of Lightsensitive Layer by Coating:

The side opposite to the thus obtained back layers was coated with a plurality of layers of the following respective compositions, thereby obtaining a color negative film.

(Composition of Lightsensitive Layer)

Main materials used in each layer are classified as follows, however, the function of each compound is not limited to one indicated:

ExC: cyan coupler, UV: ultraviolet absorber,

ExM: magenta coupler, HBS: high b.p. org. solvent,

ExY: yellow coupler, H: gelatin hardener,

ExS: sensitizing dye.

(For each specific compound, in the following description, numeral is assigned after the character, and the formula is shown later).

The numeric value given beside the description of each component is for the coating amount expressed in the unit of g/m$^2$. With respect to the silver halide, the coating amount is in terms of silver quantity. Regarding the sensitizing dye, however, the coating amount is expressed in the unit of mol per mol of silver halide present in the same layer.

1st Layer (First Antihalation Layer)

| | | |
|---|---|---|
| Black colloidal silver | silver | 0.155 |
| (Silver iodobromide emulsion) | silver | 0.01 |
| Gelatin | | 0.87 |
| ExC-1 | | 0.002 |
| ExC-3 | | 0.002 |
| ExC-9 | | 0.002 |
| Cpd-2 | | 0.001 |
| HBS-1 | | 0.004 |
| HBS-2 | | 0.002 |

2nd Layer (Second Antihalation Layer)

| | | |
|---|---|---|
| Black colloidal silver | silver | 0.066 |
| Gelatin | | 0.407 |

-continued

| | |
|---|---|
| ExM-1 | 0.050 |
| ExF-1 | $2.0\times10^{-3}$ |
| HBS-1 | 0.074 |
| Solid disperse dye ExF-2 | 0.015 |
| Solid disperse dye ExF-3 | 0.020 |
| Solid disperse dye ExF-9 | 0.020 |
| 3rd layer (Interlayer) | |
| 0.07 μm AgBrI (2) | 0.020 |
| ExC-2 | 0.022 |
| Polyethyl acrylate latex | 0.085 |
| Gelatin | 0.294 |

4th Layer (Low-speed Red-sensitive Emulsion Layer)

| | | |
|---|---|---|
| Em-M | silver | 0.065 |
| Em-N | silver | 0.097 |
| Em-O | silver | 0.162 |
| ExC-1 | | 0.109 |
| ExC-3 | | 0.022 |
| ExC-4 | | 0.072 |
| ExC-5 | | 0.011 |
| ExC-6 | | 0.003 |
| ExC-9 | | 0.022 |
| Cpd-2 | | 0.025 |
| Cpd-4 | | 0.025 |
| HBS-1 | | 0.17 |
| Gelatin | | 0.80 |

5th Layer (Medium-speed Red-sensitive Emulsion Layer)

| | | |
|---|---|---|
| Em-K | silver | 0.35 |
| Em-L | silver | 0.47 |
| ExC-1 | | 0.14 |
| ExC-2 | | 0.026 |
| ExC-3 | | 0.010 |
| ExC-4 | | 0.12 |
| ExC-5 | | 0.016 |
| ExC-6 | | 0.007 |
| ExC-9 | | 0.010 |
| Cpd-2 | | 0.036 |
| Cpd-4 | | 0.028 |
| HBS-1 | | 0.16 |
| Gelatin | | 1.18 |

6th Layer (High-speed Red-sensitive Emulsion Layer)

| | | |
|---|---|---|
| (Emulsions prepd. in Ex. 1–6) | silver | 1.47 |
| ExC-1 | | 0.18 |
| ExC-3 | | 0.035 |
| ExC-6 | | 0.029 |
| ExC-7 | | 0.010 |
| ExC-9 | | 0.035 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |

-continued

| 7th layer (Interlayer) | | |
|---|---|---|
| Cpd-1 | | 0.089 |
| Solid disperse dye ExF-4 | | 0.030 |
| HBS-1 | | 0.050 |
| Polyethyl acrylate latex | | 0.83 |
| Gelatin | | 0.84 |

8th Layer (Layer Capable of Exerting Interlayer Effect on Red-sensitive Layer)

| | | |
|---|---|---|
| Em-P | silver | 0.560 |
| ExS-6 | | $1.7 \times 10^{-4}$ |
| ExS-10 | | $4.6 \times 10^{-4}$ |
| Cpd-4 | | 0.030 |
| ExC-10 | | 0.021 |
| ExM-2 | | 0.096 |
| HBS-1 | | 0.085 |
| HBS-3 | | 0.003 |
| Gelatin | | 0.58 |

9th Layer (Low-speed Green-sensitive Emulsion Layer)

| | | |
|---|---|---|
| Em-G | silver | 0.44 |
| Em-H | silver | 0.29 |
| Em-I | silver | 0.29 |
| ExM-2 | | 0.36 |
| ExM-3 | | 0.045 |
| HBS-1 | | 0.14 |
| HBS-3 | | 0.01 |
| HBS-4 | | 0.27 |
| HBS compound-20 | | 0.14 |
| Cpd-5 | | 0.01 |
| Gelatin | | 1.39 |

10th Layer (Medium-speed Green-sensitive Emulsion Layer)

| | | |
|---|---|---|
| Em-F | silver | 0.28 |
| Em-G | silver | 0.17 |
| ExC-6 | | 0.0045 |
| ExC-10 | | 0.0045 |
| ExM-2 | | 0.031 |
| ExM-3 | | 0.029 |
| ExY-1 | | 0.006 |
| ExM-4 | | 0.028 |
| HBS-1 | | 0.032 |
| HBS-3 | | $2.1 \times 10^{-3}$ |
| HBS compound-20 | | 0.032 |
| Cpd-5 | | 0.004 |
| Gelatin | | 0.44 |

11th Layer (High-speed Green-sensitive Emulsion Layer)

| | | |
|---|---|---|
| Em-J | silver | 0.99 |
| ExC-6 | | 0.002 |
| ExC-10 | | 0.002 |

-continued

| | | |
|---|---|---|
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| Cpd-3 | | 0.004 |
| Cpd-4 | | 0.007 |
| Cpd-5 | | 0.01 |
| HBS-1 | | 0.09 |
| HBS compound-20 | | 0.09 |
| Polyethyl acrylate latex | | 0.099 |
| Gelatin | | 1.11 |

12th Layer (Yellow Filter Layer)

| | | |
|---|---|---|
| Yellow colloidal silver | silver | 0.047 |
| Cpd-1 | | 0.16 |
| Solid disperse dye ExF-5 | | 0.010 |
| Solid disperse dye ExF-6 | | 0.010 |
| Solid disperse dye ExF-8 | | 0.020 |
| Oil soluble dye ExF-7 | | 0.010 |
| HBS-1 | | 0.082 |
| Gelatin | | 1.057 |

13th Layer (Low-speed Blue-sensitive Emulsion Layer)

| | | |
|---|---|---|
| Em-B | silver | 0.15 |
| Em-C | silver | 0.15 |
| Em-D | silver | 0.15 |
| ExC-1 | | 0.641 |
| ExC-8 | | 0.012 |
| ExY-1 | | 0.035 |
| ExY-2 | | 0.47 |
| ExY-3 | | 0.10 |
| ExY-4 | | 0.005 |
| ExY-7 | | 0.30 |
| Cpd-2 | | 0.10 |
| Cpd-3 | | $4.0 \times 10^{-3}$ |
| HBS-1 | | 0.24 |
| Gelatin | | 1.41 |

14th Layer (High-speed Blue-sensitive Emulsion Layer)

| | | |
|---|---|---|
| Em-A | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |

15th Layer (1st Protective Layer)

| | | |
|---|---|---|
| 0.07 μm AgBrI (2) | silver | 0.30 |
| UV-1 | | 0.21 |

-continued

| | |
|---|---|
| UV-2 | 0.13 |
| UV-3 | 0.20 |
| UV-4 | 0.025 |
| F-18 | 0.009 |
| HBS-1 | 0.12 |
| HBS-4 | $5.0 \times 10^{-2}$ |
| Gelatin | 2.3 |

16th Layer (2nd Protective Layer)

| | |
|---|---|
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Synthetic mica | 0.25 |
| Pullulan | 0.25 |
| Gelatin | 0.75 |

In addition to the above components, W-1 to W-5, B-4 to B-6, F-1 to F-17, a lead salt, a platinum salt, an iridium salt and a rhodium salt were appropriately added to the individual layers in order to improve the storage stability, processability, resistance to pressure, antiseptic and mildew-proofing properties, antistatic properties and coating properties thereof.

Preparation of Dispersion of Organic Solid Disperse Dye:

The ExF-2 of the 1st layer was dispersed by the following method. Specifically, 21.7 mL of water, 3 mL of a 5% aqueous solution of sodium p-octylphenoxyethoxyethoxyethanesulfonate and 0.5 g of a 5% aqueous solution of p-octylphenoxy polyoxyethylene ether (polymerization degree: 10) were placed in a 700-mL pot mill, and 5.0 g of dye ExF-2 and 500 mL of zirconium oxide beads (diameter 1 mm) were charged in the mill. The contents were dispersed for 2 hr. This dispersion was conducted by using a BO type oscillating ball mill manufactured by Chuo Koki K.K. Thereafter, the contents were removed from the mill and added to 8 g of a 12.5% aqueous solution of gelatin. The beads were removed by filtration, thereby obtaining a gelatin dispersion of the dye. The average diameter of the dye fine grains was 0.44 μm.

Solid dispersions of EXF-3, EXF-4, ExF-6, ExF-8 and ExF-9 were obtained in the same manner. The average diameters of these dye fine grains were 0.24 μm, 0.45 μm and 0.52 μm, respectively. ExF-5 was dispersed by the microprecipitation dispersion method described in Example 1 of EP. No. 549,489A. The average grain diameter was 0.06 μm.

The compounds used in the preparation of each of the layers are listed below.

ExC-1

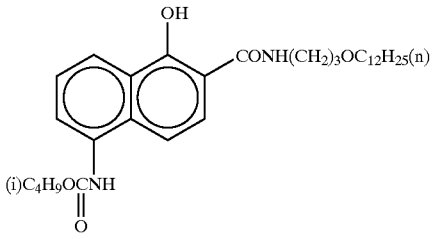

ExC-2

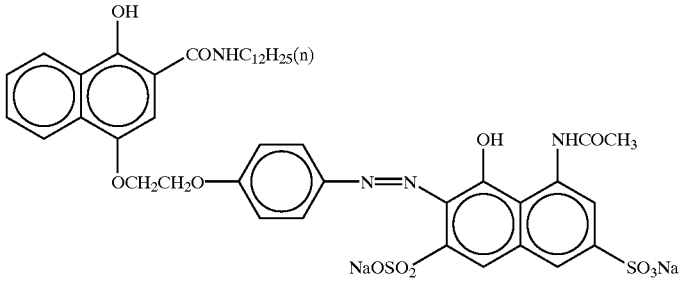

ExC-3

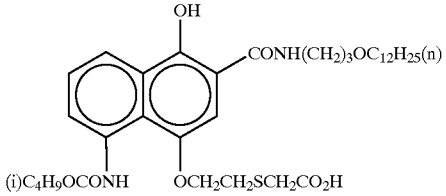

ExC-4

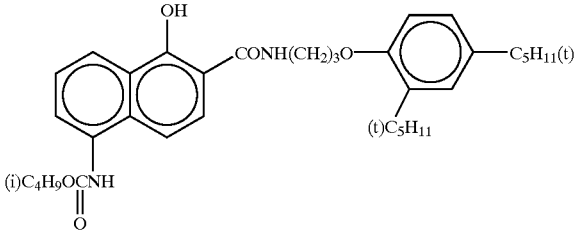

-continued
ExC-5
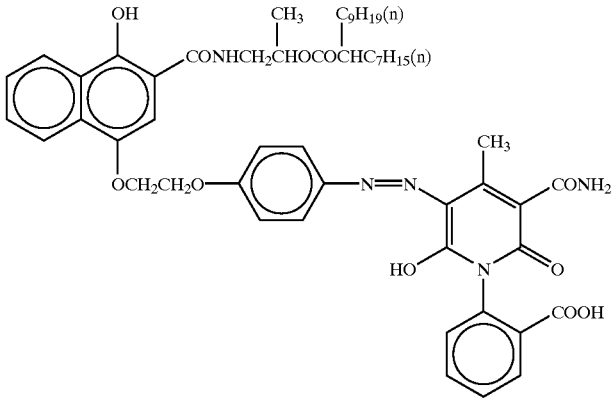
ExC-6
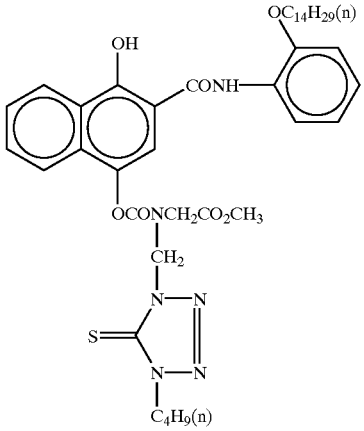
ExC-7
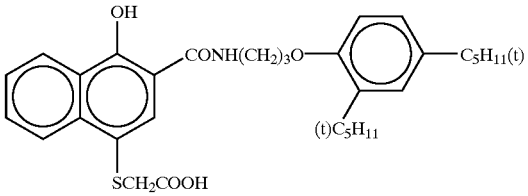
ExC-8
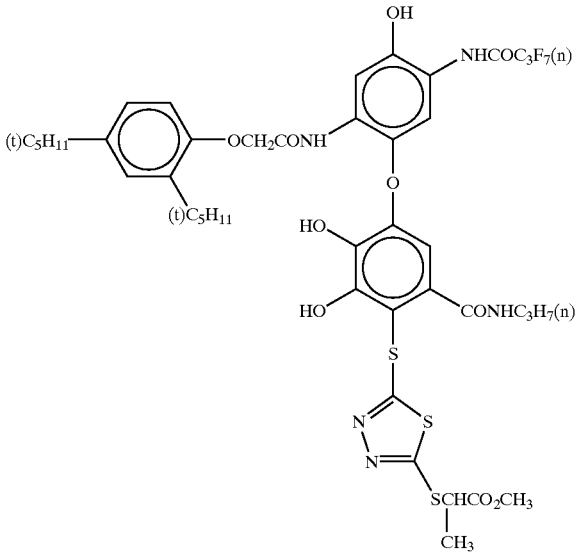
ExC-9
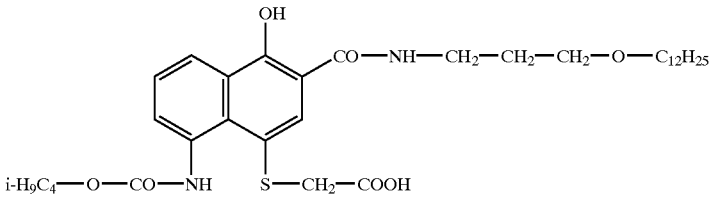

-continued
ExC-10
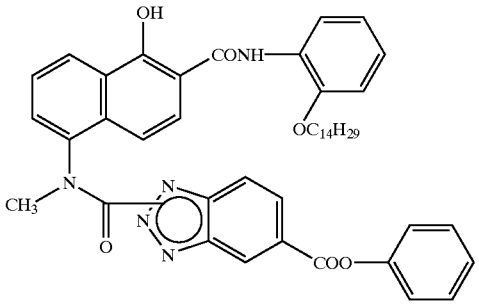
ExM-1
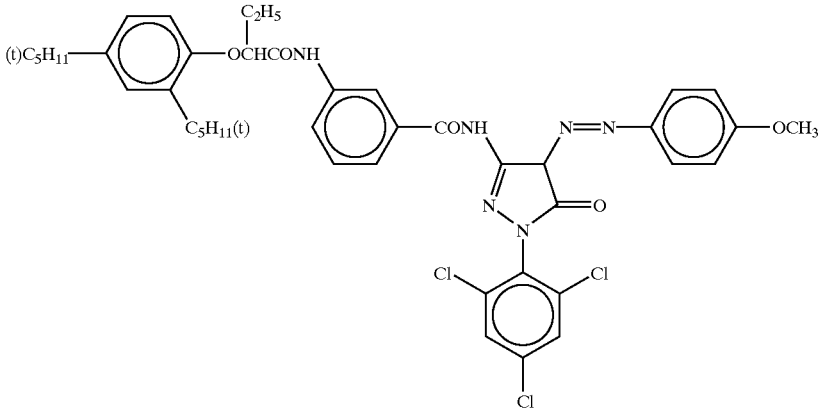
ExM-2
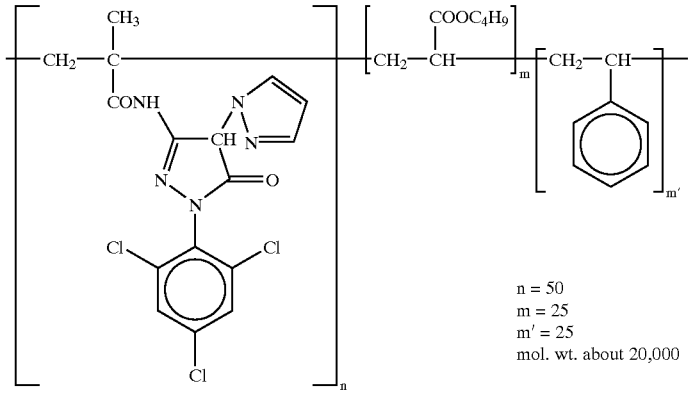
n = 50
m = 25
m′ = 25
mol. wt. about 20,000
ExM-3
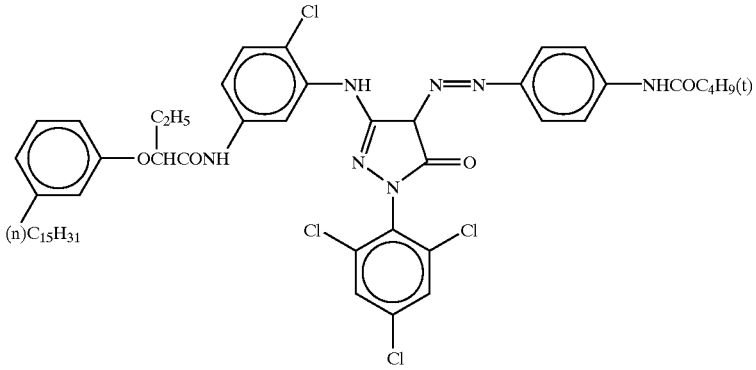

-continued
ExM-4
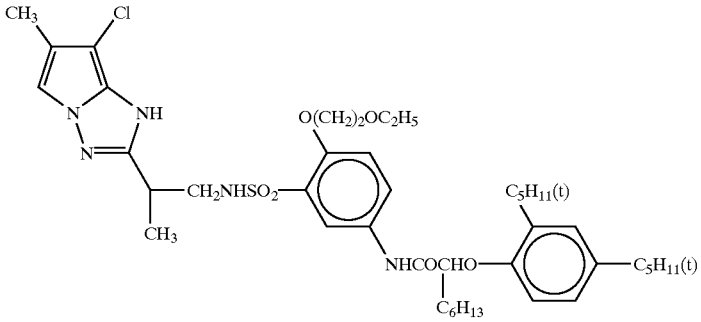
ExM-5
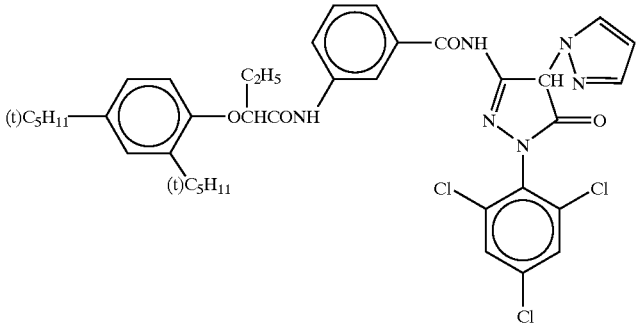
ExY-1
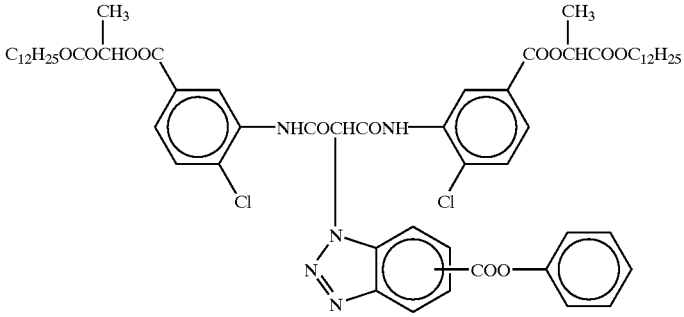
ExY-2
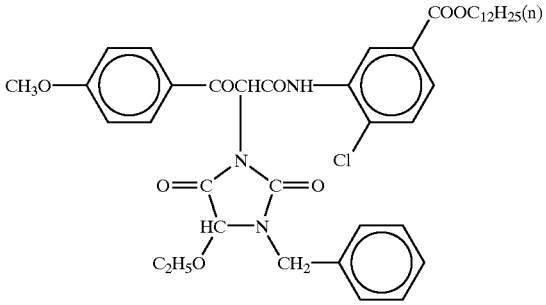
ExY-3
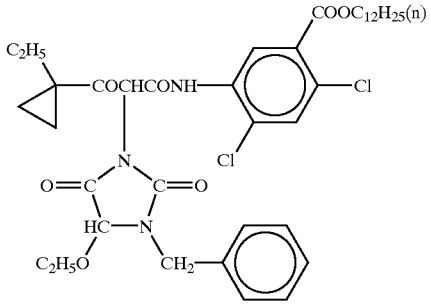

-continued
ExY-4
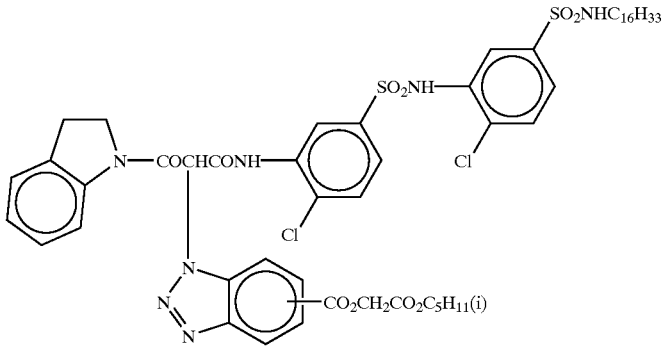
ExY-5
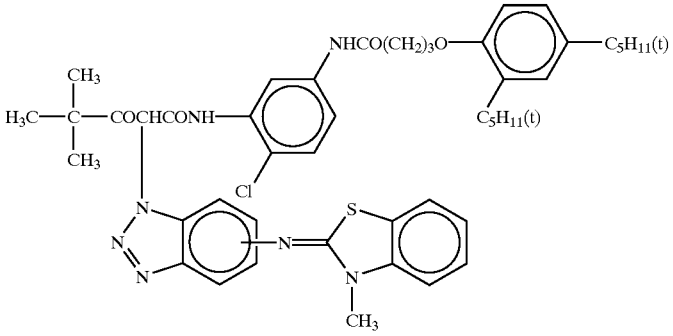
ExY-6
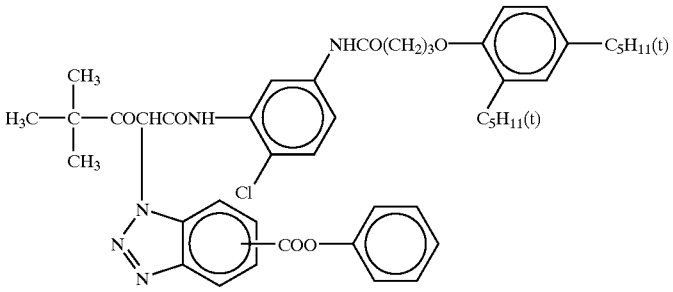
ExY-7
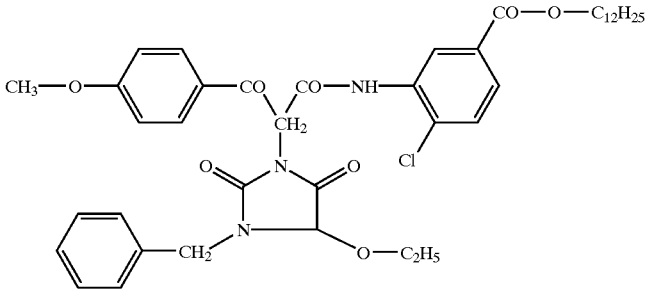
ExF-1
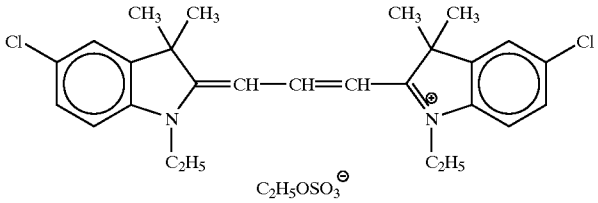

-continued
ExF-2
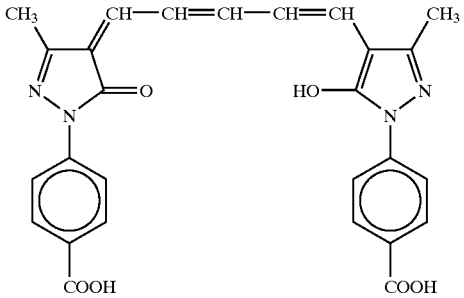
ExF-3
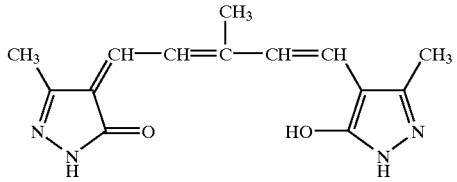
ExF-4
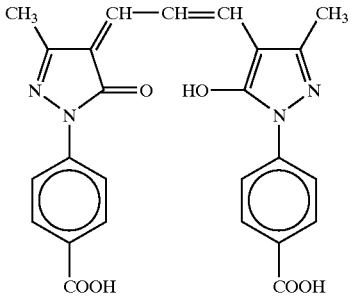
ExF-5
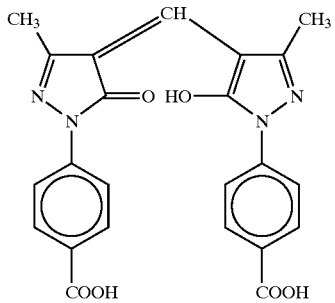
ExF-6
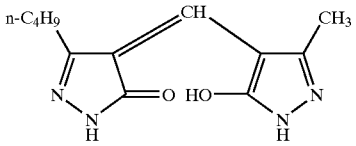
ExF-7
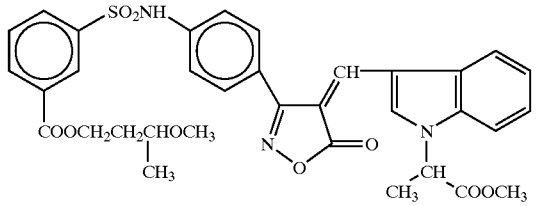
ExF-8
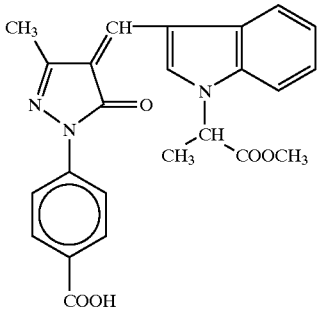
ExF-9
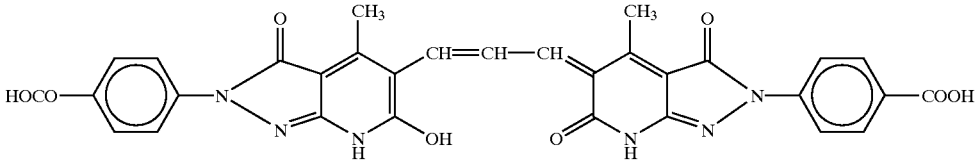
Cpd-1
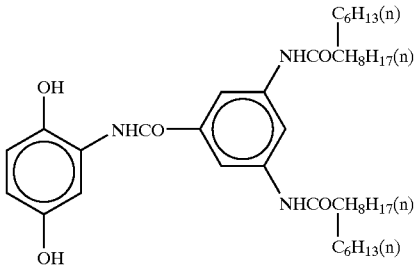

-continued
Cpd-2
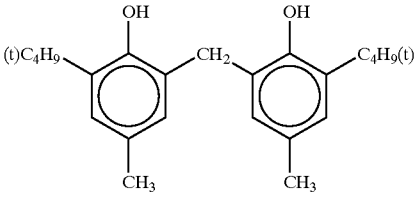
Cpd-3
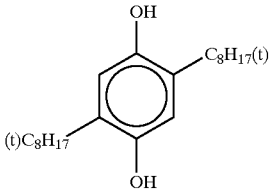
Cpd-4
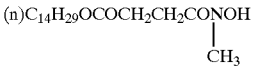
Cpd-5
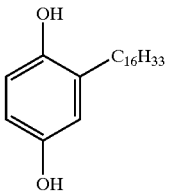
UV-1
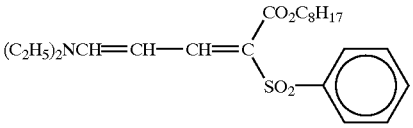
UV-2
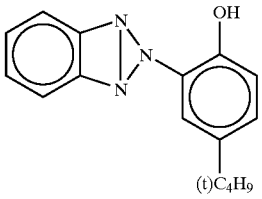
UV-3
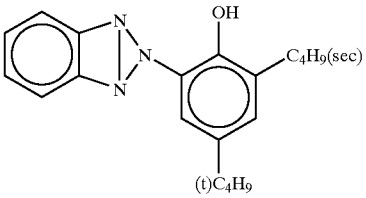
UV-4
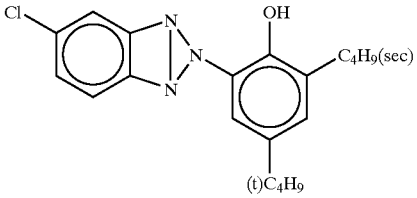
HBS-1
Tricresyl phosphate
HBS-2
Di-n-butylphthalate
HBS-3
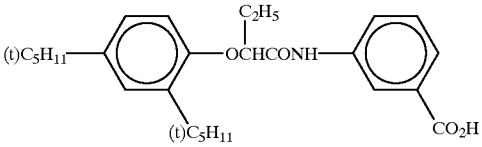
HBS-4
Tri(2-ethylhexyl)phosphate
ExS-6
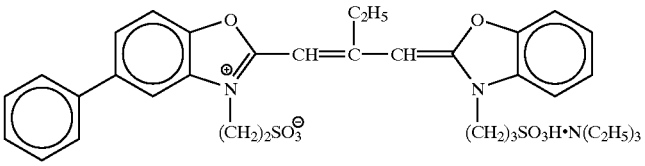
ExS-10
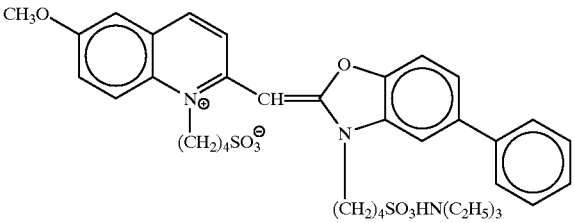
S-1
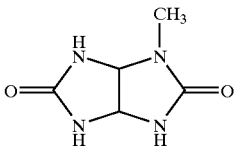
H-1
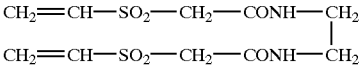
B-1
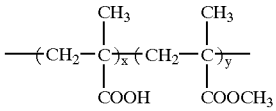
x/y = 10/90 (Wt. ratio)
Average mol. wt.: about 35,000

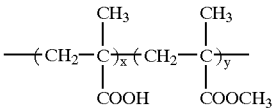
x/y = 40/60 (Wt. ratio)
Average mol. wt.: about 20,000
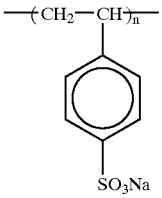
Average mol. wt.: about 750,000
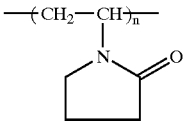
Average mol. wt.: about 10,000
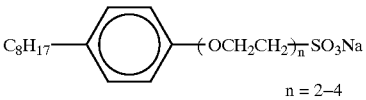
n = 2–4
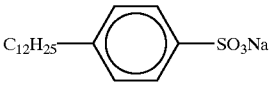
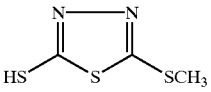
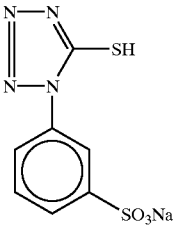
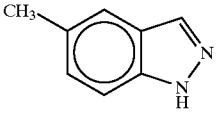
-continued
B-2
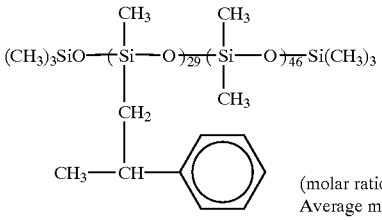
(molar ratio)
Average mol. wt.: about 8,000
B-3
B-4
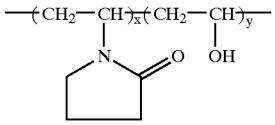
x/y = 70/30 (Wt. ratio)
Average mol. wt.: about 17,000
B-5
B-6
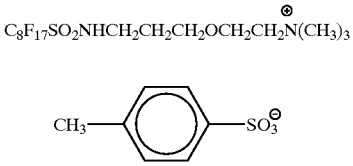
W-1
W-2
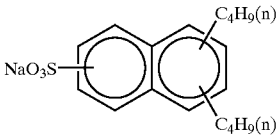
W-3
W-4
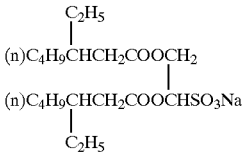
W-5
F-1
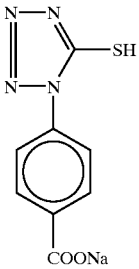
F-2
F-3
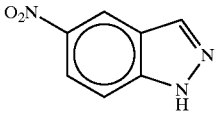
F-4
F-5
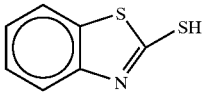
F-6

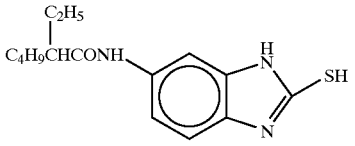

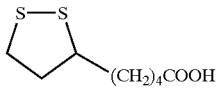

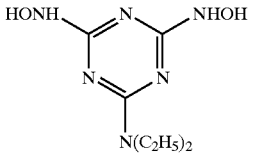

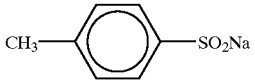

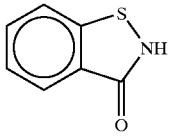

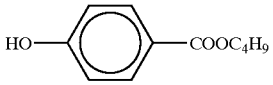

-continued

F-7

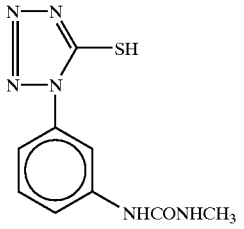

F-8

F-9

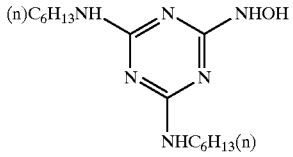

F-10

F-11

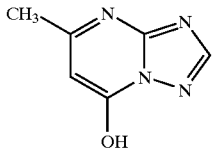

F-12

F-13

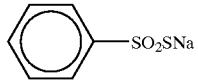

F-14

F-15

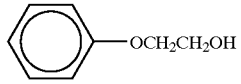

F-16

F-17

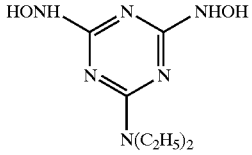

F-18

(Preparation of Samples 101 to 107)

Samples 101 to 106 were prepared by applying the emulsons Em-1-B, Em-1-D, Em-5-B, Em-8-A, Em-8-B and Em-9-A prepared in Examples 1 to 5, respectively, in the formation of the 6th layer. Sample 107 was prepared by applying emulsion Em-9-B, which was produced by increasing the amount of calcium nitrate added in the preparation of emulsion Em-9-A. The amounts of calcium ions in the samples 101 to 107 were measured. It was found that, in sample 107 only, the calcium ion amount exceeded $8.0\times10^{-2}$ g per g of gelatin.

These samples were exposed through continuous wedge and gelatin filter SC-39 produced by Fuji Photo Film Co., Ltd. for 1/100 sec. The development was carried out by the use of automatic processor FP-360B manufactured by Fuji Photo Film Co., Ltd. under the following conditions. The apparatus was reworked so as to prevent the flow of overflow solution from the bleaching bath toward subsequent baths and to, instead, discharge all the solution into a waste solution tank. This FP-360B is fitted with an evaporation correcting means described in JIII Journal of Technical Disclosure No. 94-4992 issued by Japan Institute of Invention and Innovation.

The processing steps and compositions of processing solutions are as follows.

(Processing Steps)

| Step | Time | Temp. (centigrade) | Replenishment rate* | Tank vol. |
|---|---|---|---|---|
| Color development | 3 min 5 sec | 37.8 | 20 mL | 11.5 L |
| Bleaching | 50 sec | 38.0 | 5 mL | 5 L |
| Fixing (1) | 50 sec | 38.0 | — | 5 L |
| Fixing (2) | 50 sec | 38.0 | 8 mL | 5 L |
| Water washing | 30 sec | 38.0 | 17 mL | 3 L |
| Stabilization (1) | 20 sec | 38.0 | — | 3 L |
| Stabilization (2) | 20 sec | 38.0 | 15 mL | 3 L |
| Drying | 1 min 30 sec | 60.0 | | |

*The replenishment rate is a value per 1.1 m of a 35-mm wide lightsensitive material (equivalent to one 24 Ex. film).

The stabilizer was fed from stabilization (2) to stabilization (1) by counter current, and the fixer was also fed from fixing (2) to fixing (1) by counter current. All the overflow of washing water was introduced into fixing bath (2). The amounts of drag-in of developer into the bleaching step, drag-in of bleaching solution into the fixing step and drag-in of fixer into the water washing step were 2.5 mL, 2.0 mL and 2.0 mL, respectively, per 1.1 m of a 35-mm wide lightsensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| (Color developer) | Tank soln. (g) | Replenisher (g) |
|---|---|---|
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl)amino]-aniline sulfate | 4.5 | 6.5 |
| Water | q.s. ad 1.0 L | |
| pH | 10.05 | 10.18 |

This pH was adjusted by the use of potassium hydroxide and sulfuric acid.

| (Bleaching soln.) | Tank soln. (g) | Replenisher (g) |
|---|---|---|
| Fe(III) ammonium 1,3-diamino-propanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water | q.s. ad 1.0 L | |
| pH | 4.6 | 4.0 |

This pH was adjusted by the use of aqueous ammonia.

(Fixing (1) Tank Soln.)

5:95 (by volume) mixture of the above bleaching tank soln. and the following fixing tank soln, pH 6.8.

| (Fixing (2)) | Tank soln. (g) | Replenisher (g) |
|---|---|---|
| Aq. soln. of ammonium thiosulfate (750 g/L) | 240 mL | 720 mL |
| Imidazole | 7 | 21 |
| Ammonium methanethiosulfonate | 5 | 15 |
| Ammonium methanesulfinate | 10 | 30 |

-continued

| (Fixing (2)) | Tank soln. (g) | Replenisher (g) |
|---|---|---|
| Ethylenediaminetetraacetic acid | 13 | 39 |
| Water | q.s. ad 1.0 L | |
| pH | 7.4 | 7.45 |

This pH was adjusted by the use of aqueous ammonia and acetic acid.

(Washing Water)

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

(Stabilizer): Common to Tank Solution and Replenisher. (g)

| | |
|---|---|
| Sodium p-toluenesulfinate | 0.03 |
| Polyoxyethylene p-monononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1,4-bis(1,2,4-triazol-1-ylmethyl)-piperazine | 0.75 |
| Water | q.s. ad 1.0 L |
| pH | 8.5 |

The density of each processed sample was measured by the use of a red filter. The sensitivity was read as a relative value of inverse of exposure required for reaching a density of fog density plus 0.2. Further, each exposed sample was stored at 50° C. in a relative humidity of 60% for 4 weeks in order to evaluate the aging deterioration (storage life) thereof. Consequently, the same results as in Examples 1 to 5 were obtained with respect to samples 101 to 106. With respect to sample 107, it was found that regular processing could not be carried out because of the precipitation of Ca salt.

Example 8

Demonstration of Embodiment VIII (2)-2, with a Use of Multi-layered System

Samples 221 multi-ralayered system (demonstration of Embodiment VIII (2)02, with a used of system to 223 were prepared in the same manner as in Example 7, except that the emulsion of the 6th layer of sample 102 used in Example 7 was replaced by each of Em-1-DG to Em-1-DI prepared in Example 6. Each of the samples was subjected to the same exposure and development processing as in Example 7. The density of each processed sample was measured by the use of a red filter. The sensitivity was read with the use of a relative value of fog density plus 0.2.

Further, each exposed sample was stored at 50° C. in a relative humidity of 60% for 3 weeks in order to evaluate the aging deterioration (storage life) thereof.

TABLE 11

| No. | Sample (emulsion) | Compd. | Addn. amt. (mol/mol Ag) | Rel. sensitivity | RMS | Δ fog | Relation with invention |
|---|---|---|---|---|---|---|---|
| 1 | 102 (Em-1-D) | Compd. 2 (=II-1-1) | $2.6 \times 10^{-4}$ | 100 | 100 | 0.13 | Invention (not corresponding to Embodiment VIII) |
| 2 | 221 (Em-1-DG) | II-1-2<br>STO-A | $2.1 \times 10^{-4}$<br>$0.5 \times 10^{-4}$ | 100 | 87 | 0.09 | Invention (not corresponding to Embodiment VIII) |
| 3 | 222 (Em-1-DH) | II-1-1<br>II-2-1 | $2.1 \times 10^{-4}$<br>$0.5 \times 10^{-4}$ | 100 | 101 | 0.10 | Invention (corresponding to Embodiment VIII) |
| 4 | 223 (Em-1-DI) | II-1-2<br>II-2-1 | $2.1 \times 10^{-4}$<br>$0.5 \times 10^{-4}$ | 98 | 100 | 0.10 | Invention (corresponding to Embodiment VIII) |

As apparent from Table 11, the joint use of two compounds according to the present invention was superior to conventional compound 2 (compound example II-1-1) in the inhibition of fog increase during storage. It was found that any sensitivity drop and RMS granularity deterioration did not occur during the storage. On the other hand, it has become apparent that the conventional joint use of compound example II-1-1 described in JP-A-4-16838 and comparative compound STO-A invites a sensitivity drop when used in high-speed emulsions such as that of the present invention.

Moreover, samples 231 to 233 were prepared in the same manner as in Example 7, except that the emulsion of the 6th layer of sample 103 used in Example 7 was replaced by each of Em-5-BA to Em-5-BC prepared in Example 6.

Further, samples 241 to 243 were prepared in the same manner as in Example 7, except that the emulsion of the 6th layer of sample 104 used in Example 7 was replaced by each of Em-12-AA to Em-12-AC prepared in Example 6.

Still further, samples 251 to 253 were prepared in the same manner as in Example 7, except that the emulsion of the 6th layer of sample 105 used in Example 7 was replaced by each of Em-8-BA to Em-8-BC prepared in Example 6.

Still further, samples 261 to 263 were prepared in the same manner as in Example 7, except that the emulsion of the 6th layer of sample 106 used in Example 7 was replaced by each of Em-9-AA to Em-9-AC prepared in Example 6.

These samples were subjected to the same experiment as the samples 102 and 221 to 223. The same results as described above were obtained.

Example 9

Demonstration of Embodiment VIII (1)

Samples were prepared by adding compounds specified in Table 12 to the 7th layer of sample 102 used in Example 7 and cut into a 24 mm width and a 160 cm length, which was furnished with two 2 mm square perforations disposed at an interval of 5.8 mm at 0.7 mm from one lateral side in the lengthwise direction of the lightsensitive material. Sets of these two were provided at intervals of 32 mm, and each of the cut samples was accommodated in plastic-made film cartridge shown in FIGS. 1 to 7 of U.S. Pat. No. 5,296,887, the disclosure of which is herein incorporated by reference.

Digital saturated recording of 50 $\mu$m recording wavelength was performed at a feed speed of 100 mm/sec with the use of an audio-type magnetic recording head of Permalloy material (head gap: 5 $\mu$m and turn: 50) on each sample from its magnetic recording layer coating side.

These samples were subjected to gray exposure of 4800 K color temperature and 5 cms, and the following development processing was carried out by means of a cinema automatic processor. Further, 5-day running processing was performed for 2 $m^2$ per day of the lightsensitive material. The running processed samples were returned into the plastic-made film cartridges.

(Processing Steps)

| Step | Time | Temp. (centigrade) | Replenishment rate* | Tank vol. |
|---|---|---|---|---|
| Color development | 3 min 5 sec | 38.0 | 390 mL/$m^2$ | 17 L |
| Bleaching | 50 sec | 38.0 | 130 mL/$m^2$ | 5 L |
| Fixing (1) | 50 sec | 38.0 | — | 5 L |
| Fixing (2) | 50 sec | 38.0 | 260 mL/$m^2$ | 5 L |
| Water washing | 30 sec | 38.0 | 500 mL/$m^2$ | 3.5 L |
| Stabilization (1) | 20 sec | 38.0 | — | 3 L |
| Stabilization (2) | 20 sec | 38.0 | 500 mL/$m^2$ | 3 L |
| Drying | 90 sec | 60 | | |

The stabilizer was fed from stabilization (2) to stabilization (1) by counter current, and the fixer was also fed from fixing (2) to fixing (1) by counter current. All the overflow of washing water was introduced into the fixing bath. The amounts of drag-in of color developer into the bleaching step, drag-in of bleaching solution into the fixing step and drag-in of fixer into the water washing step were 65 mL, 50 mL and 50 mL, respectively, per $m^2$ of a 35-mm wide lightsensitive material. Each crossover time was 6 sec, which was included in the processing time of the previous step.

The composition of each of the processing solutions was as follows.

| (Color developer) | Tank soln. (g) | Replenisher (g) |
|---|---|---|
| Diethylenetriamine-pentaacetic acid | 3.0 | 3.0 |
| Tyron | 0.3 | 0.3 |
| Sodium sulfite | 3.9 | 5.3 |
| Potassium carbonate | 39.0 | 39.0 |
| Disodium-N,N-bis(2-sulfonatoethyl)hydroxylamine | 10.0 | 13.0 |
| Potassium bromide | 1.25 | 0.4 |

-continued

| (Color developer) | Tank soln. (g) | Replenisher (g) |
|---|---|---|
| Potassium iodide | 1.3 mg | — |
| 4-Hydroxy-6-methyl-1,3,3a,7-tetrazaindene | 0.05 | — |
| 2-Methyl-4-[N-ethyl-N-(β-hydroxyethyl)amino]-aniline sulfate | 4.5 | 6.5 |
| Water | q.s. ad 1.0 L | |
| pH | 10.05 | 10.18 |

This pH was adjusted by the use of potassium hydroxide and sulfuric acid.

| (Bleaching soln.) | Tank soln. (g) | Replenisher (g) |
|---|---|---|
| Fe(III) ammonium 1,3-propane-diaminetetraacetate | 113.0 | 170.0 |
| Ammonium bromide | 70.0 | 105.0 |
| Ammonium nitrate | 14.0 | 21.0 |
| Succinic acid | 34.0 | 51.0 |
| Maleic acid | 28.0 | 42.0 |
| Water | q.s. ad 1000 mL | |
| pH | 4.6 | 4.0 |

This pH was adjusted by the use of aqueous ammonia and nitric acid.

(Fixing (1) Tank Soln.)

5:95 (by volume) mixture of the above bleaching tank soln. and the following fixing tank soln, pH 6.8.

| (Fixer (2)) | Tank soln. (g) | Replenisher (g) |
|---|---|---|
| Aq. soln. of ammonium thiosulfate (750 g/L) | 240.0 mL | 720.0 mL |
| Ammonium methanethiosulfonate | 5.0 | 15.0 |
| Ammonium methanesulfinate | 10.0 | 30.0 |
| Ethylenediaminetetraacetic acid | 13.0 | 39.0 |
| Imidazole | 7.0 | 21.0 |
| Water | q.s. ad 1000 mL | |
| pH | 7.4 | 7.5 |

This pH was adjusted by the use of aqueous ammonia and acetic acid.

(Washing Water) Common to Tank Soln. and Replenisher

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

(Stabilizer): Common to Tank Solution and Replenisher.

| | |
|---|---|
| 1,4-bis(1,2,4-triazol-1-ylmethyl)-piperazine | 0.75 g |
| 1,2,4-triazole | 1.3 g |
| Polyoxyethylene p-monononylphenyl ether (average polymerization degree 10) | 0.2 g |
| Disodium ethylenediaminetetraacetate | 0.05 g |
| Sodium p-toluenesulfinate | 0.03 g |
| Sodium salt of 1,2-benzoisothiazolin-3-one | 0.10 g |
| Gentamicin | 0.01 g |
| Water | q.s. ad 1 L |
| pH | 8.5 |

This pH was adjusted by the use of aqueous ammonia and nitric acid.

The following experiment was performed for the evaluation of storage life without conducting any running processing. Unexposed samples were stored at 50° C. in a relative humidity of 50% for 4 weeks. These samples together with like samples stored at 5° C. for 4 weeks were subjected to 1/100 sec exposure for sensitometry through continuous wedge at a color temperature of 4800 K and subsequently to the above color development processing. Thereafter, the density was measured, thereby determining the difference between the fog value of 50° C. stored sample and the fog value of 5° C. stored sample (Δfog1).

Further, samples stored at 50° C. in a relative humidity of 80% for 4 weeks and like samples stored at 5° C. for 4 weeks were processed in the same manner, thereby determining the fog value difference (Δfog2). The results are given in Table 12.

With respect to the lightsensitive materials having undergone the aforementioned running processing, the change between cyan minimum densities before and after development processing running was evaluated by the following method.

<Measuring of Cyan Minimum Density>

With respect to the measuring of the gradation of light-sensitive material, the cyan minimum density changes in characteristic curves in the initial stage of running and after running were read, thereby determining the density difference.

$$(\Delta D\text{min})=(\text{cyan minimum density after running})-(\text{cyan minimum density in the initial stage of running}).$$

The greater the plus value, the greater the density increase.

The results, together with the results of storage life, are given in Table 12.

TABLE 12

| Sample No. | Relation with invention | Relation with claim | Compd. incorporated in 7th layer | Addn. amt. (mol/m$^2$) | Δ fog1 (cyan) (fog increase by storage at rel. humidity 50%, 50° C.) | Δ fog2 (cyan) (fog increase by storage at rel. humidity 80%, 50° C.) | Δ Dmin (pre-running/post-running change of cyan minimum density) |
|---|---|---|---|---|---|---|---|
| 301 | invention | not satisfy requirement (1) of | none added | 0 | 0.23 | 0.28 | 0.01 |

TABLE 12-continued

| Sample No. | Relation with invention | Relation with claim | Compd. incorporated in 7th layer | Addn. amt. (mol/m$^2$) | Δ fog1 (cyan) (fog increase by storage at rel. humidity 50%, 50° C.) | Δ fog2 (cyan) (fog increase by storage at rel. humidity 80%, 50° C.) | Δ Dmin (pre-running/ post-running change of cyan minimum density) |
|---|---|---|---|---|---|---|---|
| 302 | invention | Embodiment VIII not satisfy requirement (1) of Embodiment VIII | comp. compd. A | $6 \times 10^{-6}$ | 0.20 | 0.28 | 0.11 |
| 303 | invention | Embodiment VIII not satisfy requirement (1) of Embodiment VIII | comp. compd. B | $6 \times 10^{-6}$ | 0.20 | 0.28 | 0.11 |
| 304 | invention | Embodiment VIII not satisfy requirement (1) of Embodiment VIII | comp. compd. C | $6 \times 10^{-6}$ | 0.21 | 0.29 | 0.14 |
| 305 | invention | Embodiment VIII not satisfy requirement (1) of Embodiment VIII | comp. compd. D | $6 \times 10^{-6}$ | 0.20 | 0.28 | 0.12 |
| 306 | invention | Embodiment VIII not satisfy requirement (1) of Embodiment VIII | comp. compd. E | $6 \times 10^{-6}$ | 0.20 | 0.28 | 0.13 |
| 307 | invention | Embodiment VIII not satisfy requirement (1) of Embodiment VIII samples from 308 on satisfy requirement (1) of Embodiment VIII | $Na_2PdCl_4$ | $2 \times 10^{-6}$ | 0.20 | 0.25 | 0.01 |
| 308 | invention | corresponding to Embodiment IX | I-2-1 | $6 \times 10^{-6}$ | 0.12 | 0.14 | 0.01 |
| 309 | invention | corresponding to Embodiment IX | I-2-2 | $6 \times 10^{-6}$ | 0.12 | 0.14 | 0.00 |
| 310 | invention | corresponding to Embodiment IX | I-2-3 | $6 \times 10^{-6}$ | 0.12 | 0.14 | 0.01 |
| 311 | invention | corresponding to Embodiment IX | I-2-4 | $6 \times 10^{-6}$ | 0.14 | 0.16 | 0.01 |
| 312 | invention | corresponding to Embodiment IX | I-2-5 | $6 \times 10^{-6}$ | 0.12 | 0.15 | −0.01 |
| 313 | invention | corresponding to Embodiment IX | I-2-6 | $6 \times 10^{-6}$ | 0.13 | 0.14 | 0.01 |
| 314 | invention | corresponding to Embodiment IX | I-2-7 | $6 \times 10^{-6}$ | 0.14 | 0.16 | 0.00 |
| 315 | invention | corresponding to Embodiment IX | I-2-10 | $6 \times 10^{-6}$ | 0.14 | 0.17 | 0.01 |
| 316 | invention | corresponding to Embodiment IX | I-2-16 | $6 \times 10^{-6}$ | 0.14 | 0.16 | 0.00 |
| 317 | invention | not corresponding to Embodiment IX | I-1-1 | $6 \times 10^{-6}$ | 0.16 | 0.20 | 0.02 |
| 318 | invention | not corresponding to Embodiment IX | I-1-2 | $6 \times 10^{-6}$ | 0.17 | 0.21 | 0.01 |
| 319 | invention | not corresponding to Embodiment IX | I-1-3 | $6 \times 10^{-6}$ | 0.17 | 0.21 | 0.01 |

The Table 12 shows the following with respect to storage life.

It is apparent that the use of the compounds of the present invention enables inhibiting the storage fogging by aging (samples 301, 308 to 319).

The effect thereof is far superior to the known storage improving effect of comparative compounds A, B, C, D and E (samples 302 to 306). In particular, in high humidity, although the use of the comparative compounds A, B, C, D and E cannot suppress the storage fogging, the use of the compounds of the present invention have exerted striking storage life enhancing effect.

It has been studied whether or not the viscosity of the gelatin solution for the 7th layer before coating is changed by the addition of the compounds I-1-1, I-1-3, I-2-2, I-2-3 and I-2-5 of the present invention. However, no viscosity rise was observed. On the other hand, when $Na_2PdCl_4$ (compound described in JP-A-5-333480, the disclosure of which is herein incorporated by reference) was added in an amount equivalent to $6\times10^{-6}$ mol/m$^2$ to the coating solution for the 7th layer, the viscosity increase was large so that part thereof agglomerated to thereby disenable preparing a homogeneous coating solution. When the addition amount of the $Na_2PdCl_4$ was $2\times10^{-6}$ mol/m$^2$, although the solution was applicable, the effect of inhibiting the storage fogging was slight (sample 307). Thus, the use of $Na_2PdCl_4$ cannot be advantageous in both the viscosity increase problem and the storage life improvement.

The structure of each of the comparative compounds A to E of Table 12 (compounds described in JP-A-8-234341, the disclosure of which is herein incorporated by reference) is shown below.

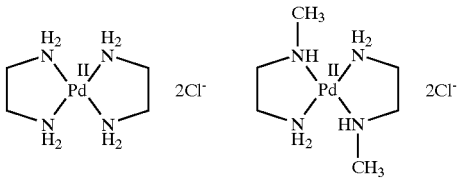

Comparative Compound C

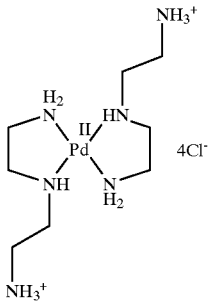

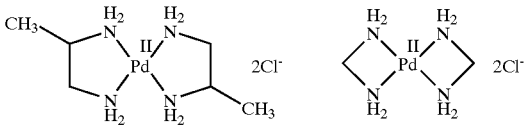

With respect to the change between cyan minimum densities before and after development processing running, the following is apparent from Table 12.

It is apparent that, when the compounds of the present invention are used, there is no increase of the cyan minimum density after development processing running (samples 301, 308 to 319).

By contrast, when known comparative compounds A to E are used, the cyan minimum density after running was increased (samples 302 to 306).

Furthermore, like the above experiment, compounds set forth in Table 12 were incorporated in the 7th layer of samples 103 to 106 used in Example 7 to thereby obtain samples, which were subjected to the same storage life and running experiment as in the above experiment. Consequently, the same results as described above were obtained.

Example 10

In the same manner as in Example 7, 135-format samples were prepared using a cellulose triacetate film support in place of the PEN support, which samples were subjected to the same performance evaluation as in Example 7.

Consequently, the same results as in Example 7 were obtained.

Example 11

In Examples 7 and 8, the amount of thiocyanate ions incorporated in the lightsensitive material is $2.3\times10^{-3}$ mol per mol of silver. In this Example, a sample in which the addition amount of thiocyanate ions in all the emulsion layers was changed to 1.2-fold, viz. $2.53\times10^{-3}$ mol per mol of silver, was prepared (sample 401). Also, another sample in which the addition amount was changed to 0.75-fold, viz. $1.73\times10^{-3}$ mol per mol of silver, was prepared (sample 402).

These samples, together with the sample 222 prepared in Example 8, were evaluated in the same manner as in Example 8. The results are given in Table 13.

TABLE 13

| No. | Sample | Addn. amt. of KSCN mol/mol Ag | Rel. sensitivity | ΔFog | Relation with invention (remark) |
|---|---|---|---|---|---|
| 1 | 222 | $2.3 \times 10^{-3}$ | 100 | 0.10 | Invention (satisfy requirement (3) of Embodiment VIII) |
| 2 | 401 | $2.53 \times 10^{-3}$ | 100 | 0.13 | Invention (not satisfy requirement (3) of Embodiment VIII) |
| 3 | 402 | $1.73 \times 10^{-3}$ | 98 | 0.08 | Invention (satisfy requirement (3) of Embodiment VIII) |

It is apparent from Table 13 that the sample 222 in which the addition amount of thiocyanate ions is $2.3\times10^{-3}$ mol per mol of silver exhibits a fog increase during storage which is less than that of the sample 401 in which the addition amount of thiocyanate ions was $2.53\times10^{-3}$ mol per mol of silver. It is also apparent that the sample 402 in which the addition amount was $1.73\times10^{-3}$ mol per mol of silver is still superior to the sample 222 in storage life.

Example 12

Samples were prepared and processed in the same manner as in Example 7, except that the following compounds were employed in place of HBS-1 to HBS-4. The same results as in Example 7 were obtained.

| $O = P(—OAr)_3$ Ar = | |
|---|---|
| (1) | 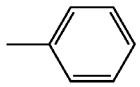 |
| (2) | 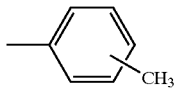 |
| (3) | 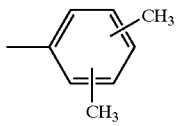 |
| (4) | 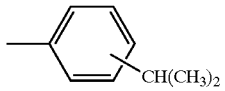 |
| (5) | 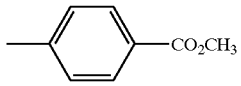 |
| (6) | $-n-C_4H_9$ |
| (7) | $-n-C_6H_{13}$ |
| (8) | $—CH_2CH(C_2H_5)CH_2CH_2CH_2CH_3$ (herein after abbreviated to 2EH) |
| (9) | $—CH_2CH(CH_3)CH_2C(CH_3)_3$ |

-continued

| | |
|---|---|
| (10) | -n-$C_{12}H_{25}$ |

Ar =

| | |
|---|---|
| (11) | —$(CH_2)_8CH{=}CH(CH_2)_7CH_3$ |
| (12) | -n-$C_{16}H_{33}$ |
| (13) | —$CH(CH_3)CH_2Cl$ |
| (14) | —$CH_2CH_2Cl$ |
| (15) | —$CH_2CH_2O$-n-$C_4H_9$ |
| (16) | —$CH_2CHClCH_2Cl$ |
| (17) | —$CH(CH_2Cl)_2$ |
| (18) | —$CH_2C(CH_2Br)_3$ |

(19)

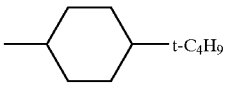

(20)

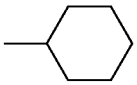

(21)

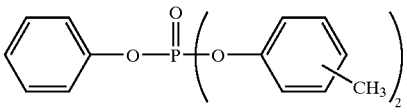

(22)

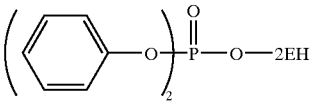

(23)

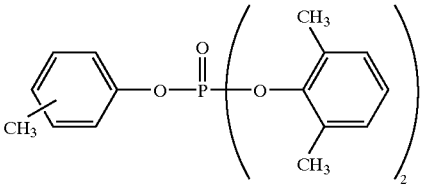

RA—OCO$(CH_2)_r$—$CO_2$RA

| | RA = | r = |
|---|---|---|
| (24) | -n-$C_8H_{17}$ | 7 |
| (25) | —$CH_3$ | 8 |
| (26) | -n-$C_4H_9$ | 8 |
| (27) | -n-$C_8H_{17}$ | 8 |
| (28) | -n-$C_8H_{17}$ | 4 |
| (29) | -i-$C_9H_{19}$ | 4 |
| (30) | -n-$C_4H_9$ | 4 |
| (31) | —$CH(CH_3)_2$ | 4 |
| (32) | —2EH | 4 |
| (33) | —$C_{10}H_{21}$ | 4 |
| (34) | —$CH_2CH_2OCH_2CH_2O$-n-$C_4H_9$ | 4 |

(35)

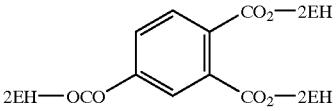

(36)

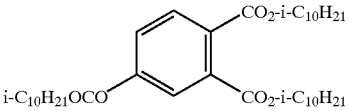

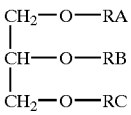

-continued

| | RA = | RB = | RC = |
|---|---|---|---|
| (37) | —$COCH_3$ | —$COCH_3$ | —CO-n-$C_{13}H_{27}$ |
| (38) | —$COCH_3$ | —$COCH_3$ | —CO-n-$C_{15}H_{31}$ |
| (39) | —$COCH_3$ | —$COCH_3$ | —CO-n-$C_{17}H_{35}$ |
| (40) | —$COCH_3$ | —H | —CO-n-$C_{17}H_{35}$ |
| (41) | —CO-n-$C_9H_{19}$ | —CO-n-$C_9H_{19}$ | —CO-n-$C_9H_{19}$ |
| (42) | H | H | —CO-n-$C_{13}H_{27}$ |
| (43) | H | H | —CO-n-$C_{15}H_{31}$ |
| (44) | H | H | —CO-n-$C_{17}H_{35}$ |
| (45) | H | H | —CO-n-$C_{17}H_{33}$ (oleyl) |

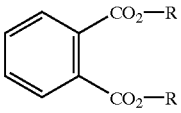

R =

| | |
|---|---|
| (46) | -n-$C_4H_9$ |
| (47) | -i-$C_7H_{15}$ |
| (48) | —2EH |
| (49) | -n-$C_{12}H_{25}$ |
| (50) | —$C(C_2H_5)_3$ |

(51)

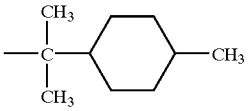

(52)

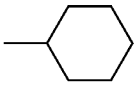

(53)

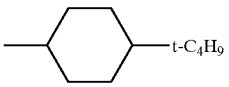

| | |
|---|---|
| (54) | -n-$C_8H_{17}$ |
| (55) | -$CH_2CH_2CH(CH_3)CH_2CH_2CH_2CH(CH_3)_2$ |
| (56) | -i-$C_{10}H_{21}$ |
| (57) | -i-$C_9H_{19}$ |
| (58) | -i-$C_{11}H_{23}$ |
| (59) | -n-$C_5H_{11}$ |
| (60) | -n-$C_6H_{13}$ |
| (61) | -n-$C_3H_7$ |

(62)

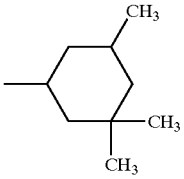

(63)

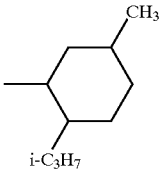

(64) —$CH_2CH_2O$-n-$C_4H_9$ (65)

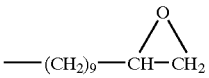

-continued
(66) $—CH_2CF_2CF_2CF_2CF_2H$
(67)
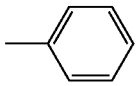
(68)
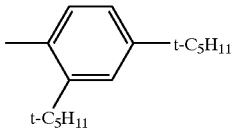
(69)
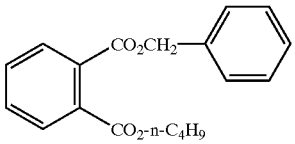
(70)
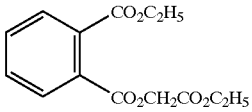
(71) $n\text{-}C_{17}H_{33}CO_2\text{-}n\text{-}C_4H_9$
(72) $n\text{-}C_5H_{11}CO_2(OCH_2)_3OCO\text{-}n\text{-}C_5H_{11}$
(73)
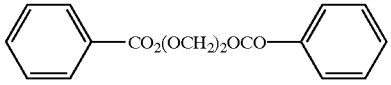
(74) $CH_3CO_2C(CH_2CO_2\text{-}n\text{-}C_4H_9)_3$
(75) $CH_3(CH_2)_5CH(OCOCH_3)CH_2CH{=}CH(CH_2)_7CO_2CH_3$
(76) $CH_3(CH_2)_5CH(OCOCH_3)CH_2CH{=}CH(CH_2)_7CO_2\text{-}n\text{-}C_4H_9$
(77) $n\text{-}C_4H_9OCO(CH_2)_6CO_2CH_2CO_2\text{-}n\text{-}C_4H_9$
(78)
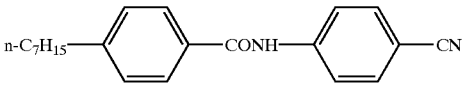
(79)
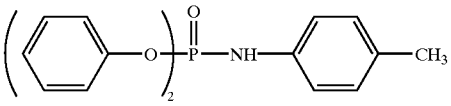
(80)
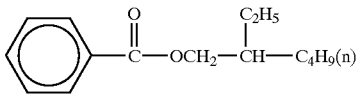
(81)
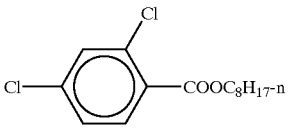
(82)
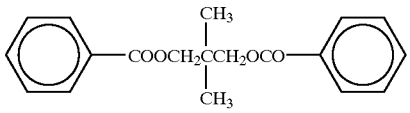
(83)
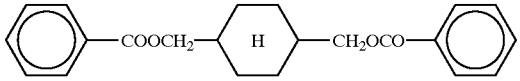
-continued
(84)
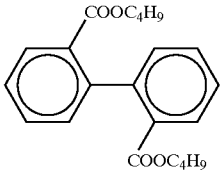
(85) $n\text{-}C_{15}H_{31}COOC_{16}H_{33}\text{-}n$
(86)
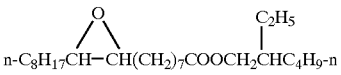
(87)
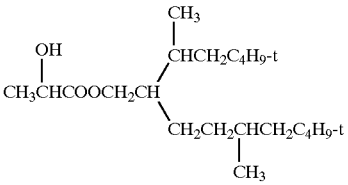
(88)
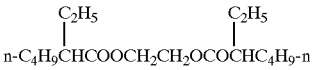
(89)
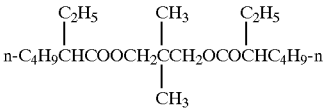
(90)
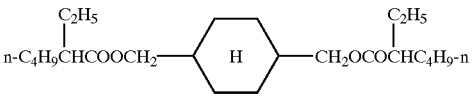
(91)
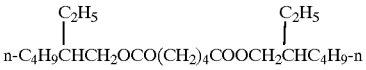
(92)
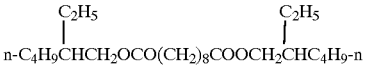
(93)
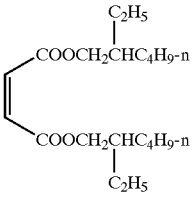
(94)
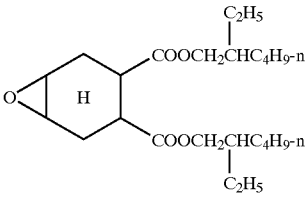
(95)
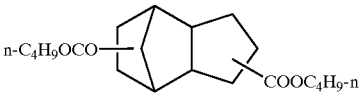

-continued
(96)
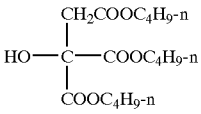
(97)
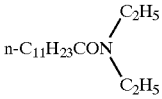
(98)
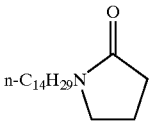
(99)
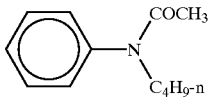
(100)
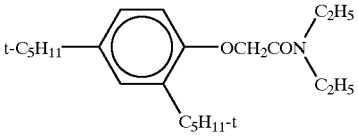
(101)
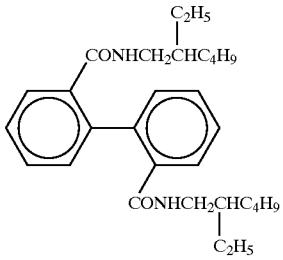
(102)
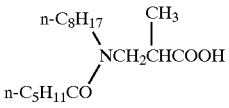
(103)
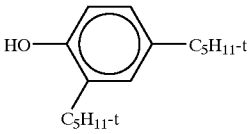
(104)
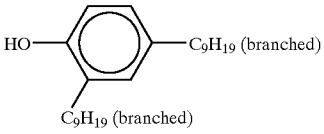
(105)
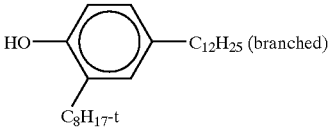
-continued
(106)
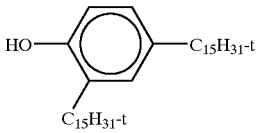
(107)
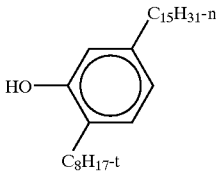
(108)
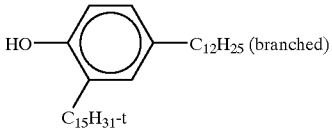
(109)
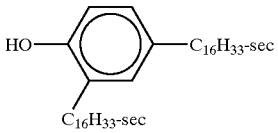
(110)
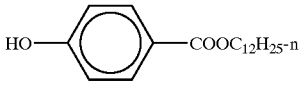
(111)
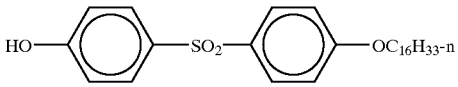
(112)
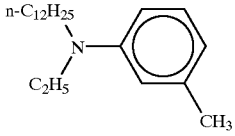
(113)
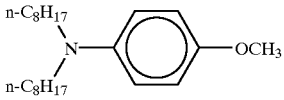
(114)
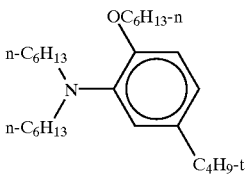
(115)
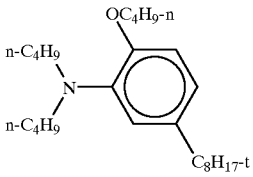

-continued (116)

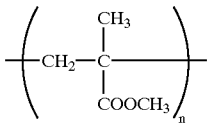

(Average mol. wt. 20,000)

(117)

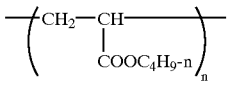

(Average mol. wt. 50,000)

(118)

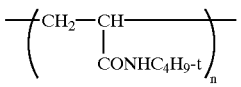

(Average mol. wt. 60,000)

(119)

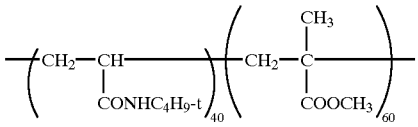

(Average mol. wt. 40,000)

(120)

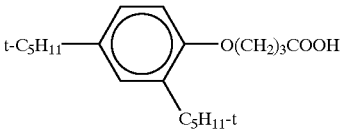

(121)

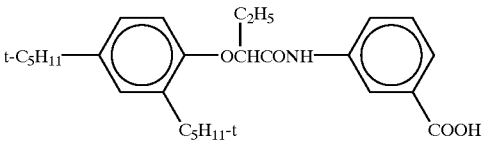

(122)

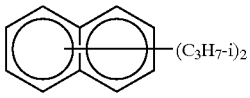

(123) $C_nH_{2n+2}$
(Normal-paraffin A mixture of n = 14 and n = 15)

(124)

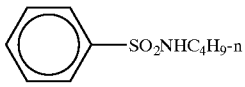

(125)

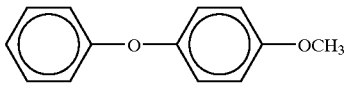

(126)

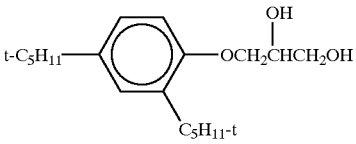

(127) Chlorinated paraffin
(Average composition $C_{14}H_{24}Cl_6$)
(128) Chlorinated paraffin
(Average composition $C_{12}H_{18}Cl_8$)
(129) Poly(chlorotrifluoroethylene)
(Average mol. wt. 900)

(130)

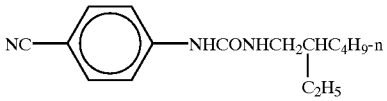

(131)

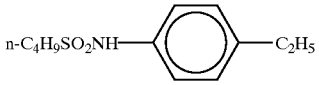

(132)

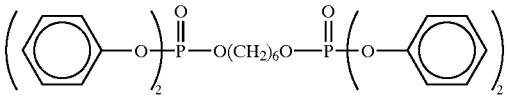

(133)

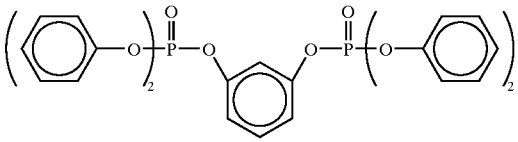

Example 13

Samples like samples 301 and 307 to 313 were prepared in the same manner as in Example 9, except that the undercoated support was replaced by the following.

1) First Layer and Subbing Layer:

Both major surfaces of a 90 μm thick polyethylene naphthalate support were treated with glow discharge under such conditions that the treating ambient pressure was 0.2 Torr, the $H_2O$ partial pressure of ambient gas 75%, the discharge frequency 30 kHz, the output 2500 W, and the treating strength 0.5 kV·A·min/m$^2$. This support was coated, in a coating amount of 5 mL/m$^2$, with a coating liquid of the following composition to provide the 1st layer in accordance with the bar coating method described in JP-B-58-4589, the disclosure of which is herein incorporated by reference.

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts.wt. |
| Gelatin | 0.5 pt.wt. |
| Water | 49 pts.wt. |
| Polyglycerol polyglycidyl ether | 0.16 pt.wt. |
| Polyoxyethylene sorbitan monolaurate (polymn. degree 20) | 0.1 pt.wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/m$^2$, with a coating liquid of the following composition to provide a subbing layer for emulsion in accordance with the bar coating method.

| | |
|---|---|
| Gelatin | 1.01 pts.wt. |
| Salicylic acid | 0.30 pt.wt. |
| Resorcin | 0.40 pt.wt. |

-continued

| | |
|---|---|
| Polyoxyethylene nonylphenyl ether (polymn. degree 10) | 0.11 pt.wt. |
| Water | 3.53 pts.wt. |
| Methanol | 84.57 pts.wt. |
| n-Propanol | 10.08 pts.wt. |

Furthermore, the following second layer and third layer were superimposed in this sequence on the first layer by coating. Finally, multilayer coating of a color negative lightsensitive material of the composition indicated below was coated on the opposite side. Thus, a transparent magnetic recording medium with silver halide emulsion layer was obtained.

2) Second Layer (Transparent Magnetic Recording Layer):

(1) Dispersion of Magnetic Substance:

1100 parts by weight of Co-coated $\gamma$-$Fe_2O_3$ magnetic substance (average major axis length: 0.25 $\mu$m, $S_{BET}$: 39 $m^2/g$, Hc: 831, Oe, $\sigma s$: 77.1 emu/g, and $\sigma r$: 37.4 emu/g), 220 parts by weight of water and 165 parts by weight of silane coupling agent 3-Poly(polymerization Degree:

10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following formulation, a composition was prepared by blending by means of the open kneader once more for 4 hr:

| | |
|---|---|
| Above obtained surface treated magnetic grains | 855 g |
| Diacetylcellulose | 25.3 g |
| Methyl ethyl ketone | 136.3 g |
| Cyclohexanone | 136.3 g. |

Still further, in accordance with the following formulation, a composition was prepared by carrying out fine dispersion by means of a sand mill (¼G sand mill) at 2000 rpm for 4 hr. Glass beads of 1 mm diameter were used as medium.

| | |
|---|---|
| Above obtained blend liquid | 45 g |
| Diacetylcellulose | 23.7 g |
| Methyl ethyl ketone | 127.7 g |
| Cyclohexanone | 127.7 g. |

Moreover, in accordance with the following formulation, a magnetic substance containing intermediate liquid was prepared.

(2) Preparation of Magnetic Substance Containing Intermediate Liquid:

| | |
|---|---|
| Above obtained fine dispersion of magnetic substance | 674 g |
| Diacetylcellulose soln. (solid content 4.34%, solvent: methyl ethyl ketone/cyclohexanone = 1/1) | 24,280 g |
| Cyclohexanone | 46 g. |

These were mixed together and agitated by means of a disperser to thereby obtain a "magnetic substance containing intermediate liquid".

An $\alpha$-alumina abrasive dispersion of the present invention was produced in accordance with the following formulation.

(a) Preparation of Sumicorundum AA-1.5 (Average Primary Grain Diameter: 1.5 $\mu$m, Specific Surface Area: 1.3 $m^2/g$) Grain Dispersion

| | |
|---|---|
| Sumicorundum AA-1.5 | 152 g |
| Silane coupling agent KBM903 (produced by Shin-Etsu Silicone) | 0.48 g |
| Diacetylcellulose soln. (solid content 4.5%, solvent: methyl ethyl ketone/cyclohexanone = 1/1) | 227.52 g. |

In accordance with the above formulation, fine dispersion was carried out by means of a ceramic-coated sand mill (¼G sand mill) at 800 rpm for 4 hr. Zirconia beads of 1 mm diameter were used as medium.

(b) Colloidal Silica Grain Dispersion (Fine Grains)

Use was made of "MEK-ST" produced by Nissan Chemical Industries, Ltd.

This is a dispersion of colloidal silica of 0.015 $\mu$m average primary grain diameter in methyl ethyl ketone as a dispersion medium, wherein the solid content is 30%.

(3) Preparation of a Coating Liquid for Second Layer:

| | |
|---|---|
| Thus obtained magnetic substance containing intermediate liquid | 19,053 g |
| Diacetylcellulose soln. (solid content 4.5%, solvent: methyl ethyl ketone/cyclohexanone = 1/1) | 264 g |
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) diluent (solid content 20%, dilution solvent: methyl ethyl ketone/cyclohexanone = 1/1) | 203 g |
| Methyl ethyl ketone | 170 g |
| Cyclohexanone | 170 g. |

A coating liquid obtained by mixing and agitating these was applied in a coating amount of 29.3 $mL/m^2$ with the use of a wire bar. Drying was performed at 110° C. The thickness of magnetic layer after drying was 1.0 $\mu$m.

3) Third Layer (Higher Fatty Acid Ester Sliding Agent Containing Layer)

(1) Preparation of Raw Dispersion of Sliding Agent

The following liquid A was heated at 100° C. to thereby effect dissolution, added to liquid B and dispersed by means of a high-voltage homogenizer, thereby obtaining a raw dispersion of sliding agent.

| Liquid A | |
|---|---|
| Compd. of the formula: $C_6H_{13}CH(OH)(CH_2)_{10}COOC_{50}H_{101}$ | 399 pts.wt. |
| Compd. of the formula: n-$C_{50}H_{101}O(CH_2CH_2O)_{16}H$ | 171 pts.wt. |
| Cyclohexanone | 830 pts.wt. |
| Liquid B | |
| Cyclohexanone | 8600 pts.wt. |

(2) Preparation of Spherical Inorganic Grain Dispersion

Spherical inorganic grain dispersion (c1) was prepared in accordance with the following formulation.

| | |
|---|---|
| Isopropyl alcohol | 93.54 pts. wt. |
| Silane coupling agent KBM903 (produced by Shin-Etsu Silicone) Compd. 1-1: $(CH_3O)_3Si—(CH_2)_3—NH_2$) | 5.53 pts. wt. |
| Compd. 2-1 | 2.93 pts. wt. |

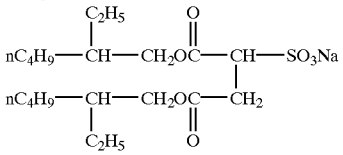

Seahostar KEP50 (amorphous spherical silica, av. grain size 0.5 μm, produced by Nippon Shokubai Kagaku Kogyo 88.00 pts.wt.

This composition was agitated for 10 min, and further the following was added.

Diacetone alcohol 252.93 pts.wt.

The resultant liquid was dispersed by means of ultrasonic homogenizer "Sonifier 450 (manufactured by Branson)" for 3 hr while cooling with ice and stirring, thereby finishing spherical inorganic grain dispersion c1.

(3) Preparation of Spherical Organic Polymer Grain Dispersion

Spherical organic polymer grain dispersion (c2) was prepared in accordance with the following formulation.

| | |
|---|---|
| XC99-A8808 (produced by Toshiba Silicone Co., Ltd., spherical crosslinked polysiloxane grain, av. grain size 0.9 μm) | 60 pts.wt. |
| Methyl ethyl ketone | 120 pts.wt. |
| Cyclohexanone | 120 pts.wt. |
| (solid content 20%, solvent: methyl ethyl ketone/cyclohexanone = 1/1) | |

This mixture was dispersed by means of ultrasonic homogenizer "Sonifier 450 (manufactured by Branson)" for 2 hr while cooling with ice and stirring, thereby finishing spherical organic polymer grain dispersion c2.

(4) Preparation of Coating Liquid for 3rd Layer

A coating liquid for 3rd layer was prepared by adding the following components to 542 g of the aforementioned raw dispersion of sliding agent:

| | |
|---|---|
| Diacetone alcohol | 5950 g |
| Cyclohexanone | 176 g |
| Ethyl acetate | 1700 g |
| Above Seahostar KEP50 dispersion (c1) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g. |

This coating liquid for 3rd layer was applied onto the 2nd layer in a coating amount of 10.35 mL/m$^2$, dried at 110° C. and after-dried at 97° C. for 3 min.

The thus obtained sample was subjected to the same performance evaluation as in Example 9. The same results as in Example 9 were obtained.

Example 14

The same effects as in Examples 1 to 5 and 7 can be exerted by using each of the emulsions Em-1-B, Em-1-D, Em-5-B, Em-8-A, Em-8-B and Em-9-A produced in Examples 1 to 5 and emulsions Em-1-DA to Em-1-DC produced in Example 7 in the 6th layer of sample 201 described in Example 2 of JP-A-9-5912, the disclosure of which is herein incorporated by reference, to thereby produce silver halide color reversal photographic lightsensitive materials and by subjecting them to the color reversal processing described in Example 1 of JP-A-9-5912.

Example 15

The same results as in Example 9 can be obtained by incorporating each of the compounds listed in Table 12 in the 7th layer of the silver halide color reversal photographic lightsensitive material of Example 14 to thereby produce samples and by subjecting the samples to the color reversal processing described in Example 1 of JP-A-9-5912.

Example 16

The same effects as in Examples 1 to 5 and 7 can be exerted by using each of the emulsions Em-1-B, Em-1-D, Em-5-B, Em-8-A, Em-8-B and Em-9-A produced in Examples 1 to 5 and emulsions Em-1-DA to Em-1-DC produced in Example 7 in the emulsion layer of photographic material 9 described in Example 1 of JP-A-8-240877, the disclosure of which is herein incorporated by reference, to thereby produce silver halide lightsensitive materials for X-ray and by subjecting them to the processing described in Example 1 of JP-A-8-240877.

Example 17

The same results as in Example 9 can be obtained by incorporating each of the compounds listed in Table 12 in the interlayer of the silver halide lightsensitive material for X-ray of Example 16 to thereby produce samples and by subjecting the samples to the processing described in Example 1 of JP-A-8-240877.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A process for producing a lightsensitive silver halide emulsion comprising silver halide grains, wherein:

the emulsion contains tabular silver halide grains in an amount of at least 50% of the total projected area of all the silver halide grains, the average iodine content of all the silver halide grains is at least 2 mol %, the tabular silver halide grains have at least 10 dislocation lines per grain, and each of the silver halide grains has a twin face spacing of 0.017 μm or less; and the process comprises (step 1) set forth below, and the process comprises a step of performing chemical sensitization so that a selenium sensitizer is added in an amount of $2.5\times10^{-6}$ to $5\times10^{-5}$ mol/mol silver and comprises a step of performing spectral sensitization:

(step 1) performing the spectral sensitization in which a spectral sensitizer is added in the presence of 50 ppm or less of calcium, magnesium and strontium, followed by adding at least one water-soluble salt of a metal selected from the group consisting of calcium, magnesium and strontium, so that the concentration of calcium, magnesium and strontium becomes 100–2500 ppm; and then the chemical sensitization is started.

2. The process according to claim 1, wherein, in the crystal growth step of the silver halide grains, fine silver halide grains containing silver iodide in an amount of at least 95 mol % are formed by mixing together an aqueous solution of a water-soluble silver salt and an aqueous solution of a water-soluble halide by means of a mixer provided outside a reactor vessel for use in the crystal growth and, immediately after the formation of the fine silver halide grains, the fine grains are fed in the reactor vessel for use in the crystal growth.

3. The process according to claim 1, wherein, at the time of the chemical sensitization of the lightsensitive silver halide emulsion, a silver iodobromide emulsion prepared in advance is added and dissolved to thereby effect a shell attachment.

4. The process according to claim 1, wherein at least one complex selected from the group consisting of hexacyanoiron (II) complexes and hexacyanoruthenium complexes is added at the time of grain formation of the lightsensitive silver halide emulsion.

5. The process according to claim 1, wherein, at the time of the chemical sensitization of the lightsensitive silver halide emulsion, a silver iodobromide emulsion prepared in advance is added and dissolved to thereby effect a shell attachment; and at least one complex selected from the group consisting of hexacyanoiron (II) complexes and hexacyanoruthenium complexes is added at the time of grain formation of the lightsensitive silver halide emulsion.

6. The process according to claim 5, wherein, in the crystal growth step of the silver halide grains, fine silver halide grains containing silver iodide in an amount of at least 95 mol % are formed by mixing together an aqueous solution of a water-soluble silver salt and an aqueous solution of a water-soluble halide by means of a mixer provided outside a reactor vessel for use in the crystal growth and, immediately after the formation of the fine silver halide grains, the fine grains are fed in the reactor vessel for use in the crystal growth.

7. A silver halide color photographic lightsensitive material comprising a support and, superimposed thereon, at least one blue-sensitive silver halide emulsion layer containing a yellow coupler, at least one green-sensitive silver halide emulsion layer containing a magenta coupler, at least one red-sensitive silver halide emulsion layer containing a cyan coupler and at least one hydrophilic protective colloid layer;

wherein calcium ions, magnesium ions and strontium ions are contained in a coating amount, in terms of atomic weight, of $8.0\times10^{-2}$ g or less per g of all the gelatin contained in the lightsenstive material; and wherein the emulsion prepared by the process according to claim 1 is contained.

8. The lightsensitive material according to claim 7, wherein the lightsensitive material satisfies the requirement (1) that at least one Pd(II) complex represented by the following general formula (I-1) is contained:

(I-1)

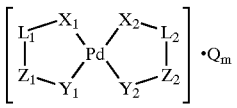

wherein each of $X_1$ and $X_2$ independently represents —$S(R_{11})$—, —$N(R_{12})(R_{13})$— or —$O(R_{14})$—; each of $Y_1$ and $Y_2$ independently represents —$S(R_{21})$—, —$N(R_{22})(R_{23})$— or —$O(R_{24})$—; each of $Z_1$ and $Z_2$ independently represents an alkylene group, an arylene group or a divalent heterocyclic residue; each of $L_1$ and $L_2$ independently represents a single bond, an alkylene group, —CO— or —$SO_2$—; Q represents an anionic ion; m is an integer of 0 to 4; provided that, when each of $X_1$ and $X_2$ independently is —$N(R_{12})(R_{13})$— and each of $Y_1$ and $Y_2$ independently is —$N(R_{22})(R_{23})$—, each of $L_1$ and $L_2$ independently represents —CO— or —$SO_2$—; each of $R_{11}$, $R_{14}$, $R_{21}$ and $R_{24}$ independently represents a hydrogen atom, an alkyl group, a cycloalkyl group, an alkenyl group, an alkynyl group, an aralkyl group, an aryl group or a heterocyclic group; each of $R_{12}$, $R_{13}$, $R_{22}$ and $R_{23}$ independently represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, an alkylsulfonyl group or an arylsulfonyl group; and, when $R_{12}$ or $R_{22}$ is a hydrogen atom, the N-position proton may be dissociated to thereby result in coordination with Pd(II); and the Pd(II) complex of the general formula (I-1) of the requirement (1) is represented by the following general formula (I-2):

(I-2-1)

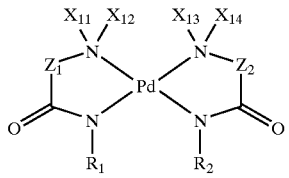

or (I-2-2)

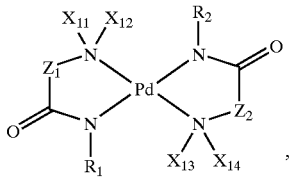

wherein each of $Z_1$ and $Z_2$ independently represents an alkylene group, an arylene group or a divalent heterocyclic residue; each of $R_1$ and $R_2$ independently represents a hydrogen atom, an alkyl group, an aryl group, a heterocyclic group, an acyl group, an alkoxycarbonyl group, an aryloxycarbonyl group, a carbamoyl group, an alkylsulfonyl group or an arylsulfonyl group; and each of $X_{11}$, $X_{12}$, $X_{13}$ and $X_{14}$ independently represents a hydrogen atom, an alkyl group, an aryl group or a heterocyclic group.

9. A silver halide color photographic lightsensitive material comprising the silver halide emulsion prepared by the process according to claim 1, wherein the lightsensitive material satisfies at least one selected from among the following requirements (1) to (3):

(1) at least one Pd(II) complex represented by the following general formula (I-1) is contained:

(I-1)

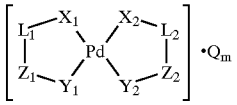

wherein each of $X_1$ and $X_2$ independently represents —$S(R_{11})$—, —$N(R_{12})(R_{13})$— or —$O(R_{14})$—; each of $Y_1$ and $Y_2$ independently represents —$S(R_{21})$—, —$N(R_{22})(R_{23})$— or —$O(R_{24})$—; each of $Z_1$ and $Z_2$ independently represents an alkylene group, an arylene group or a divalent heterocyclic residue; each of $L_1$ and $L_2$ independently represents a single bond, an alkylene group, —CO— or —$SO_2$—; Q represents an anionic ion; m is an integer of 0 to 4; provided that, when each of $X_1$ and $X_2$ independently is —$N(R_{12})(R_{13})$— and each of $Y_1$ and $Y_2$ independently is —$N(R_{22})(R_{23})$—, each of $L_1$ and $L_2$ independently represents —CO— or —$SO_2$—; each of $R_{11}$, $R_{14}$, $R_{21}$ and $R_{24}$ independently represents a hydrogen atom, an alkyl group, a cycloalkyl group, an alkenyl group, an alkynyl group, an aralkyl group, an aryl group or a heterocyclic group; each of $R_{12}$, $R_{13}$, $R_{22}$ and $R_{23}$ independently represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, an alkylsulfonyl group or an arylsulfonyl group; and, when $R_{12}$ or $R_{22}$ is a hydrogen atom, the N-position proton may be dissociated to thereby result in coordination with Pd(II);

(2) at least one water-soluble mercaptotetrazole compound represented by the following general formula (II-1) and at least one water-soluble mercaptotriazole compound represented by the following general formula (II-2) are contained:

(II-1)

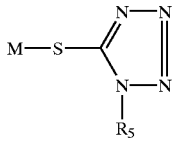

wherein $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms, —$COR_3$, —$COOR_3$ or —$SO_2R_3$; and $R_3$ represents a hydrogen atom, an alkyl group or an aryl group; and (II-2)

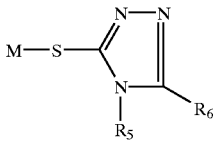

wherein $R_6$ represents a hydrogen atom, a substituted or unsubstituted alkyl group or a substituted or unsubstituted aryl group; $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms, —$COR_3$, —$COOR_3$ or —$SO_2R_3$; and $R_3$ represents a hydrogen atom, an alkyl group or an aryl group; and (3) thiocyanate ions are contained in the lightsensitive material in an amount of $2.5\times10^{-3}$ mol or less per mol of all the silver contained in the lightsensitve material.

10. The lightsensitive material comprising the silver halide emulsion prepared by the method according to claim 1, wherein the lightsensitive material satisfies the following requirements (1) to (3):

(1) at least one Pd(II) complex represented by the following general formula (I-1) is contained:

(I-1)

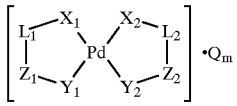

wherein each of $X_1$ and $X_2$ independently represents —$S(R_{11})$—, —$N(R_{12})(R_{13})$— or —$O(R_{14})$—; each of $Y_1$ and $Y_2$ independently represents —$S(R_{21})$—, —$N(R_{22})(R_{23})$— or —$O(R_{24})$—; each of $Z_1$ and $Z_2$ independently represents an alkylene group, an arylene group or a divalent heterocyclic residue; each of $L_1$ and $L_2$ independently represents a single bond, an alkylene group, —CO— or —$SO_2$—; Q represents an anionic ion; m is an integer of 0 to 4; provided that, when each of $X_1$ and $X_2$ independently is —$N(R_{12})(R_{13})$— and each of $Y_1$ and $Y_2$ independently is —$N(R_{22})(R_{23})$—, each of $L_1$ and $L_2$ independently represents —CO— or —$SO_2$—; each of $R_{11}$, $R_{14}$, $R_{21}$ and $R_{24}$ independently represents a hydrogen atom, an alkyl group, a cycloalkyl group, an alkenyl group, an alkynyl group, an aralkyl group, an aryl group or a heterocyclic group; each of $R_{12}$, $R_{13}$, $R_{22}$ and $R_{23}$ independently represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, an alkylsulfonyl group or an arylsulfonyl group; and, when $R_{12}$ or $R_{22}$ is a hydrogen atom, the N-position proton may be dissociated to thereby result in coordination with Pd(II);

(2) at least one water-soluble mercaptotetrazole compound represented by the following general formula (II-1) and at least one water-soluble mercaptotriazole compound represented by the following general formula (II-2) are contained:

(II-1)

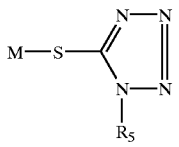

wherein $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms, —$COR_3$, —$COOR_3$ or —$SO_2R_3$; and $R_3$ represents a hydrogen atom, an alkyl group or an aryl group; and (II-2)

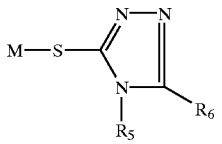

wherein $R_6$ represents a hydrogen atom, a substituted or unsubstituted alkyl group or a substituted or unsubstituted aryl group; $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms, —$COR_3$, —$COOR_3$ or —$SO_2R_3$; and $R_3$ represents a hydrogen atom, an alkyl group or an aryl group; and (3) thiocyanate ions are contained in the lightsensitive material in an amount of $2.5\times10^{-3}$ mol or less per mol of all the silver contained in the lightsensitve material.

11. A process for producing a lightsensitive silver halide emulsion comprising silver halide grains, wherein:

the emulsion contains tabular silver halide grains in an amount of at least 50% of the total projected area of all the silver halide grains, the average iodine content of all the silver halide grains is at least 2 mol %, the tabular silver halide grains have at least 10 dislocation lines per grain, and each of the silver halide grains has a twin face spacing of 0.017 $\mu$m or less; and the process comprises (step 1) set forth below, and the process comprises a step of performing chemical sensitization so that the silver halide grains have a selenium/gold molar ratio of 0.8 to 10, and comprises a step of performing spectral sensitization:

(step 1) performing the spectral sensitization in which a spectral sensitizer is added in the presence of 50 ppm or less of calcium, magnesium and strontium, followed by adding at least one water-soluble salt of a metal selected from the group consisting of calcium, magnesium and strontium, so that the concentration of calcium, magnesium and strontium becomes 100–2500 ppm, and then the chemical sensitization is started.

12. The process according to claim 11, wherein, in the crystal growth step of the silver halide grains, fine silver halide grains containing silver iodide in an amount of at least 95 mol % are formed by mixing together an aqueous solution of a water-soluble silver salt and an aqueous solution of a water-soluble halide by means of a mixer provided outside a reactor vessel for use in the crystal growth and, immediately after the formation of the fine silver halide grains, the fine grains are fed in the reactor vessel for use in the crystal growth.

13. The process according to claim 11, wherein, at the time of the chemical sensitization of the lightsensitive silver halide emulsion, a silver iodobromide emulsion prepared in advance is added and dissolved to thereby effect a shell attachment.

14. The process according to claim 11, wherein at least one complex selected from the group consisting of hexacyanoiron (II) complexes and hexacyanoruthenium complexes is added at the time of grain formation of the lightsensitive silver halide emulsion.

15. The process according to claim 11, wherein, at the time of the chemical sensitization of the lightsensitive silver halide emulsion, a silver iodobromide emulsion prepared in advance is added and dissolved to thereby effect a shell attachment; and at least one complex selected from the group consisting of hexacyanoiron (II) complexes and hexacyanoruthenium complexes is added at the time of grain formation of the lightsensitive silver halide emulsion.

16. The process according to claim 15, wherein, in the crystal growth step of the silver halide grains, fine silver halide grains containing silver iodide in an amount of at least 95 mol % are formed by mixing together an aqueous solution of a water-soluble silver salt and an aqueous solution of a water-soluble halide by means of a mixer provided outside a reactor vessel for use in the crystal growth and, immediately after the formation of the fine silver halide grains, the fine grains are fed in the reactor vessel for use in the crystal growth.

17. A silver halide color photographic lightsensitive material comprising a support and, superimposed thereon, at least one blue-sensitive silver halide emulsion layer containing a yellow coupler, at least one green-sensitive silver halide emulsion layer containing a magenta coupler, at least one red-sensitive silver halide emulsion layer containing a cyan coupler and at least one hydrophilic protective colloid layer;

wherein calcium ions, magnesium ions and strontium ions are contained in a coating amount, in terms of atomic weight, of $8.0\times10^{-2}$ g or less per g of all the gelatin contained in the lightsenstive material; and wherein the emulsion prepared by the process according to claim 11 is contained.

18. The lightsensitive material comprising the silver halide emulsion prepared by the method according to claim 11, wherein the lightsensitive material satisfies the following requirements (1) to (3):

(1) at least one Pd(II) complex represented by the following general formula (I-1) is contained:

(I-1)

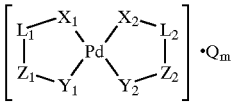

wherein each of $X_1$ and $X_2$ independently represents —$S(R_{11})$—, —$N(R_{12})(R_{13})$— or —$O(R_{14})$—; each of $Y_1$ and $Y_2$ independently represents —$S(R_{21})$—, —$N(R_{22})(R_{23})$— or —$O(R_{24})$—; each of $Z_1$ and $Z_2$ independently represents an alkylene group, an arylene group or a divalent heterocyclic residue; each of $L_1$ and $L_2$ independently represents a single bond, an alkylene group, —CO— or —$SO_2$—; Q represents an anionic ion; m is an integer of 0 to 4; provided that, when each of $X_1$ and $X_2$ independently is —$N(R_{12})(R_{13})$— and each of $Y_1$ and $Y_2$ independently is —$N(R_{22})(R_{23})$—, each of $L_1$ and $L_2$ independently represents —CO— or —$SO_2$—; each of $R_{11}$, $R_{14}$, $R_{21}$ and $R_{24}$ independently represents a hydrogen atom, an alkyl group, a cycloalkyl group, an alkenyl group, an alkynyl group, an aralkyl group, an aryl group or a heterocyclic group; each of $R_{12}$, $R_{13}$, $R_{22}$ and $R_{23}$ independently represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, an alkylsulfonyl group or an arylsulfonyl group; and, when $R_{12}$ or $R_{22}$ is a hydrogen atom, the N-position proton may be dissociated to thereby result in coordination with Pd(II);

(2) at least one water-soluble mercaptotetrazole compound represented by the following general formula (II-1) and at least one water-soluble mercaptotriazole compound represented by the following general formula (II-2) are contained:

(II-1)

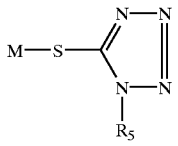

wherein $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms, —$COR_3$, —$COOR_3$ or —$SO_2R_3$; and $R_3$ represents a hydrogen atom, an alkyl group or an aryl group; and (II-2)

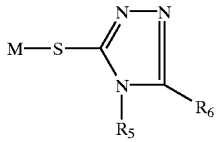

wherein $R_6$ represents a hydrogen atom, a substituted or unsubstituted alkyl group or a substituted or unsubstituted aryl group; $R_5$ represents an organic residue substituted with at least one member selected from the group consisting of —$SO_3M$, —COOM, —OH and —$NHR_2$; M represents a hydrogen atom, an alkali metal atom, a quaternary ammonium group or a quaternary phosphonium group; $R_2$ represents a hydrogen atom, an alkyl group having 1 to 6 carbon atoms, —$COR_3$, —$COOR_3$ or —$SO_2R_3$; and $R_3$ represents a hydrogen atom, an alkyl group or an aryl group; and (3) thiocyanate ions are contained in the lightsensitive material in an amount of $2.5\times10^{-3}$ mol or less per mol of all the silver contained in the lightsensitve material.

* * * * *